US009885209B2

(12) United States Patent
Konstantin

(10) Patent No.: US 9,885,209 B2
(45) **Date of Patent: *Feb. 6, 2018**

(54) LIGHT-CONTROL ASSEMBLY

(71) Applicant: CPI DAYLIGHTING, INC., Lake Forest, IL (US)

(72) Inventor: Moshe Konstantin, Highland Park, IL (US)

(73) Assignee: CPI DAYLIGHTING, INC., Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/548,065

(22) Filed: Nov. 19, 2014

(65) Prior Publication Data

US 2015/0107158 A1 Apr. 23, 2015

Related U.S. Application Data

(60) Division of application No. 13/589,835, filed on Aug. 20, 2012, now Pat. No. 8,893,434, which is a (Continued)

(51) Int. Cl.

| | |
|---|---|
| ***E06B 9/386*** | (2006.01) |
| ***E06B 7/096*** | (2006.01) |
| ***E06B 9/264*** | (2006.01) |
| ***E06B 9/28*** | (2006.01) |
| ***E06B 3/32*** | (2006.01) |

(Continued)

(52) U.S. Cl.

CPC ..... *E06B 7/096* (2013.01); *E04F 10/10* (2013.01); *E06B 3/32* (2013.01); *E06B 7/098* (2013.01); *E06B 7/10* (2013.01); *E06B 9/264* (2013.01); *E06B 9/28* (2013.01); *E06B 2009/2643* (2013.01)

(58) Field of Classification Search

CPC ..... E06B 9/386; E06B 7/098; E06B 7/096; F24F 13/075; F24F 13/1406

USPC .... 160/236, 176.1 R, 176.1 V, 177 R, 177 V, 160/168.1 R, 168.1 V; 49/91.1, 92.1

See application file for complete search history.

(56) References Cited

U.S. PATENT DOCUMENTS

| | | | |
|---|---|---|---|
| 2,185,712 | A | 1/1940 | Rowley |
| 3,012,294 | A | 12/1961 | Waldor |

(Continued)

FOREIGN PATENT DOCUMENTS

| | | | |
|---|---|---|---|
| JP | 2004294053 | A | 10/2004 |
| JP | 2005140386 | A | 6/2005 |
| WO | 2010013233 | A2 | 2/2010 |

OTHER PUBLICATIONS

Supplemental European Search Report for European Application No. 13839170, dated May 17, 2016, 5 pages.

*Primary Examiner* — Katherine W Mitchell
*Assistant Examiner* — Johnnie A. Shablack
(74) *Attorney, Agent, or Firm* — Michael Best & Friedrich LLP

(57) ABSTRACT

A light-control assembly including a modular beam with a plurality of adjacent circular bores separated by web portions, and a series of light-controlling members with laterally compliant edge structures mounted in the beam so that the edge structures accommodate the webs between the bores when the light-controlling members are closed to achieve enhanced, blackout or near blackout light-blocking along the edges of the light-controlling members.

12 Claims, 41 Drawing Sheets

Related U.S. Application Data continuation-in-part of application No. 12/903,904, filed on Oct. 13, 2010, now Pat. No. 8,245,444, and a continuation-in-part of application No. 10/600,261, filed on Jun. 20, 2003, now Pat. No. 7,281,353.

(51) Int. Cl.

| | |
|---|---|
| ***E06B 7/098*** | (2006.01) |
| ***E06B 7/10*** | (2006.01) |
| ***E04F 10/10*** | (2006.01) |

(56) References Cited

U.S. PATENT DOCUMENTS

| | | | | |
|---|---|---|---|---|
| 3,120,035 | A | 2/1964 | Morris | |
| 3,484,990 | A | 12/1969 | Kahn et al. | |
| 3,540,154 | A | 11/1970 | Claudio | |
| 3,746,042 | A | 7/1973 | Finkel | |
| 3,771,559 | A | 11/1973 | Alley | |
| 4,435,919 | A | 3/1984 | Poisson | |
| 4,461,277 | A | 7/1984 | Pardo | |
| 4,469,132 | A | 9/1984 | Redington | |
| 6,499,255 | B1 | 12/2002 | Givoni | |
| 8,056,289 | B1 | 11/2011 | Konstantin | |
| 8,893,434 | B1 * | 11/2014 | Konstantin | E06B 7/096 160/236 |
| 2006/0238994 | A1 | 10/2006 | Chery et al. | |
| 2010/0287858 | A1 | 11/2010 | Israeli | |
| 2011/0067824 | A1 | 3/2011 | Konstantin et al. | |

* cited by examiner

LIGHT-CONTROL ASSEMBLY

CROSS-REFERENCE TO RELATED PATENT APPLICATIONS

This application is a divisional of U.S. patent application Ser. No. 13/589,835 filed Aug. 20, 2012 which is U.S. Pat. No. 8,893,434, which is a continuation-in-part of U.S. patent application Ser. No. 12/903,904 filed Oct. 13, 2010, now U.S. Pat. No. 8,245,444, and Ser. No. 10/600,261 filed Jun. 20, 2003, now U.S. Pat. No. 7,281,353. The entire disclosures of the foregoing patent applications are hereby incorporated by reference.

FIELD OF THE DISCLOSURE

This disclosure pertains to architectural structures designed to pass light and, more particularly, to transparent/translucent panel systems for controlling the level of light admitted through horizontal and sloped glazing, skylights, roofs, walls, and other architectural structures designed to pass light and to readily constructed light-control assemblies designed for reliable light-blocking that are particularly effective in dynamic control of daylighting and shading. In the light-control assemblies elongated light control members such as opaque or translucent slats or other light-blocking members are rotated up to 360° by applying rotary force to the light-blocking members to achieve black-out or near black-out conditions. The assemblies achieve unusually effective light-blocking through the use of beams having circular bores with laterally compliant and other light-blocking members.

BACKGROUND

The U.S. Department of Energy as well as sustainable construction organizations and the like are pressing for the installation of dynamic daylighting and shading systems to improve energy efficiency in buildings. Innovations are sorely needed to meet this need.

Various types of transparent and translucent glazing systems are available for the construction of horizontal, vertical and sloped glazing in skylights, roofs, walls, and other architectural structures designed to pass light for daylighting interiors or other purposes. When using such glazing systems, it is therefore desirable, in accord with sustainable construction criteria, to optimize the system's shading coefficient to reduce solar heat gain on hot summer days and during peak sunlight hours year round, while providing maximum light and solar heating on cold winter days and when it is otherwise needed or desired. It is also often desirable to control glare and direct sunlight in order to ensure the comfort of those who occupy the space exposed to the glazing system. If architects and space planners can be freed from the constraints of current light transmission control in horizontal, vertical and sloped glazing in skylights, roofs, walls, and other architectural structures, they will be able to maximize interior daylight without the burden of unmanaged heat gain or discomforting glare more effectively address these shading requirements and meet sustainable construction criteria. Furthermore, these considerations apply as well to shading of open unglazed areas.

Indeed, if the level of light entering overhead large glazed as well as unglazed areas can be simply, efficiently, effectively and uniformly controlled with little or no light leakage between, e.g., multiple adjacent light-controlling members, it will provide architects and space planners with important new tools. They will be able to maximize energy efficiency with aesthetic and sustainable designs to a degree not previously possible. And, sun tracking control shading systems can dynamically rotate light-blocking members up to 360° to efficiently shade small or large glazed and open, unglazed areas to provide the desired uniform light level inside the space thereunder would be particularly desirable.

The known approaches to controlling the amount of light admitted through glazing systems—particularly on a large scale and in overhead, horizontal and sloped glazing applications—are limited and are generally unreliable, noisy and often difficult and expensive to construct, assemble on-site, maintain and service. Also, existing approaches suffer from non-uniform and excessive light leakage between adjacent light-controlling members which appears as an aesthetically undesirable series of often irregular bright lines. Additionally, although it is often desirable to retrofit light-controlling systems to already constructed glazing systems, this is not easily accomplished with current light-controlling systems. There is therefore substantial need for an economic and readily constructed and retrofitted light-controlling system that may be used for shading glazed areas of all sizes, including very large glazed areas. There is also substantial need for such light-controlling systems that can be easily assembled, maintained and serviced, in which the light is uniformly distributed across the glazed area, and in which light leakage is de minimis or eliminated or, where present, is kept to narrow and regular lines.

Prior approaches to controlling the level of light passing into architectural structures have included louver blind assemblies using pivoting flexible light-controlling members operable behind a window or sandwiched inside a chamber formed by a double-glazed window unit. Such louver blinds require substantial support of the flexible members which, additionally, must be controlled from both their distal and their proximal ends. Furthermore, louver blinds are difficult and expensive to assemble, apply, operate, maintain and replace, and cannot be readily adapted for use in non-vertical applications or in applications in which it is either desirable or necessary to control the flexible members from only one end. Louver blinds are particularly problematic when it comes to applications in which the installation requiring light-control or shading is very long, e.g., 10 ft., 20 ft., 40 ft., 60 ft. or more. In addition, dynamic control of louver blinds in large overhead shading applications is complicated, expensive, difficult to install and maintain, and often simply impractical. Furthermore, rotating louver blinds require that rotary force be applied to the top edge of the blinds. This is because louver blinds are flexible and rely on the force of gravity to hang vertically in the proper desired position and therefore cannot be rotated from their base. Thus, louver blinds cannot be used in generally horizontal overhead glazing application or in sloped applications, where rotation must be controlled from the base or proximal end and the force of gravity on non-vertical louver blinds would create untold complications and very non-uniform shading.

Other approaches to controlling the level of light passing through architectural structures have used motorized shades or drapery. These approaches are also problematic, particularly in the applications noted above where the glazing is large and would require very long shades or blinds, e.g., on the order of 10 ft., 20 ft., 40 ft., 60 ft. or more, since such large shades would be heavy, difficult to manipulate and maintain, and expensive. The mechanics of controlling and manipulating motorized shades or drapery of any size is quite complicated and therefore motorized shades and drapery are expensive and difficult to maintain. Also, it is not possible to achieve uniform light distribution across a wide glazed space with motorized shades or drapery.

U.S. Pat. Nos. 7,281,353; 6,499,255; and 6,978,578 provide other more recent approaches to addressing the challenge of providing dynamic daylighting and shading systems on a large scale and in overhead, horizontal and sloped glazing applications. These patents utilize a plurality of rotatably-mounted light-blocking tubular members having at least one portion that is substantially opaque and means for rotating the light-blocking members to block out varying amounts of radiation by varying the area of the opaque portions presented to the incoming light. In the systems described in the above three patents, the light-blocking members are combined in a series of adjacent segregated elongated tubular cells or mounted for rotation in individual or paired cross-members positioned between light transmitting panels. As an alternative to tubular members, a generally rigid opaque member may be used if fitted with rings spaced along this member. Indeed, even the tubular members may be fitted with such rings in order to facilitate tubular member rotation and to improve performance. Attachment of the rings requires notching of the generally rigid opaque member and can be difficult and time-consuming for both generally flat and tubular members. Also, the rings, which unfortunately may interfere with light-blocking, must nevertheless be wide enough to accommodate longitudinal movement due to thermal expansion and contraction. Determining the width and location of the rings and ring-receiving notches is complex and, indeed, may require architectural approval before being implemented in custom applications, often making the use of such rings inconvenient and expensive.

In the system of the '578 patent, the centers of rotation of the light-blocking members do not remain in place as the light-blocking members are rotated resulting in increased torque and load on the motor and varying horizontal positioning of the light-controlling members. Since the light-blocking members often do not run true because they are inadequately restrained and therefore bend and snake about as they rotate, they produce uneven and continuously varying spacing between adjacent members with uneven light distribution and an unacceptable appearance of disarray of the light-blocking members. When these light-blocking members are used in vertically oriented applications, they can disengage from lower-cross-members and run far more untrue with even greater increases in the torque/motor load and irregular lateral movement. When they are used in applications calling for an inclined orientation, the light-blocking members tend to disengage from the lower cross members and rotate in an uncontrolled manner, rubbing against one another, resulting in increased friction and torque and producing problematic noise. Finally, in tests simulating the application of snow and wind loads, excessive friction is produced between the light-blocking members and the cross-members which could cause early failure.

The paired upper and lower cross members of the '353 patent solve the above problems. Also, when this system is in the fully closed position, there may be more light leakage than often desired.

While the designs provided by the above three patents represent important advances in the art, they have another drawback. For these designs, the light-blocking components of adjacent tubular members cannot come sufficiently close to each other when the systems are in their fully closed configuration due to intervening structural features. Therefore total blackout or near total blackout light blocking cannot be achieved.

We provide a significantly improved design in one of our two patent applications, U.S. patent application Ser. No. 12/903,904 filed Oct. 13, 2010. In the '904 application, a beam with adjacent bores separated by web portions is described. Bearing members comprising an annular ring are dimensioned to fit within the bores and are provided with a flange extending radially outwardly from the rings. The bearings are mounted to the beam with the flanges in an offset fashion. A first bearing member is mounted in a first bore with its flange adjacent to a first beam face, its ring extending into the bore and a next bearing member mounted in a next adjacent bore with its flange adjacent the opposite beam face and its ring extending into the bore. This bearing structure and disposition makes it possible to bring the edges of adjacent light-controlling members close together when the members are closed making them more effective in light-blocking than has heretofore been thought possible.

However, in various applications, including where the web portions in the beam of the '904 application between the bores are increased in width for structural or other reasons, it is desirable to provide alternative embodiments to achieve total or near total blackout where the adjacent edges of the light-blocking members are able to span the increased width webs between adjacent bores.

The present system provides a transparent/translucent panel unit in which the transmission of light across the system can be adjusted from almost full transparency or translucency to near total opacity.

SUMMARY

It is an objective to provide light-control assemblies in which the transmission of light can be adjusted from almost full transparency or passage of light to total black-out or near total black-out.

It is another objective to provide light-control assemblies that is reliable, quiet in operation, and readily constructed, maintained and serviced.

It is yet another objective to provide light-control assemblies that may be readily assembled on-site and that can be used in both new construction and retrofit applications.

It is still a further objective to provide a light-control assembly that accommodates thermal expansion and contraction of the components of the assembly, including the light-controlling members, when the assembly is subjected to wide-ranging temperature changes at the site of installation so that, e.g., slats in the assembly can move longitudinally within bearing members free from limitations imposed by rings and notches as the slats lengthen or shorten due to temperature swings.

Still another objective is to provide light-control assemblies that may be readily used with horizontal, vertical and sloped glazing in skylights, roofs, walls and other glazed and open unglazed architectural structures designed to pass light for daylighting interiors or other purposes.

Another objective is to provide light-control assemblies that can be readily serviced on-site.

Yet another objective is to provide light-control assemblies that can be spaced along any desired length of adjoining very long light-blocking members to accommodate rotation of the light-blocking members up to 360° by applying a rotary force about their longitudinal axes at only one end of the light-blocking members.

A still further objective is to provide light-control assemblies that can simply and efficiently be used with photovoltaic members.

Another objective is to provide light-control assemblies that can be made of modular components so larger assemblies can be economically and readily constructed and used in dynamic control of daylighting and shading in applications of varying widths.

A still further objective is to provide light-control assemblies that can accommodate radius bends in light-blocking members and that will continue to operate reliably in such installations.

It is still another objective to provide light-control assemblies with light-controlling members that may be free of notching and/or rings or other material removal and can be easily and simply slid into position.

It is a further objective to provide efficient, economic means for supporting and maintaining light-controlling members in panel units having spaced flat panels or sheets in ways not heretofore thought possible.

These and other objectives will become apparent to those skilled in the art upon consideration of the accompanying specification, claims and drawings.

BRIEF DESCRIPTION OF THE DRAWINGS

Features, objects and advantages of embodiments may be best understood by reference to the following description, taken in conjunction with the following drawings, in which like reference numerals identify like elements in the several figures, and in which:

FIG. 20D is an end elevation view of yet another light-controlling member mounted in a bearing member circular bore;

DETAILED DESCRIPTION

Figure 1:
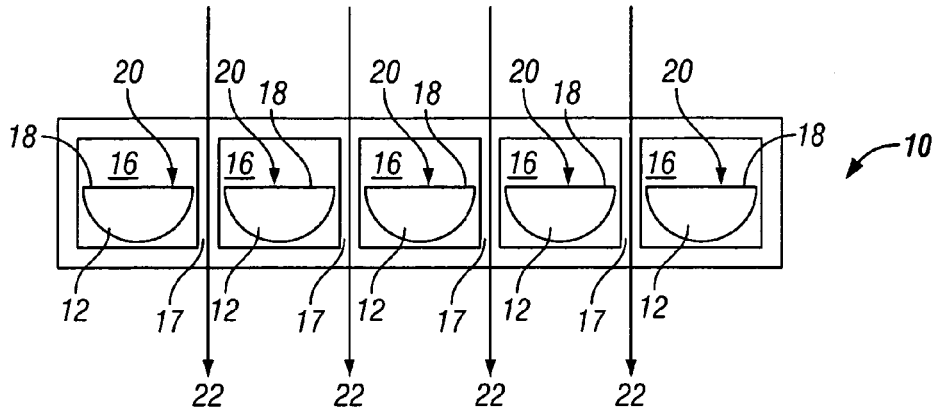
FIG. 1 (Prior Art)
FIG. 1 is an elevational view of a portion of a prior art panel in accordance with the teaching of U.S. Pat. No. 6,499,255.

Turning first to FIG. 1, an elevational view of a transparent or translucent panel 10 in accordance with the teaching of prior U.S. Pat. No. 6,499,255 is shown. Panel 10 includes a series of half-cylinder louvers 12 rotatably mounted in a series of adjacent, segregated cells 16 separated by walls 17. Louvers 12 each have an opaque top surface 18. Thus, in the illustrated embodiment where the louvers are in the fully closed position, light rays 20 strike opaque surfaces 18, which block light transmission through the louvers. Unfortunately, the transparent or translucent material in the walls 17 between adjacent cells remains unblocked, which means that light rays 22 will penetrate the panel through these walls. Thus, even with all of the louvers in the fully closed position, the panels of the '255 patent admit light: in one commercial embodiment of this invention, the panels have been found to admit a minimum of about 6% light transmission. Also, the panel of the '255 consists of one integral, hollow core, multi-cell panel with inserted radiation-blocking members in the cells, which means that serviceability and maintenance options are limited.

The panel systems of the present invention are referred to as being transparent/translucent. It is intended to mean by this that the panel systems range from transparent (transmitting light rays so that objects on one side may be distinctly seen from the other side) through translucent (letting light pass but diffusing it so that objects on one side cannot be clearly distinguished from the other side). Also, the panel systems may be tinted. Typical tinting colors include white, bronze, green, blue, and gray, although other colors may be used. Further, the panels may have a matte finish. Finally, combinations of different top and bottom panels may be used, such as clear/clear, white/clear, clear/white, bronze/clear, green/clear, green/white, bronze/white, white/white, etc.

Also, when reference to "light" is made in the description of the present invention, it should be construed to include the spectral range of visible light as well as electromagnetic radiation below and/or above that spectral range.

Figure 2A:
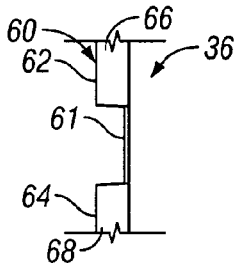
FIG. 2A is a partial enlarged view of the spacer rails of FIG. 2.
Figure 2B:
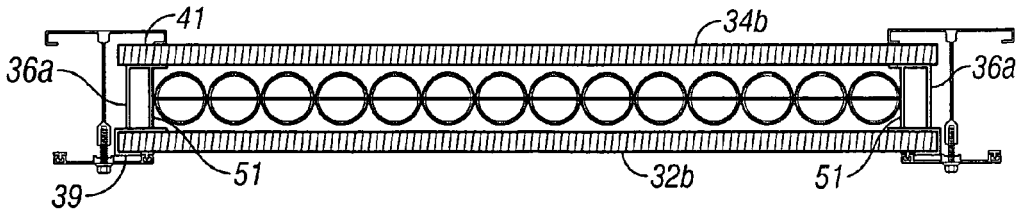
FIG. 2B is an elevational view of an alternate panel joining arrangement in accordance with the present embodiments.
Figure 2:
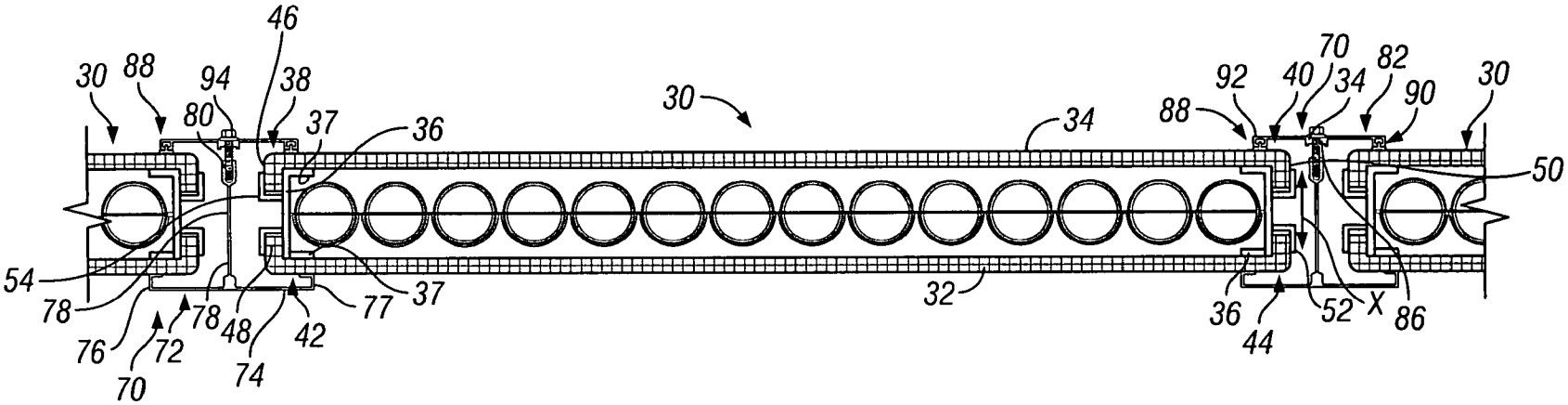
FIG. 2 is a front elevation view of a panel unit in accordance with present embodiments, attached to adjacent panel units which are shown in partial view.

Turning now to FIG. 2, a panel system unit 30 in accordance with the invention is shown consisting of two generally flat transparent/translucent panels, including an interior panel 32 and an exterior panel 34. Panels 32 and 34 are generally parallel and are separated a distance "x" by elongated spacer rails 36 with top and bottom ledges 37 which extend along the lateral edges 38, 40, 42 and 44 of the interior and exterior panels. This spacing may be of any desired size, since the spacing of the panels can be adjusted to accommodate whatever diameter is chosen. While panels 32 and 34 may be of any desired width, currently preferred widths are 24, 48 and 60 inches. Also, while the panels may also be any desired length, it is currently intended that panels about 2 feet to 60 feet in length will be used.

Figure 3:
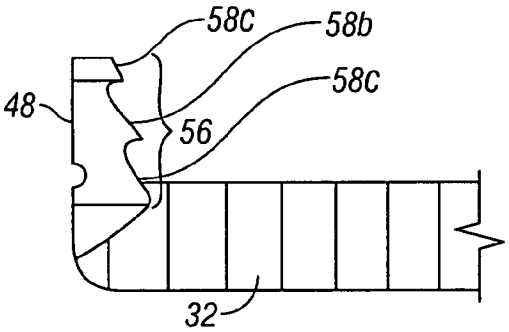
FIG. 3 is an enlarged partial front elevation view of one panel joining flange which may be used with the present embodiments.

The lateral edges of the panels may be provided with respective panel joining flanges 46, 48, 50 and 52 for conveniently assembling the panels together. In one such panel-joining arrangement, the flanges each have a smooth outer face 54 and an inner face 56 with tooth-like detents 58*a*-58*c* (FIG. 3), whose function will be explained below. A similar joining flange structure is described, for example, in U.S. Pat. No. Re. 36,976, the contents of which are incorporated herein by reference. Also, panels with different panel joining flange designs and other panel-joining arrangements may be used.

As seen best in FIG. 2A, spacer rails 36, in turn, each have an outer bracket 60 shaped as shown, to provide a middle attachment section 61 and offset ends 62 and 64. The brackets are attached to the outer surface of each of the spacer rails by conventional means, with attachment section 61 centered along the rails, thereby defining top and bottom channels 66 and 68 between the outer surface of the spacer rails and the inner surface of the bracket. The channels are dimensioned to accept flanges 48-52 in a tightly fitting manner to firmly and sealingly join the panels under an elastic deformation of the detents. Thus, when the panels are pressed home to assemble the panel system unit with the inner surfaces of panels 32 and 34 abutting ledges 37, there is resistance to removal of either of the panels from these channels. If and when a repair is needed, it is necessary only to release one corner of the panel flange with an appropriate tool, and then continue to zip it along the length of the panel to release the entire panel. The panel can be reinstalled after the repair is completed by again pressing the panels home to seat the panel flanges in the channels.

An alternate panel-joining arrangement is depicted in FIG. 2B. In this embodiment, internal and external panels 32*a* and 34*b* may be any appropriate sheet material. The sheets are held together in this embodiment by retainers 36*a* which extend along the opposite lateral edges of the sheets. Retainers 36*a* include two channels 39 and 41 in which the lateral edges of the sheets snugly rest and a spacer 51 carrying the flanges at the desired sheet spacing of the panel system. The retainers preferably are made of aluminum or of another metal which either inherently resists corrosion or is treated to resist corrosion.

Any number of fully assembled panel units 30 can be joined to adjacent panel units to achieve the panel system width called for in a particular application. Adjoining panel units may be fixed to each other using a clamping system 70. This clamping system includes a bottom member 72 with a base 74 and elongated bottom pedestals 76 and 77 along each lateral edge of the base. An upstanding bracket 78 along the center of the base with a series of screw thread-receiving apertures 80 along its length. Clamping system 70 also includes a top member 82 with an upstanding reinforcing strip 84 along its center and a series of screw-receiving apertures 86 running along the strip. Along each lateral edge of the top portion, a pair of elongated top pedestals 88 and 90 are provided with apertures for receiving resilient sealing gaskets 92.

In order to join the adjacent lateral edges of the panel units, the clamping members are positioned as illustrated, with elongated bottom pedestals 76 and 77 abutting the exposed surface of the interior panels and sealing gaskets 92 of top pedestals 88 and 90 abutting the top surface of the exterior panels. A series of screws 94 spaced, for example, at intervals of about 8-16 inches, are passed through the apertures 86 and into the thread-receiving apertures 80, and screwed home to lock the clamping member together and seal the connection from outside elements.

Figure 4:
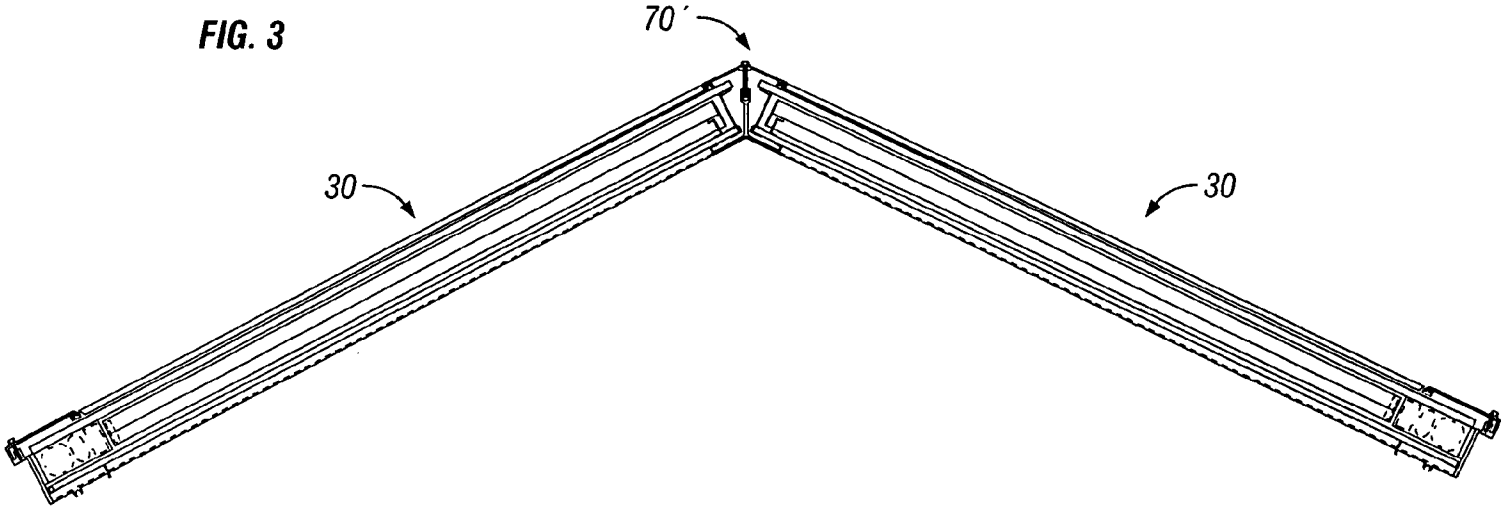
FIG. 4 is a front elevation view of adjacent panel units angled with respect to each other to form a roof ridge.
Figure 5:
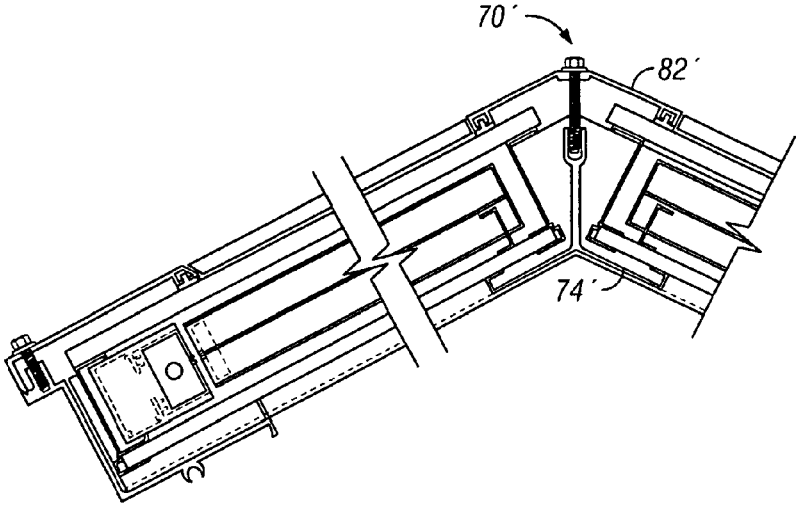
FIG. 5 is a partial enlarged view of a portion of the structure illustrated in FIG. 4.

FIGS. 4 and 5 illustrate an alternate application of the invention where adjacent panel units are angled with respect to each other to form a roof ridge. In this embodiment, a modified clamping system design 70' is used. This modified clamping system generally corresponds to clamping system 70 except that base 74' and top member 82' are angled to produce the desired ridge slope.

Figure 6:
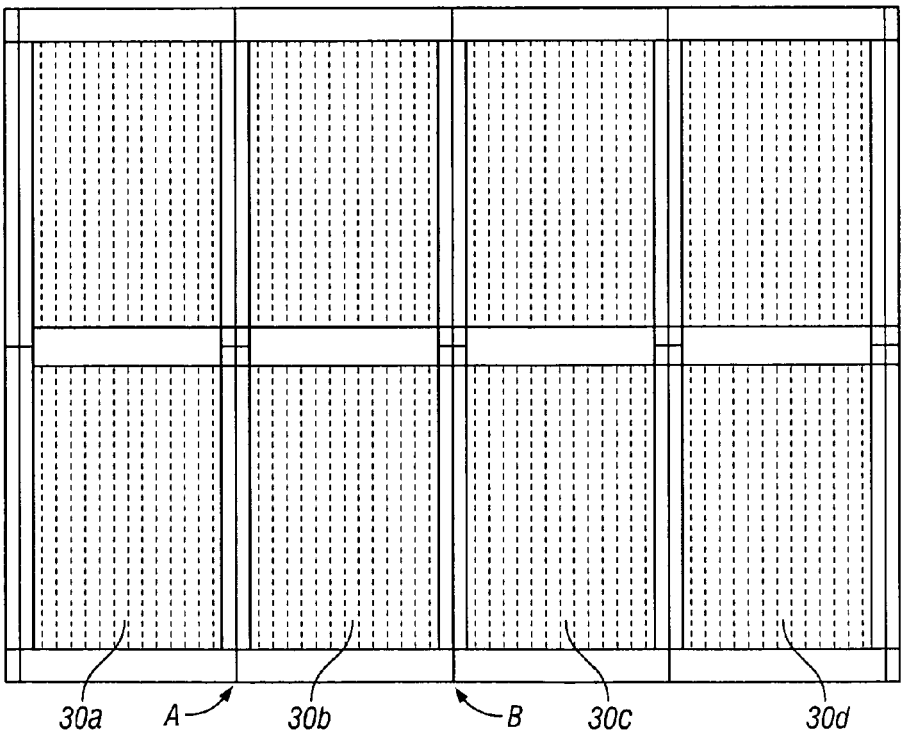
FIG. 6 is a plan view, of a portion of the structure illustrated in FIG. 4.
Figure 7:
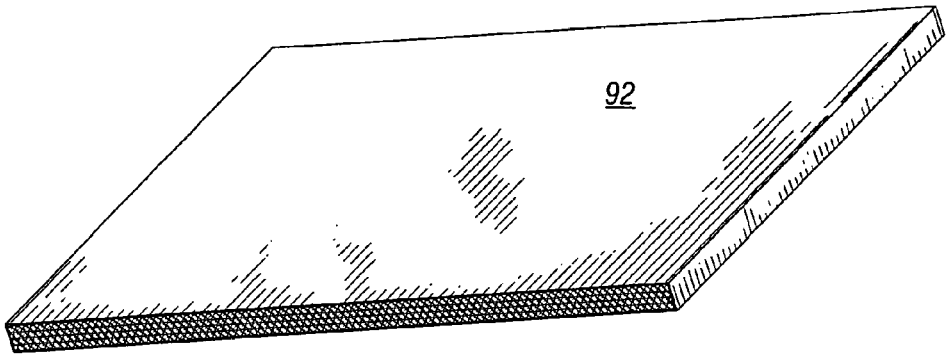
FIG. 7 is a perspective view of a honeycomb polycarbonate translucent panel which may be used in constructing a panel unit in accordance with the present embodiments.

A series of four panel units assembled to produce a panel system for use in a skylight is illustrated in FIG. 6. In this fully assembled system, the four panel units 30*a*, 30*b*, 30*c*, and 30*d* are each individually assembled and joined to adjacent panel units as illustrated in FIG. 2 and described above.

The use of removably mounted interior and exterior panels facilitates easy replacement of damaged panels without exposing the interior of the enclosed structure. Adding or replacing a double-layer on other glazing system, in contrast, would be significantly more difficult and expensive, and could produce damage requiring repairs that interrupt the function of the architectural structure in which the panel system is mounted.

Thus, assuming for purposes of illustration that exterior panel of panel unit 30*b* has to be removed to remedy a problem within the panel unit. This can be accomplished by inserting an appropriate tool at point A to remove the leading corner of the panel flange from its corresponding channel and then continue to zip it along the length of the panel to release the entire panel. This is repeated at point B whereupon the entire panel is removed, the problem is remedied and the exterior panel re-installed by positioning the flanges adjacent the channels and pressing the exterior panel home as describe earlier. It should be noted that this entire repair operation can be accomplished without disturbing the interior panel of the panel unit. Also, either of the sheets of the alternative panel-joining arrangement of FIG. 2B may be removed in a similar fashion by slipping the appropriate channel from the edge of the sheet which is to be removed and reattaching the channel when the repair is completed.

A wide variety of different types of panels made of various transparent and translucent materials may be used, including, but not limited to, plastics (including, but not limited to, polycarbonates and acrylics), fiberglass, perforated metal fabric, or glass. It is preferred, however, that the panels have at least the appropriate light transmitting properties and a minimum resistance to impact of about 10 ft/lb. Also, a UV-resistant architectural face can be co-extruded with the panel to minimize the need for periodic resurfacing.

In one preferred embodiment, a Pentaglas® honeycomb polycarbonate translucent panel available from CPI International Inc. (Lake Forest, Ill.) will be used. These polycarbonate panels are described in U.S. Pat. No. 5,895,701, which is incorporated herein by reference, have an integral extruded honeycomb structural core consisting of small honeycomb cells approximately 0.16 inch by 0.16 inch which provides internal flexibility to absorb expansion and minimize stress and resists impact buckling. The resulting design offers smaller spans between rib supports, resulting in stronger durability, as well as superior light quality, visual appeal, higher insulation and excellent UV resistance. The internal flexibility of the panels absorbs thermal expansion through the panel in all directions (on the x, y, and z axes). This minimizes stress in all directions and preserves dimensional stability. The panels also have a high impact absorbing and load bearing property, a good ratio of weight to strength, and UV protection on both sides of the panel. The superior light diffusion capabilities ensure excellent quality of natural light. The panels are environmentally friendly, non-toxic, and made of 100% recyclable material.

Figure 8:
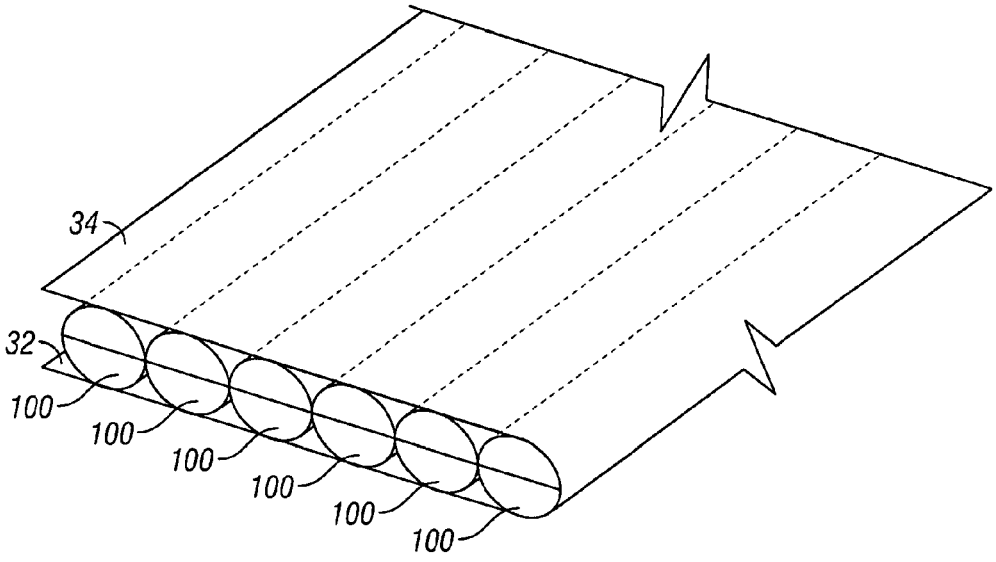
FIG. 8 is a diagrammatic perspective view of a series of abutting light-controlling members.

A series of elongated rotatably mounted light-controlling members 100 corresponding in length to the length of the panel units are disposed between panels 32 and 34, as represented in a diagrammatic perspective fashion in FIG. 8. As described below, the light-controlling members may be of a variety of different structures. In a preferred embodiment, the light-controlling members will have a circular outer rotation surface (e.g., an elongated tube or a series of outer annular members disposed along the light-controlling members generally perpendicularly to the longitudinal axes of the light-controlling members) extending at least about 180° around their circumference. In the illustrated embodiment, the light-controlling members abut each other (tolerance about 1-3 mm) to maximize the light blocking capability of the system. This is a preferred embodiment of the invention. However, in alternative embodiments, the light-controlling members may be spaced from each other permitting some light to pass between adjacent light-controlling members, so long as the circular engagement surfaces of adjacent light-controlling members remain in contact.

Figure 9:
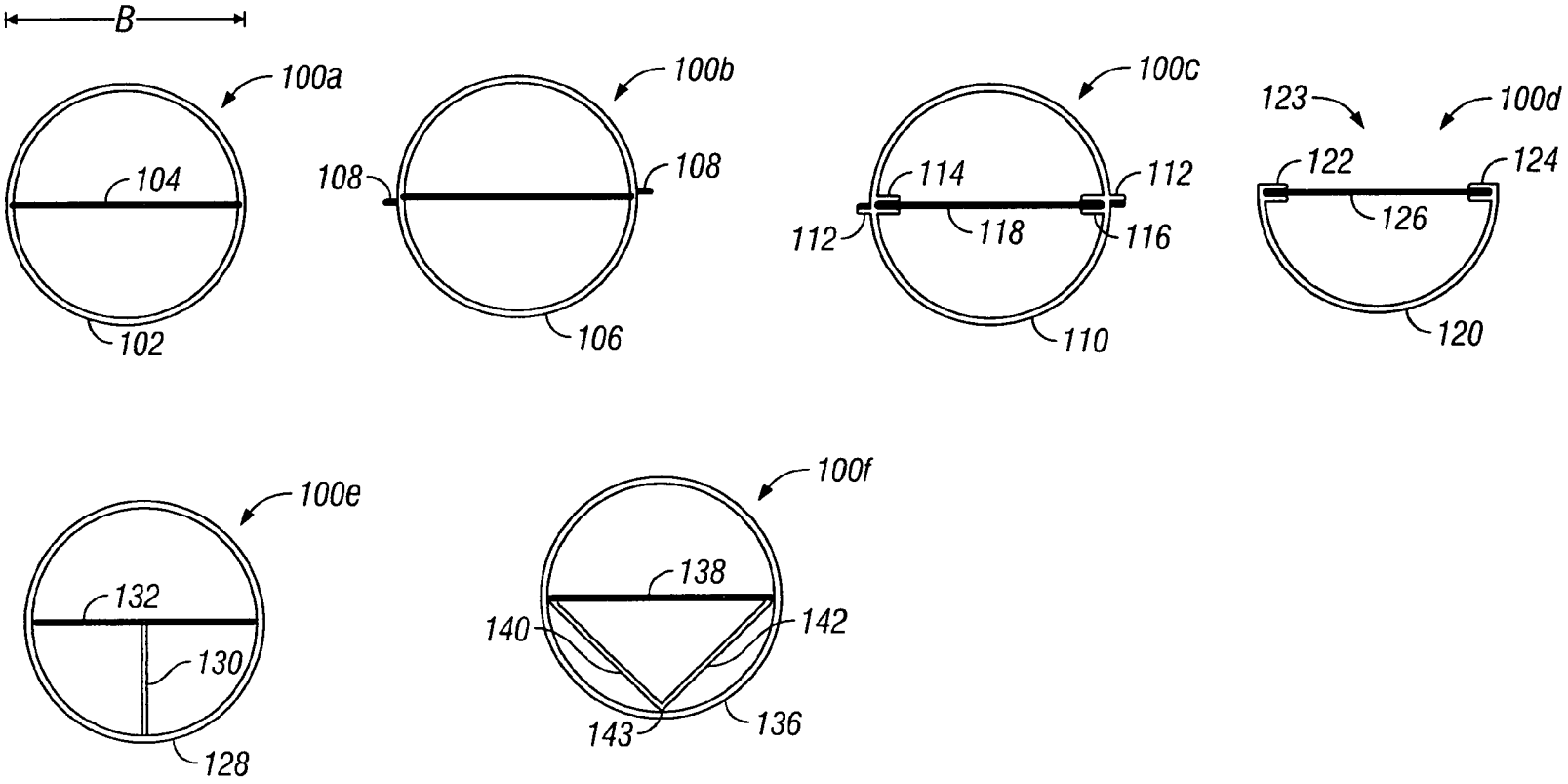
FIG. 9 is a series of alternative designs of light-controlling members which may be used in present embodiments.

A series of alternative designs of the light-controlling members 100 are illustrated in cross-section in FIG. 9. For example, a light-controlling member 100*a* may be used, comprising a generally elongated transparent or translucent tube 102 having a diameter "B". A generally planar light-blocking or opaque member 104 is positioned in the tube across its diameter by co-extruding the outside tubular wall and the light-blocking or opaque member or by inserting the light-blocking or opaque member in a preformed tube.

Figure 9A:
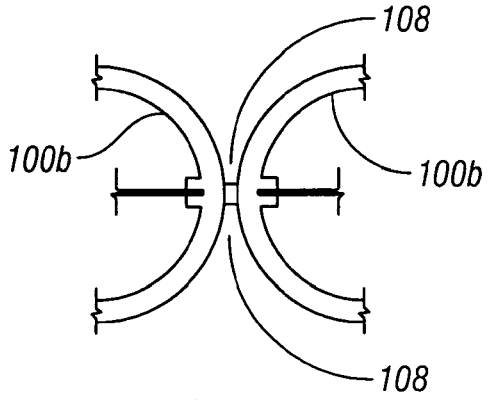
FIG. 9A is an enlarged partial view of a pair of particular light controlling members in abutting position.
Figure 9B:
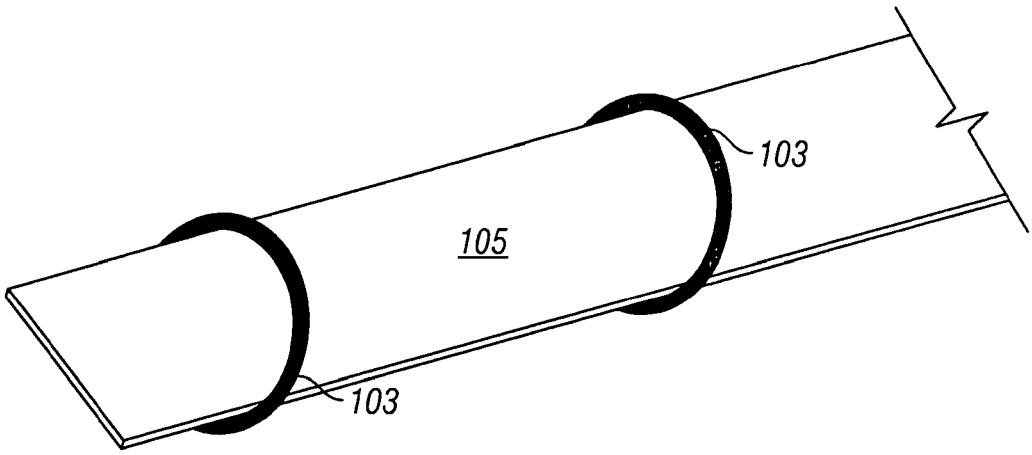
FIG. 9B is a partial view of a light-controlling member comprising a flat opaque member with a series of rings spaced along its length.

The light-blocking or opaque member need not be flat but may, for example, be wider than the allowed space and inserted in a "bowed" or other configuration. In the illustrated embodiment, tube 102 may be replaced by a series of annular members or rings 103 spaced along an opaque member 105 (FIG. 9B). In this embodiment, the opaque member should be sufficiently rigid so that applying rotary movement to the opaque member at any point along its length will cause the entire light-blocking or opaque member to rotate about its longitudinal axis without causing the opaque member to twist substantially out of its initial configuration.

The light-blocking members may be opaque or they may be translucent or tinted to a level which produces the desired degree of light-blocking. Also, the light-blocking members may be segmented into light-blocking or opaque portions and transparent/translucent portions. For example, in a 40-foot panel unit with corresponding 40-foot light-controlling members, the first 10 feet of one or more of each of the light-blocking members may be opaque, the next 5 feet transparent/translucent, and the last 25 feet opaque. Such a segmented arrangement might be used where it is desired to maintain a lighted area at all times.

Light-controlling member 100*b* is generally of the same design as light-controlling member 100*a* including a tube 106, except that longitudinal sills 108 project radially from the outer surface of the tube. When the tubes are positioned so that the sills abut at least partially as the tubes rotate (FIG. 9A), the range of motion of the tubes is limited by the abutting sills to 180°. Also, the sills may be either opaque themselves (as shown) or coated with a light-blocking or opaque material. This provides enhanced light blocking when the sills approach and reach an abutting position since light between the tubes is blocked by the sills. Furthermore, the use of light-blocking or opaque sills in this fashion makes it possible to increase the spacing between the adjacent tubes without sacrificing light blocking between the tubes, so long as the sills are also widened to insure that they extend into the space between the adjacent tubes. Of course, tubes with light-blocking or opaque sills as described above may also be arranged so that the sills do not actually touch as the tubes rotate, which will permit some light to pass between the sills when the light-controlling members are in the closed position. Lastly, the tubes may be provided with only one light-blocking or opaque sill each or with more than two sills at varying locations about the circumference of the tubes.

Light-controlling member 100*c* comprises a tube 110 with opaque-coated outer sills 112 and a pair of opposing slots 114 and 116 formed at the inside diameter of the tube to receive an opaque member 118 which is assembled into the tube after it is formed. In all cases, the opaque member is rendered opaque by known techniques, such as painting, by coating with an opaque film, by applying an opaque plastic layer by co-extrusion, etc. Also, fire resistant materials such as metal slots may be used as the opaque member to improve the fire resistance of the panel system. Additionally, different colors and designs may be applied to the opaque members to increase the visual interest of the panel system as the opaque members move into the closed position. Indeed, the opposite sides of individual opaque members may be differently colored or bear different designs to produce different visual effects by rotating the light-controlling members 180° from one fully closed position to the other.

Figure 9C:
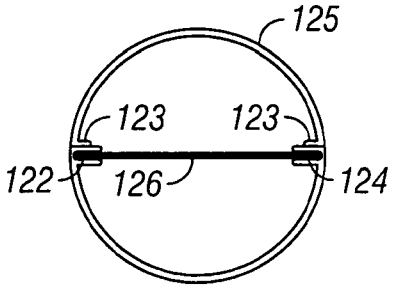
FIG. 9C is an alternate embodiment of a light-controlling member structure of FIG. 9 in which an opaque member is assembled into opposing slots of a hemispherical tube light-controlling member and then a second hemispherical tube is assembled to the first tube to form a complete tubular configuration.

Another light-controlling member design is designated 100*d*. This tube has a generally hemispherical cross-section and preferably its circumference extends to 180°. Although an opaque surface may be coextruded across the diameter of the tube (not shown), in the illustrated embodiment the tube 120 includes a pair of opposing slots 122 and 124 at the inside diameter of the tube to receive an opaque member 126 which is assembled into the tube after it is formed. When this structure is used, a series of annular members or rings may be disposed along the length of the light-controlling member to permit complete rotation of the light-controlling member. In another alternative embodiment, once the opaque member is assembled into opposing slots 122 and 124, another tube 125 with a generally hemispherical cross-section and lands 128 may be assembled to tube 120 (e.g., by creating an adhesive bond or a clip-on type connection at the lands) to produce a complete 360° tubular configuration as seen in FIG. 9C.

Light-controlling member 100*e* comprises an opaque member 132 with a supporting wall 130, together forming an elongated light-controlling member with a "T" shaped cross-section, as shown. The reinforcing rib 7 adds rigidity to the opaque member and also helps position the opaque member within a series of rings 128 which are spaced along the light-controlling member. In a less preferred embodiment of the invention, the reinforcing rib may be eliminated. Light-controlling member 100*f*, in turn, includes a series of annular members of rings 136 and an opaque member 138 with generally perpendicular supporting walls 140 and 142 which extend along the length of the tube and abut the rings at their apex 143. Other tube configurations are illustrated in U.S. Pat. No. 6,499,255, and are incorporated herein by reference.

Figure 10A:
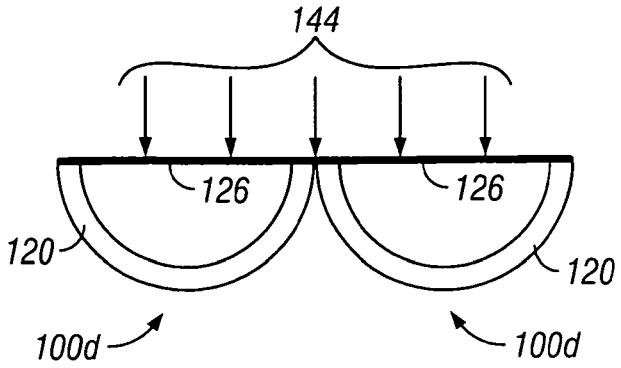
FIGS. 10A-10C are diagrammatic representations of two light-controlling members in three difference relative positions, showing the passage of varying amounts of light.
Figure 10B:
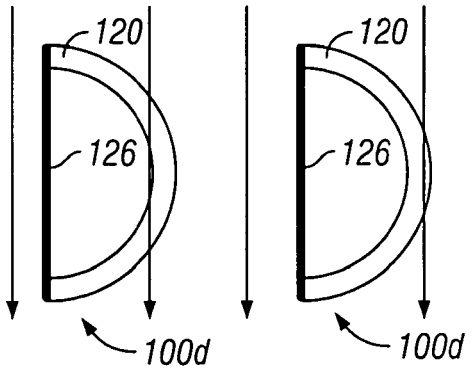
Figure 10C:
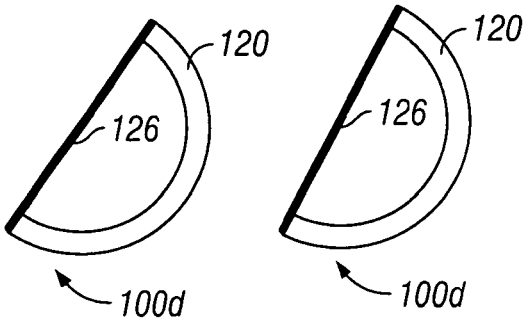
Figure 11A:
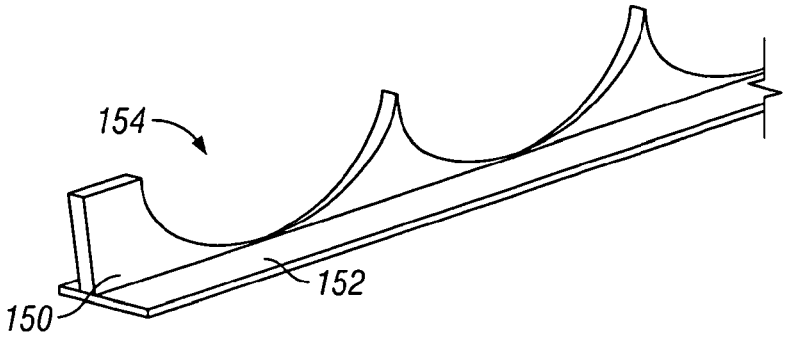
FIG. 11A is a partial enlarged perspective view of a scalloped carrier member for supporting adjacent light-controlling members and FIG. 11B is a similar partial perspective view showing a pair of juxtaposed scalloped carrier members.
Figure 11B:
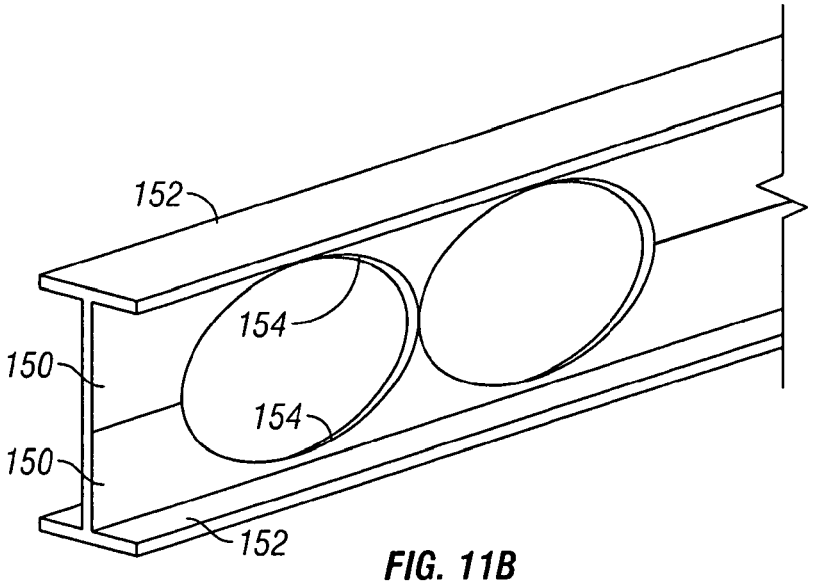

FIGS. 10A-10C are diagrammatic representations of two light-controlling members 100*d* in three different positions. In FIG. 10A, the two light-controlling members are in the "fully closed" position, with the opaque members 126 of the tubes 120 adjacent each other and fully blocking incoming light 144. This figure should be contrasted with the depiction of the prior art system of U.S. Pat. No. 6,499,255 in which in the fully closed position depicted, light rays 22 penetrate the panel through the walls 17 between the cells 16. In FIG. 10B, tubes 120 have been rotated 90° so that the maximum amount of light 144 may pass by the tubes. Finally, in an intermediate position of the tubes as shown in FIG. 10C, only a portion of the light will pass.

In each of the embodiments of this invention, the opaque members may be replaced with light-blocking members which are not opaque but rather are semi-opaque so that a limited amount of light will pass in the fully closed position, as may be required or desired in certain applications. Also, the opaque or semi-opaque members may include photovoltaic solar cells to generate electricity, preferably in conjunction with means for maximizing the photovoltaic output by rotating the light-controlling members with movement of the sun across the sky to insure that the photovoltaic solar cells continuously receive the maximum possible sunlight exposure. Finally, where the sole objective is to generate electricity, the opaque members may be replaced with transparent or translucent photovoltaic solar cells.

Figure 13:
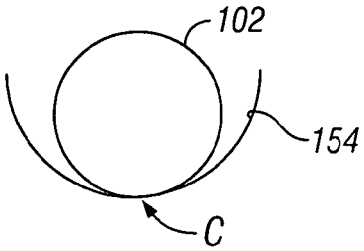
FIG. 13 is an exaggerated diagrammatic representation taken in elevation view of a single light-controlling member resting in a scallop in a carrier member.

We turn now to FIGS. 11A, 11B, 12A and 12B. These figures illustrate scalloped carriage members 150 each comprising a generally horizontal base 152, and a series of hemispherical cut-outs or "scallops" 154 in their top surface. Scallops 154 are intended to receive the light-controlling members and are therefore slightly greater in diameter than the light-controlling members. Thus, as illustrated in FIG. 13, the area of contact between the outer surface C of the tube 102 and the inner surface of a scallop 154 is minimized, thereby minimizing the friction between the two, as the light-controlling member is rotated.

In the fully assembled panel, support of the light-controlling members may be provided by a series of carriage members spaced along the panel for supporting and horizontally positioning the light-controlling members adjacent each other. The scalloped carriage members may be used singly or in pairs, clamped together using a clamping spring 150, as depicted in FIG. 12B. When the carriage members are used with light controlling members with sills, as in 100*c* of FIG. 9, the sills should be cut away to provide clearance for the carriage members. Furthermore, since the use of sills permits increased spacing between adjacent light-controlling members, the spacing between the scallops can be increased, permitting a concomitant increase in the surface area of the abutting surfaces 151 and 153 (FIG. 12A) of the carriage members and the option of placing connecting members (e.g., hook and loop (Velcro®) connectors, self-tapping screws, snap fasteners, etc.) at those abutting surfaces to help lock the carriage members together.

The carriage members preferably will be made of a low friction material such as a low friction engineered plastic like polycarbonate or a low friction metal like aluminum, and the scallops and/or the portions of the light-controlling members riding in the scallops may be coated with a slippery coating such as Teflon. Also, when a hemispherical light-controlling member is used (e.g., 100*d*), rings may be disposed on the light-controlling member at the point of contact with the scallops to extend the range of rotation. When hemispherical light-controlling members with sills are used, the sills may be cut away to permit annular members to be disposed on the light-controlling member at the point of contact with the scallops.

Figure 14B:
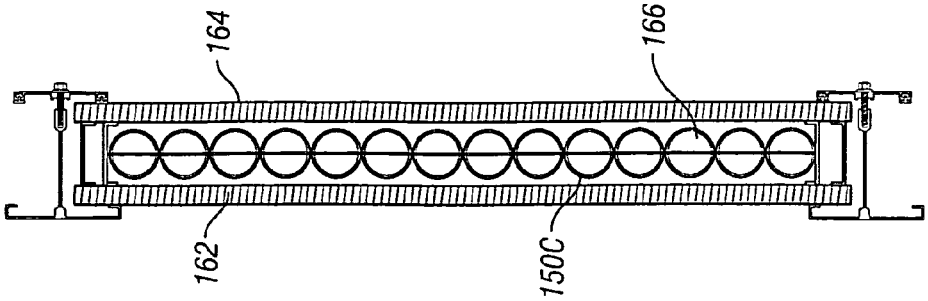
FIGS. 14A-14C are, respectively, a top plan view of a single panel unit, an end view thereof, and a cross-section thereof.
Figure 14A:
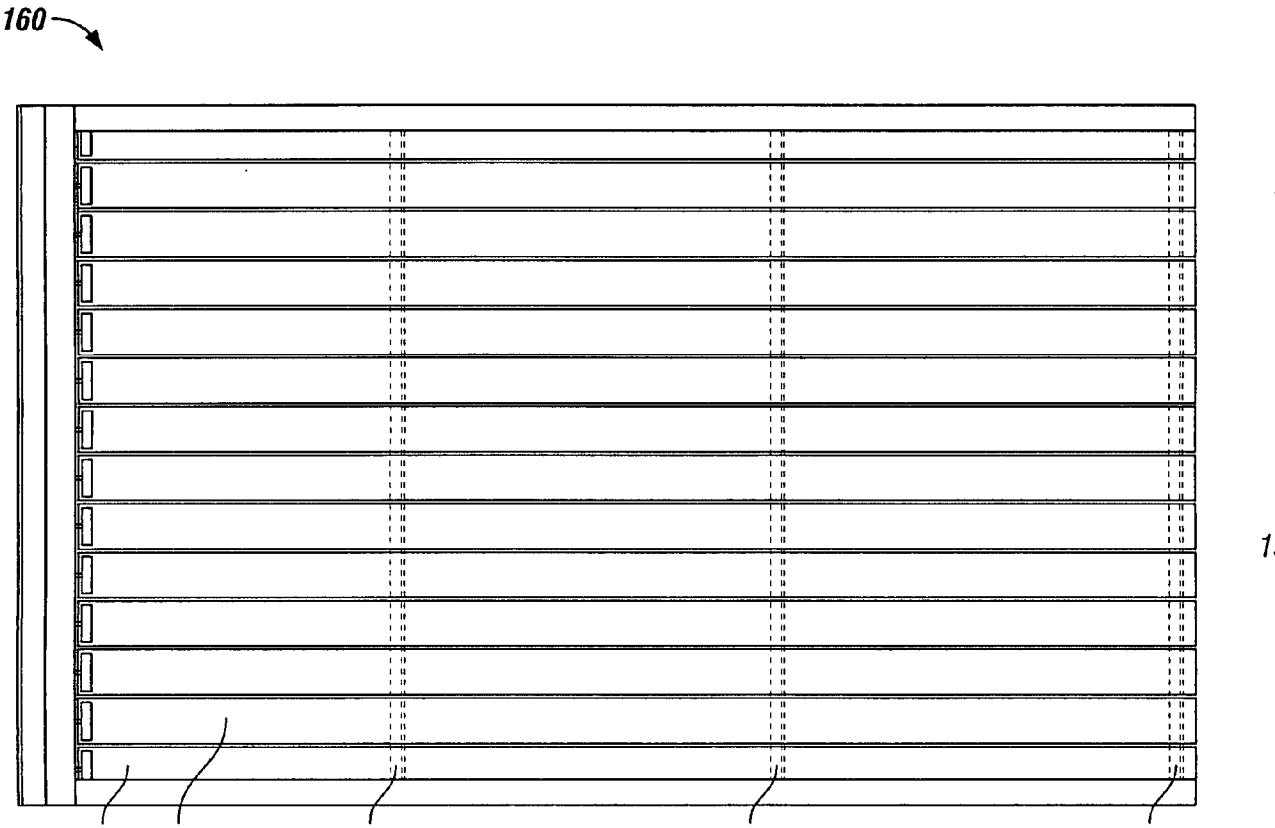
Figure 14C:
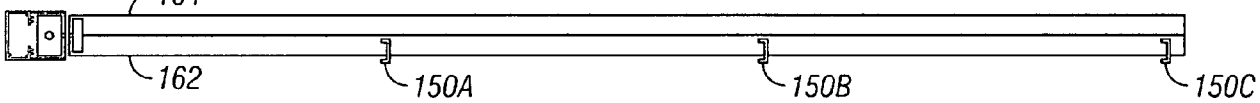

A fully assembled panel system 160 is shown in FIGS. 14A, 14B, and 14C (respectively, top plan, side elevation and cross-sectional views), with a series of scalloped carrier members 150A, 150B and 150C spaced within a panel unit comprising interior panel 162, exterior panel 164, and a series of light-controlling members 166 within the panel system resting on the scalloped carrier members which support the light-controlling members.

Figure 15:
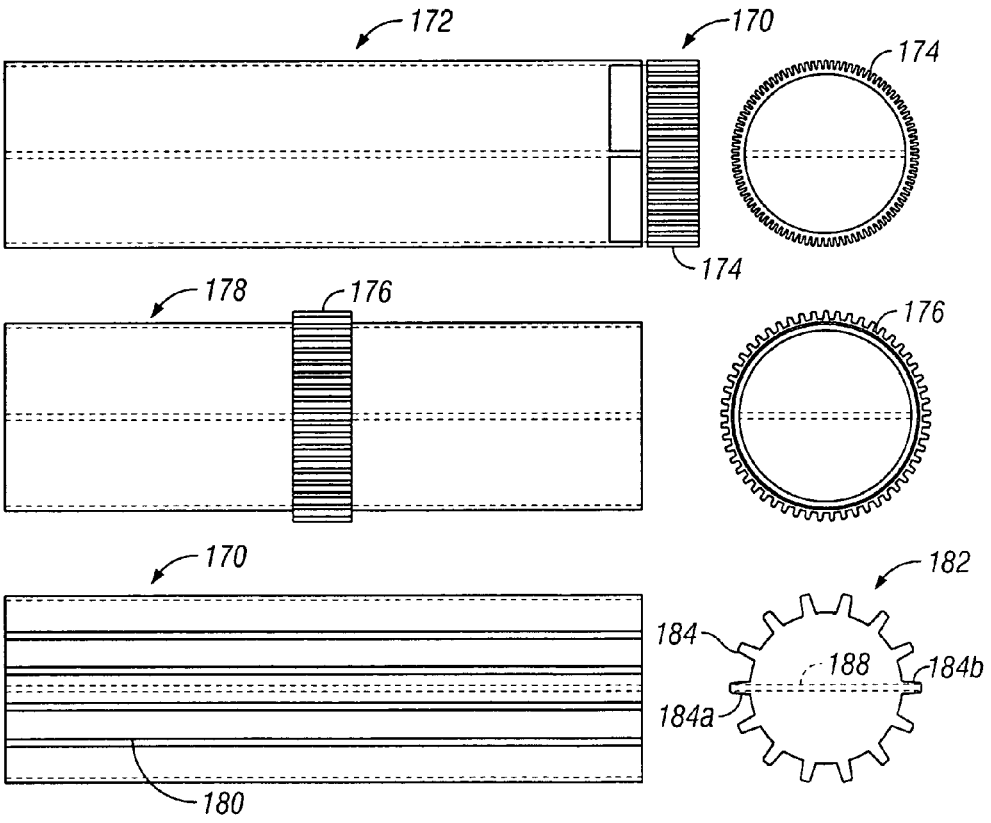
FIG. 15 is a representation of three alternative means for transmitting motion across adjacent light-controlling members.

Turning now to FIG. 15, three alternative means for transmitting motion across adjacent light-controlling members are illustrated. In the first motion-transmitting arrangement, an annular endcap 170 is attached to one end of a light-controlling member 172 and the endcap is provided with a band 174 of a high coefficient of friction material, such as rubber or polyurethane, so that circular motion imparted to one light-controlling member in the series of adjacent members will impart motion to the remaining members due to the frictional linkage achieved by the high coefficient of friction material positioned in alignment on adjacent members. One or more bands 174 may also be applied along the light-controlling members when they are tubular, either in lieu of the band on endcap 170 or in addition to it. Also, it is preferred that the bands be clear or translucent, particularly when they are disposed along the light-controlling members. Additionally, where the light-controlling members have sills, as discussed above, the sills will be cut away to provide clearance for the rings.

In the second motion-transmitting arrangement, one or more notched bands 176 are positioned along a light-controlling member 178 and aligned so that the intermeshed bands of adjacent light-controlling members transmit motion imparted to one member across the series of intermeshed members. Such intermeshing bands may also be used on an endcap as described above and further use of clear or translucent intermeshing bands is preferred. Also, as in the prior embodiment, where the light-controlling members have sills as discussed above, the sills will be cut away to provide clearance for the rings.

In the third motion-transmitting arrangement, the outer surface 182 of each of light-transmitting members 180 is provided (as by extruding) with a cogwheel cross-section, as shown, including a series of teeth 184 extending along their length so that the adjacent light-transmitting members intermesh to transmit motion imparted to one member (as by a drive motor (not shown)) across the series of intermeshed members. An opaque member 188 is preferably positioned within the cogwheel cross-section between a diametrically opposing pair of teeth 184*a* and 184*b* so that the opaque member extends into the teeth and is supported along its lateral edges within the opposing teeth. This embodiment has some significant advantages. First, the intermeshing teeth provide a wide tolerance as to fit between adjacent light-controlling members and tolerance to dirt or other extraneous matter which may find its way into the area. Second, since the opaque member extends into the teeth and is supported along its lateral edges within the opposing teeth in the closed position, the opaque members of adjacent light-controlling members will overlap, blocking the passage of light between adjacent light-controlling members.

Figure 16:
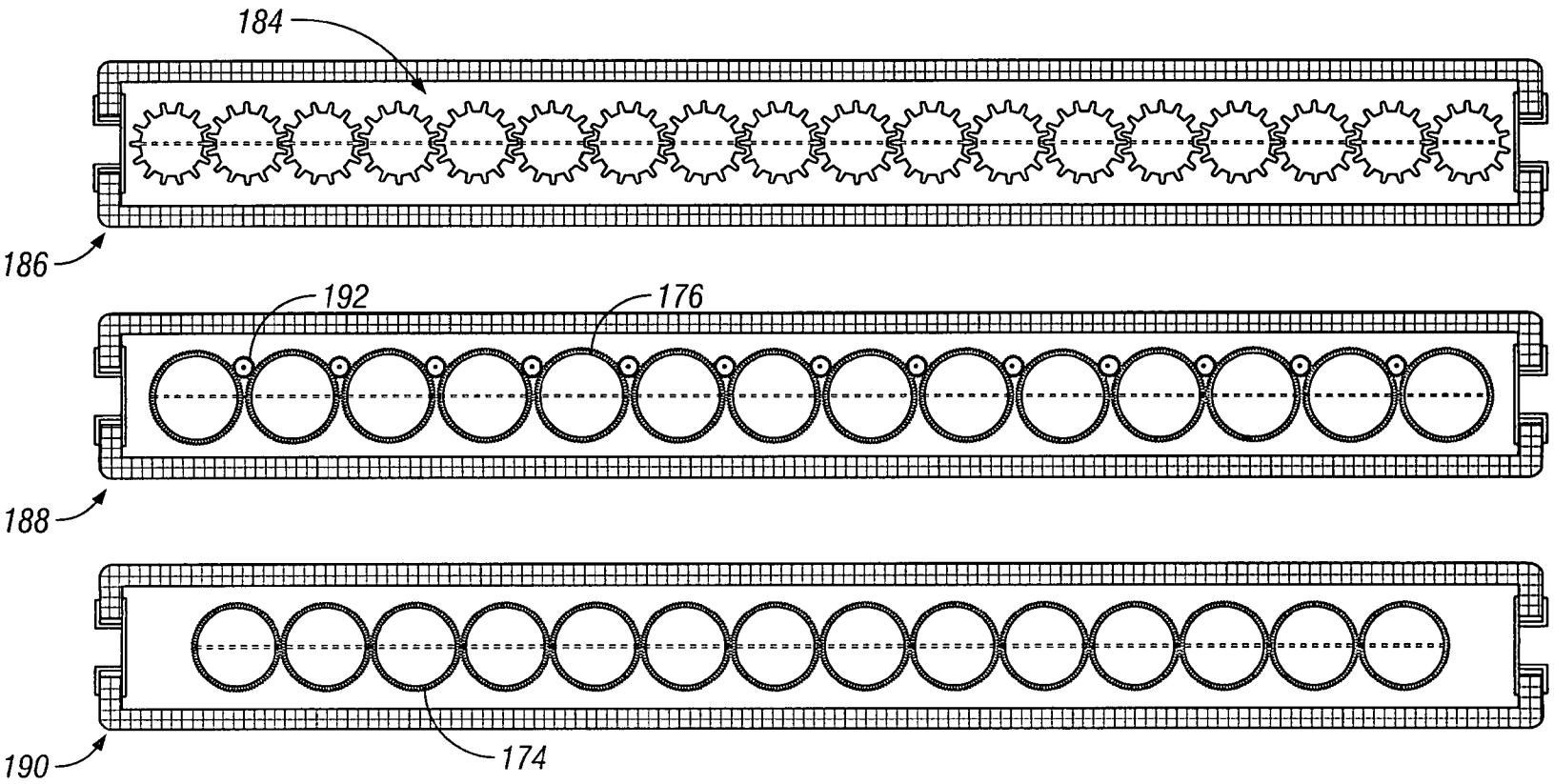
FIG. 16 is comprises end views of means for transmitting motion across adjacent light-controlling members.

End views of the light-transmitting members resting within a series of three panel systems, 186, 188 and 190 as described above are illustrated in FIG. 16. In panel system 188, however, a small gear 192 is located between the adjacent spaced light-controlling members to enable the light-controlling members to rotate in the same direction as the adjacent notched bands intermesh with the wheels.

Figure 12A:
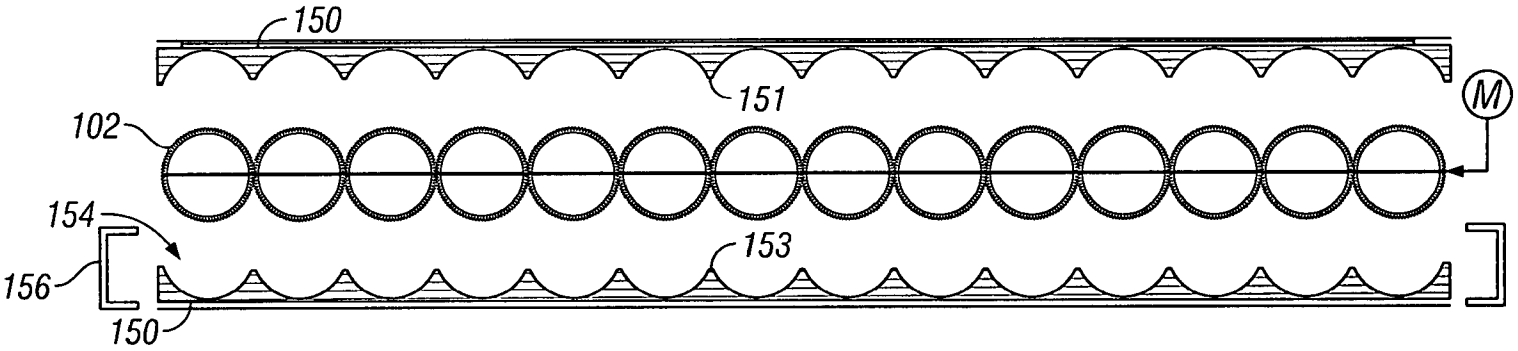
FIGS. 12A and 12B are front elevation views of, respectively, a series of adjacent light-controlling members of a single panel unit with top and bottom scalloped carrier members spaced therefrom and with the top and bottom scalloped members affixed together and holding the light-controlling members in place.
Figure 12B:
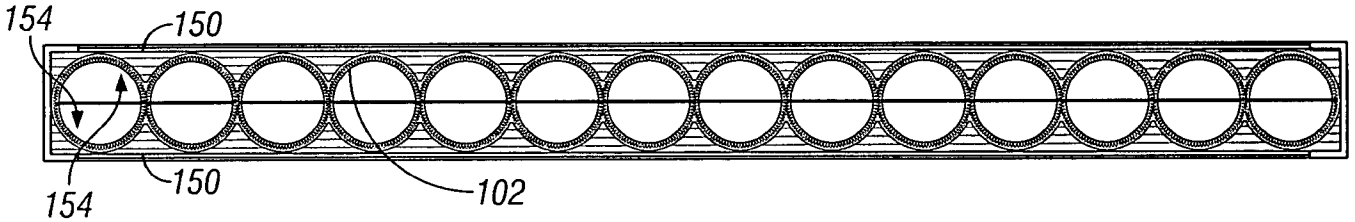

The above and other methods may be used for rotating adjacent light-controlling members where rotary motion is imparted to one or more (but not all) of the adjacent light-controlling members either manually or by motorized means, as represented diagrammatically by feature M in FIG. 12A. Any of the mechanisms described in U.S. Pat. No. 6,499,255, for example, may be used for imparting such rotary motion.

Figure 17A:
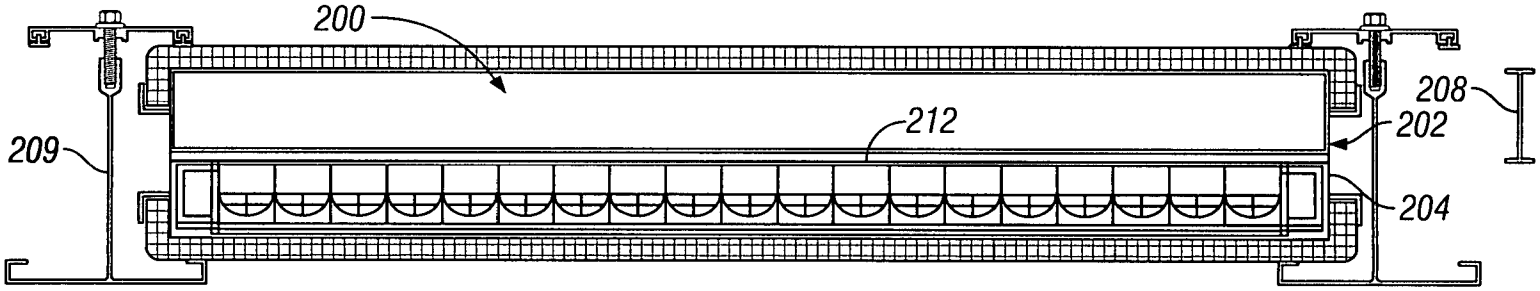
FIGS. 17A and 17B comprise alternative embodiments in which a metal screen and insulating materials are located within the panel system.
Figure 17B:
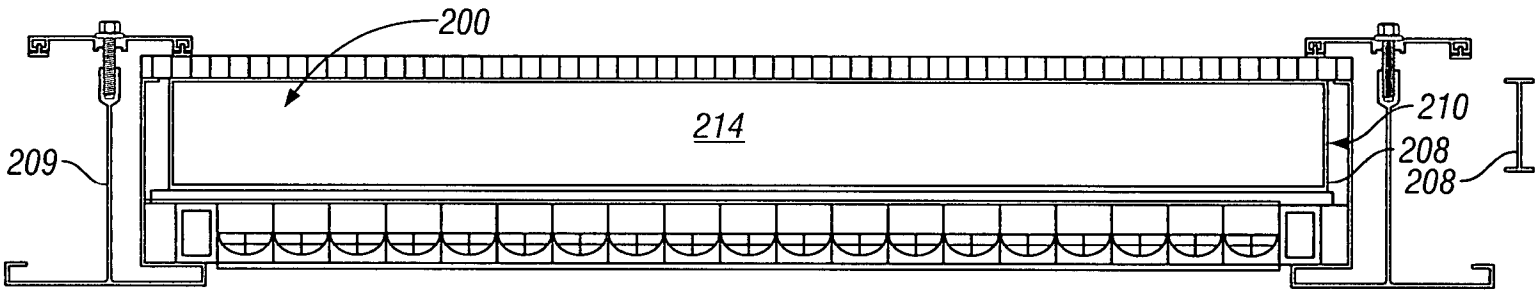

Turning now to FIGS. 17A and 17B, a further embodiment of the present invention is disclosed in which space 200 is provided above the plane of the adjacent light-controlling members in the panel unit. Thus, for example, in FIG. 17A, a panel joining system 202 much like that of panel joining system 36 in FIG. 2 is shown, except that this panel-joining system 202 has an elongated upstanding bracket 204 and is used in conjunction with elongated spacer rails 208, shown in side view at the right of the figure. A different enlarged panel-joining system 210 is used in the embodiment of FIG. 17B with different panels, and the panels are held together by a different attachment mechanism. In both cases, enlarged clamps 209 are used to joint adjacent panel units.

In both the embodiments of FIGS. 17A and 17B, a series of "I" beams 208 are positioned at intervals between the lateral edges of the interior and exterior panels to create an air space 210 between the panels. In FIG. 17A, a panel of a non-combustible generally light-transmitting material, such as a metal screen 212, is positioned above the light-controlling members and held tautly in position. In FIG. 17B, a series of "I" beams 208 are positioned at intervals between the lateral edges of the interior and exterior panels to create an air space 210 between the panels. In FIG. 17A, a layer of light transmitting fire-resistant insulating material, such as loose glass fibers 214, is disposed immediately above the screen in air space 210 to add thermal insulation and to enhance the fire resistance of the panel system. The screen and insulating material prevent or delay the passage of burning particles through the panel system, in accordance with the requirements of ASTM E-108 Class A Fire Rating Requirements. The resulting panel system thus provides the light transmission and control characteristics of the other embodiments of the invention as well as improved fire resistance.

Figure 18:
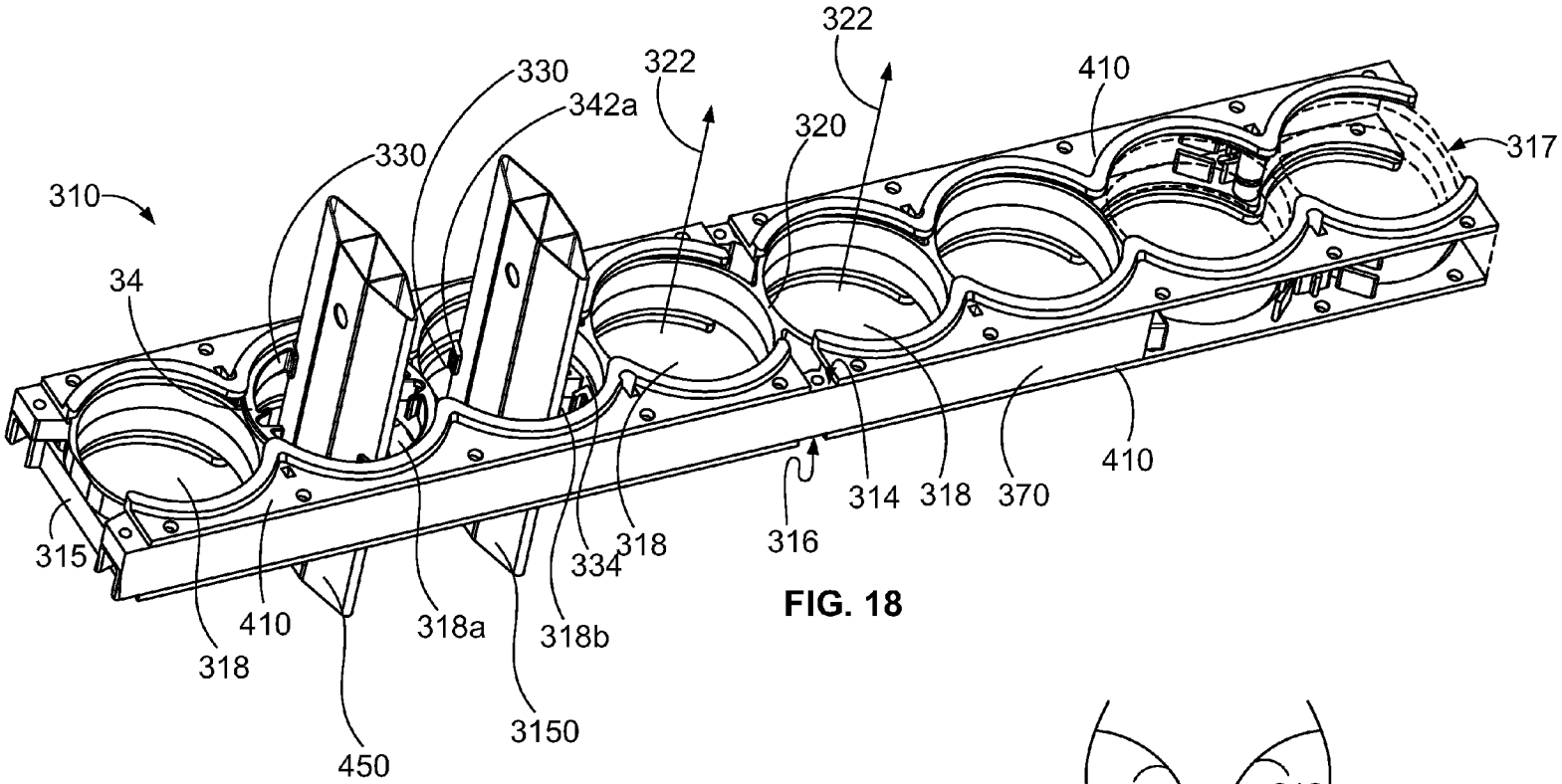
FIG. 18 is a perspective view of an embodiment of a light-control assembly in accordance with an embodiment including a single beam and two pairs of retainers.

Turning now to FIG. 18, a light-control assembly 310 is illustrated. Assembly 310 includes first and second opposed faces 314 and 316 first and second ends 315 and 317, and a series of adjacent circular bores 318 extending between the opposed faces of the assembly and exemplary bearing members 330 shown mounted in two adjacent bores 318*a* and 318*b*. Bores 318 are formed in the beam 370 (FIG. 21A) of the assembly which will be described below. The longitudinal axes 322 of the bores preferably will be generally parallel to each other although they need not be generally parallel in all embodiments.

Figure 18A:
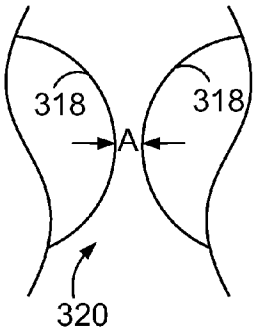
FIG. 18A is a partial view of a web portion between adjacent bores in the beam of the light-control assembly of FIG. 18.

Adjacent circular bores 318 are separated by a web portion 320 (FIGS. 18 and 18A) of beam 370 (FIG. 21A) defined by the lateral spacing of the bores. Web portion 320 will be shaped as indicated in FIG. 18A with its thinnest dimension "A" at the point where the diameters of the adjacent bores that define the web are co-linear.

In some embodiments it is preferred that web portion 320 be as thin as possible in order to optimize the light-blocking performance of the light-control assembly by minimizing the distance between the adjacent edges of the light-controlling members when they are in the closed position, as will be described in more detail below in connection with FIGS. 23C and 23F. Of course, web portion 320 must not be so thin as to adversely affect the structural integrity of the beam.

While it is preferred in some embodiments described herein that web portion 320 be as thin as possible in order to optimize the light-blocking performance by minimizing the distance between the adjacent edges of the light-controlling members when they are in the closed position, other embodiments described herein will accommodate thicker web portions.

The optimal web thickness A or A' at the point where the diameters of the adjacent bores that define the web are co-linear (FIGS. 18A and 18B) will depend on the material out of which beam 370 is made as well as the thickness of the beam between its opposed faces and other structural features of the beam and other structural components of the light-control assembly. In one embodiment, where the beam is made out of polycarbonate, the bores are about 45 mm in diameter and the thickness between the opposed faces of the beam is about 16 mm, the web can be as thin as about 1 mm. in thickness at dimension A. Such a thin web is desirable in some embodiments. In other embodiments however web thickness A' will be greater (preferably at least 2 mm for structural or other reasons.

Figure 19A:
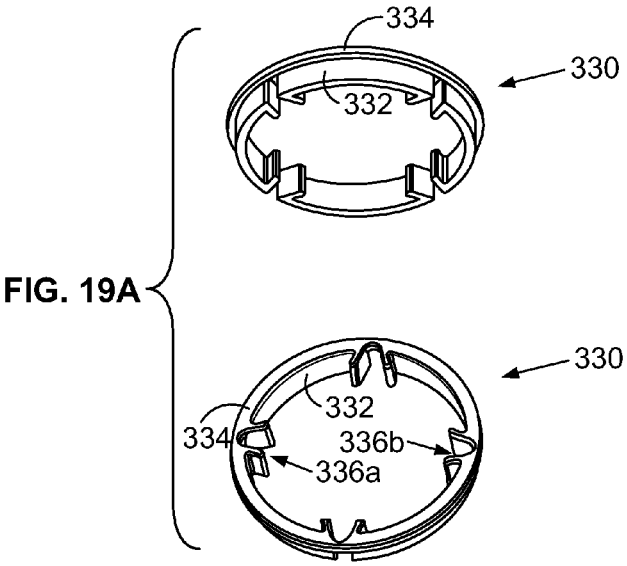
FIG. 19A includes top and bottom perspective views of an exemplary flanged bearing member that may be used in a light-control assembly embodiment.
Figure 19C:
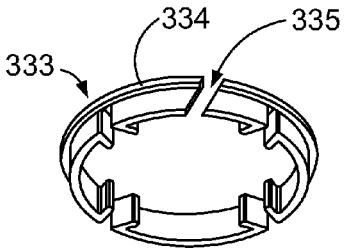
FIG. 19C is a view of a bearing member as in FIGS. 19A and 19B with the addition of a slot in the side of the bearing member.
Figure 19B:
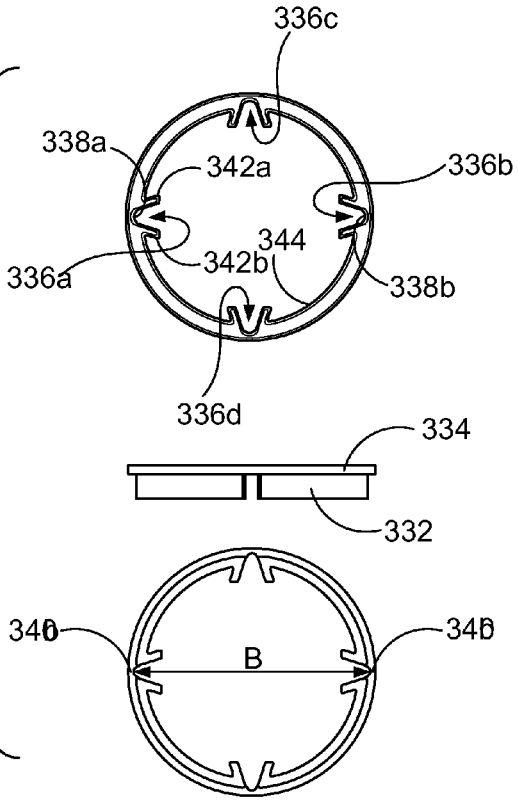
FIG. 19B includes top, elevation and bottom views of the bearing member of FIG. 19A.

Embodiments of light-control assembly 10 include bearing members 330 as shown in FIG. 18 and as illustrated in enlarged form in FIGS. 19 and 19B. In this embodiment, bearing members 330 each include an annular ring 332 dimensioned to fit rotatably within bores 318 and a retention flange 334 extending radially outwardly from the rings. The width of flange 334 may be less than or equal to the thickness A of web portion 320 between the bores to preclude interference between the flange and light-blocking members mounted in bearings in the adjacent bores.

In embodiments in which web thickness A' is large enough to accommodate adjacent bearing flanges (i.e., the flanges are not offset), the total width of the flanges of adjacent bearings may be less than or equal to the thickness A' of web portion 320 between the bores to preclude interference between the flanges of the adjacent bearings.

Bearing members 330 have at least two diametrically opposed notches 336*a* and 336*b*. Notches 336*a* and 336*b* have opposed notch bottoms 338*a* and 338*b* spaced a predetermined distance apart "B". In the embodiment of these figures, notches 336*a* and 336*b* extend through the rings and into the flanges leaving web portions of the flange 340*a* and 340*b* below the bottom of each of the notches. In this illustrated embodiment bearing members 330 also include an optional second pair of diametrically opposed notches 336*c* and 336*d* equally spaced from notches 336*a* and 336*b* to help maintain the circularity of the bearing members when they are made by a plastic injection molding process.

The bearing members in this embodiment also include pairs of guide and retention tabs 342*a* and 342*b* located on opposite edges of the notches. Tabs 342*a* and 342*b* project from the inner surface 344 of the ring to define a "V" shaped receiving cavity that opens towards the center of the bearing member.

Figure 28:
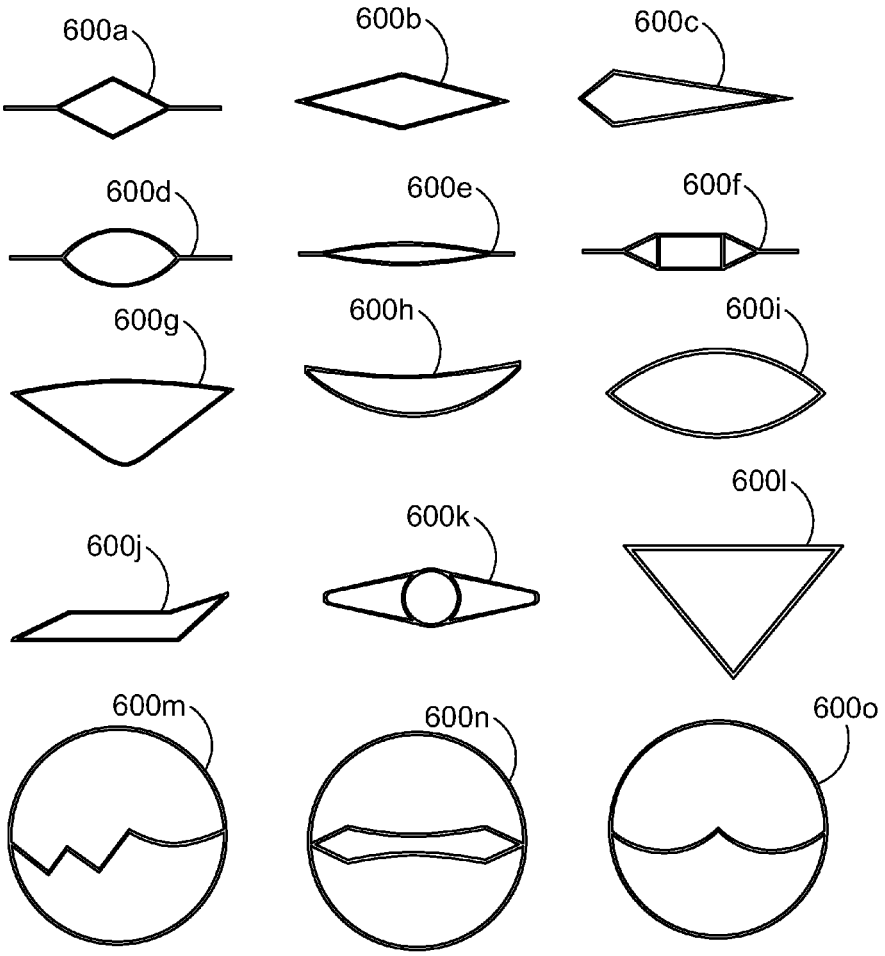
FIG. 28 depicts a series of alternative light-blocking member configurations.
Figure 29:
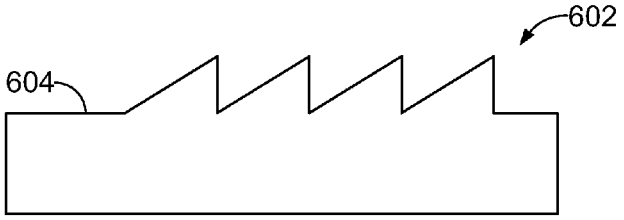
FIG. 29 depicts micro-prismatic toothing on the surface of a light-blocking member.

Notches 336*a* and 336*b* (optionally including retention tabs 342*a* and 342*a*) are designed to receive light-blocking members in the form, for example, of slats 450, which are described below in connection with the description of FIGS. 23A-23E and 18-32 and which themselves act as opaque reflecting, spectral controlling or translucent barriers. Notches 336*a* and 336*b*, of course, can receive other types of light-blocking members that act as opaque, translucent, reflecting or spectral controlling barriers including without limitation flat light-blocking members, light-blocking members 600*a*-600*k* of FIG. 28, tubular designs light-blocking members 6008-600*o* of FIG. 28 and the tubular hemispherical light-controlling members fitted with opaque or translucent barriers, as described below. The shapes shown in 600*m*-600*o* of FIG. 28 employ the principle of retro-reflection as disclosed in US 2006/028845A1, the pertinent disclosure of which is incorporated by reference. Finally, as illustrated in FIG. 29, micro-prismatic toothing 602 may be provided on the surface 604 of a light-blocking member to achieve retro-reflection either alone or on a geometric retro-reflective surface as in FIG. 28. Such micro-prismatic toothing will help avoid overheating and glare. Also, the micro-structured mirroring may be rolled onto an aluminum substrate, and then glossed, anodized and formed into a desired geometrical shape.

FIG. 2C illustrates an alternative bearing member structure 333 having a relief slot 335 that passes through the annular ring and retention flanges of the bearing member. This slot facilitates mounting of bearing members structured in this way since the bearing member can be pressed together to close the slot when the rings are inserted in the bores. After insertion, the bearing members will be released so that they can spring back to their original configuration ensuring rotatable mounting in the bores. Such slotted bearing members not only facilitate assembly into the bores but also are forgiving of tolerance variations and thermal expansion/contraction of other components in the light-control assembly.

Figure 19D:
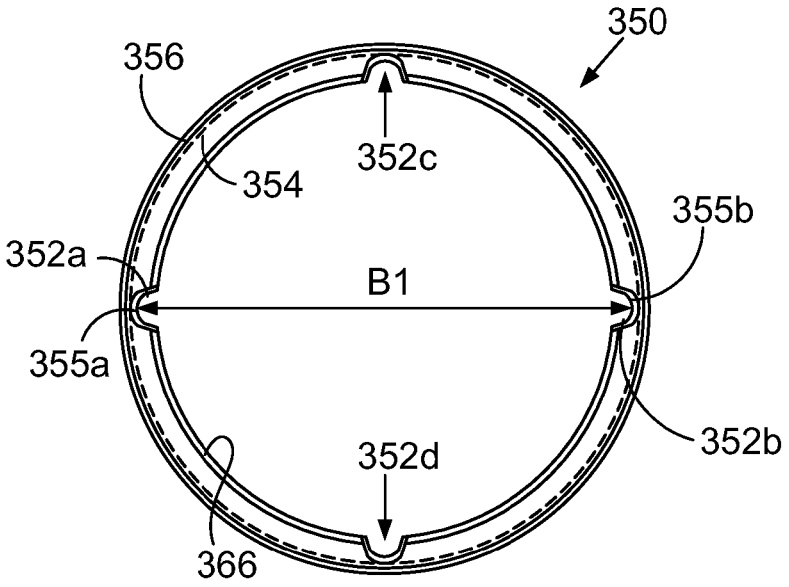
FIG. 19D is an elevation view of yet another alternative bearing member design.

FIG. 19D depicts yet another bearing member design 350 in which retention flange 334, as well as the optional guide and retention tabs are not used and notches 352*a*, 52*b*, 352*c* and 352*d* extend through the rings 354 but not into retention flanges 356 thereby establishing a smaller predetermined distance B1 between notch bottoms 352*a* and 352*b* which is smaller than distance "B". Additionally, the web portions of the flange below the bottom of each of the notches in this embodiment are thicker than web portions 340*a* and 340*b* since the notches do not extend into the flanges.

Figure 20A:
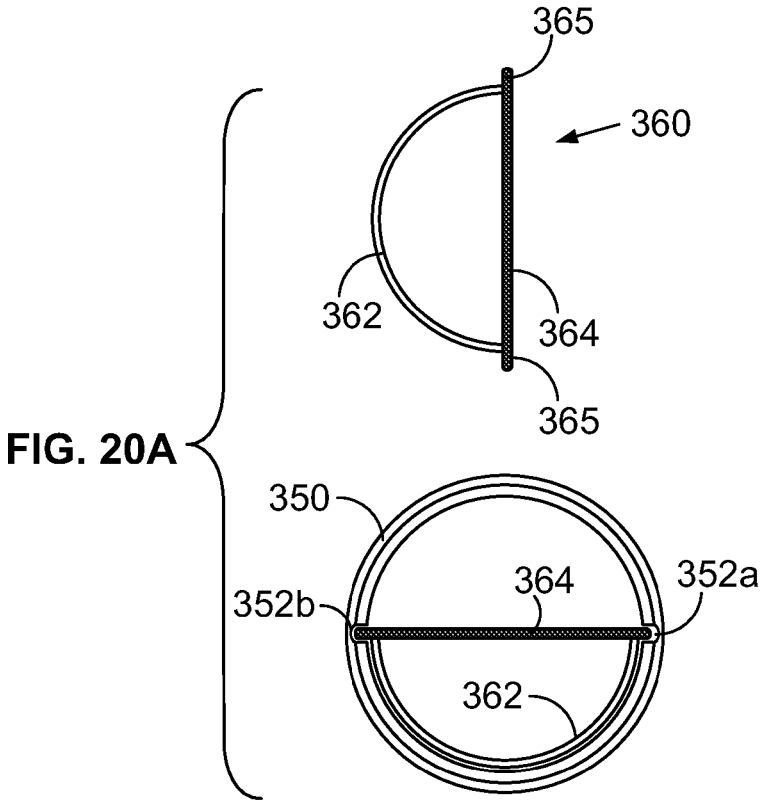
FIG. 20A includes an end elevation view of a hemispherical light-controlling member and an end elevation view of the hemispherical light-controlling member mounted in the bearing member of FIG. 19D.

FIG. 20A illustrates a hemispherical tubular light-controlling member 360 which may be used with, e.g., any of bearing members 330, 333 or 350. Light-controlling member 360 includes a clear tubular hemispherical portion 362 and a generally flat opaque or translucent barrier component 364. The opaque or translucent barrier component includes ledges 365 which extend beyond the outer surface of the tubular hemispherical portion. These ledges are dimensioned to rest in notches 352*a* and 352*b* of bearing member 350A as shown (or in the corresponding notches of bearing members 330 or 333) while the tubular hemispherical portion preferably fits within the inner wall 366 of ring 354 of the bearing member (or the corresponding inner walls of the rings of bearing members 330 or 333).

Figure 20B:
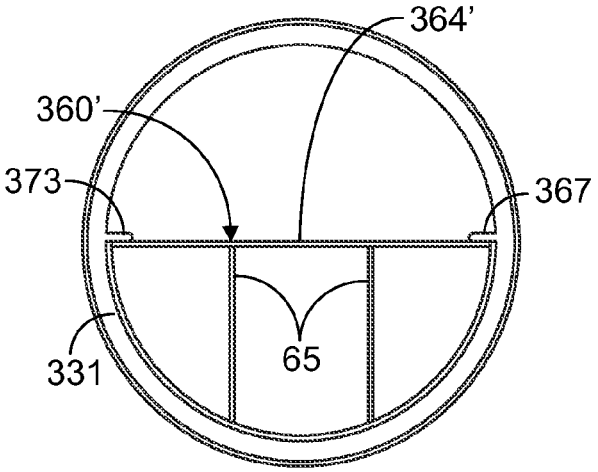
FIG. 20B includes an end elevation view of a tubular light-controlling member, a front elevation view of yet another bearing member design and an end elevation view of the tubular light-controlling member mounted in this bearing member.

FIG. 20B illustrates an alternative arrangement where a hemispherical tubular light-controlling member 360' is mounted in a bearing member 331. This hemispherical member includes a generally flat opaque or translucent barrier component 364' and optional supporting members 365. Bearing member 331 has inwardly diametrically directed locking tab members 373 which retain the hemispherical member in place in the bearings.

Figure 20C:
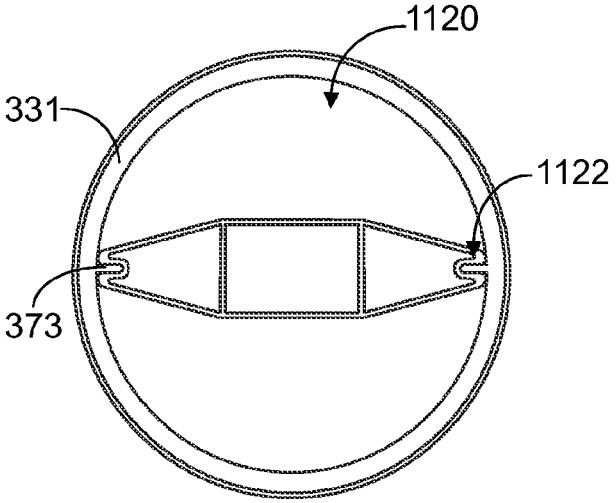
FIG. 20C is an end elevation view of a light-control slat with longitudinally disposed slots mounted onto tab members.

Bearing 331 may also be employed as illustrated in FIG. 20C with a light-controlling member in the form of a slat 1120 which has longitudinally disposed elongated slots 1122 at each of its lateral edges which may be mounted onto tab members 73 as shown in this figure.

FIG. 20D illustrates a 360° tubular light-controlling member 367 including a clear tubular component 368 and a generally flat opaque or translucent barrier component 369 which is mounted across the diameter of the tubular member. The alternative light-blocking members of FIG. 28 may also be used in lieu of component 369. Also, the micro-prismatic toothing of FIG. 29 may be employed. A bearing member that may be used with this configuration may comprise, e.g., the structure of bearing members 330, 333 or 350, but preferably will not have either notches or tabs. For example, bearing member 355 having ring 357 and flange 359 may be used. In this embodiment, the tubular light-controlling member preferably will fit snuggly against the inner wall 361 of the ring of bearing member 355 which itself will be rotatably mounted in bore 318.

When reference is made to a feature as being opaque or translucent it is intended to mean that the feature ranges from translucent (letting some light pass but diffusing it so that objects on one side cannot be clearly distinguished from objects on the other side) to opaque (letting no appreciable amount of light pass). When reference is made to "light", this term should be construed to include the spectral range of visible light (with or without the electromagnetic radiation with wavelengths below and above that of the visible light). When reference is made to a light-controlling member as being "spectral controlling" it is intended to mean that one or more selected portions of the spectrum are allowed to pass or are blocked, e.g., that a UV, IR or other wavelength range is allowed to pass or is blocked. When reference to a light-controlling member as being "reflecting" or "reflective" it is intended to mean that some or all of the incident light (including e.g., a selected wavelength range) is bent or sent back from a blocking surface of the light-controlling member.

Any light-blocking components used in the described embodiments, such as the opaque or translucent or spectral controlling barrier components 364, 369 or 600*a*-600*o*, may be tinted to a level that produces the desired degree of light-blocking. Also, the light-blocking components may be segmented into light-blocking or opaque portions and transparent/translucent portions. For example, in 40-foot light-controlling members, the first 10 feet of one or more of each of the light-blocking components may be opaque, the next 5 feet transparent/translucent, and the last 25 feet opaque. Such a segmented arrangement might be used where it is desired to maintain a light-admitting area at all times. Also, translucent portions may be tinted. Typical tinting colors include white, bronze, green, blue and gray; although other colors may be used. Finally, light-controlling members may have one face (e.g., face 465 of light control member 450 or one face of flat portions 364 or 369) and a different treatment on the other face (e.g., face 467 of light control member 450 or the opposite face of flat portions 364 or 369). For example, one face may have a reflective surface and the other may have a diffusing surface so that the light-controlling member may be rotated into a first position in which it reflects incoming light away from the covered space and a second position in which the non-reflective surface diffuses the incoming light that strikes it.

The barrier components may include photovoltaic solar cells along their surface to generate electricity, preferably in conjunction with means for maximizing the photovoltaic output by rotating the light-controlling members to track the movement of the sun across the sky, ensuring that the photovoltaic solar cells continuously receive the maximum possible sunlight exposure. This combination provides in a single assembly both effective dynamic control of daylighting and shading and efficient electricity generation.

Figure 20E:
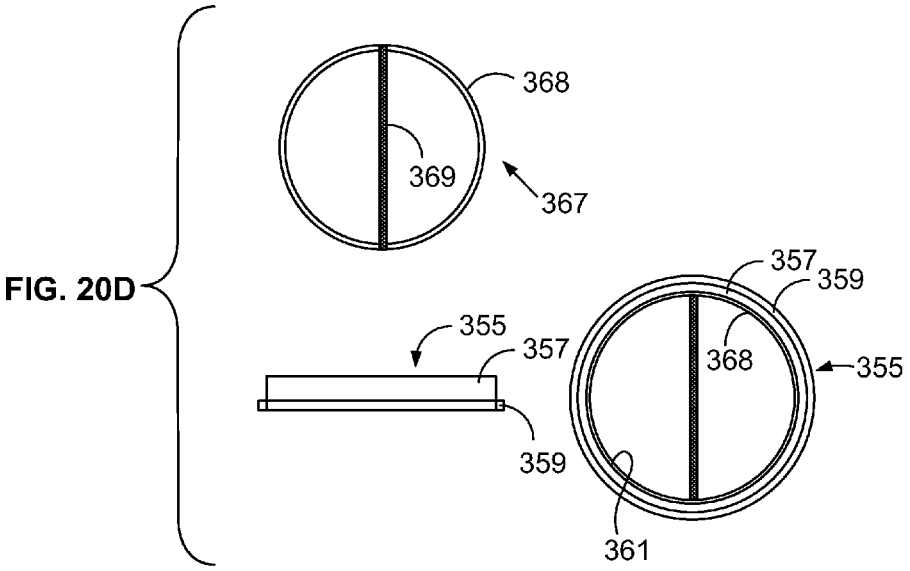
FIG. 20E is an end elevation view of another light-controlling member, mounted in the bearing depicted in FIGS. 19A and 19B.
Figure 20E:
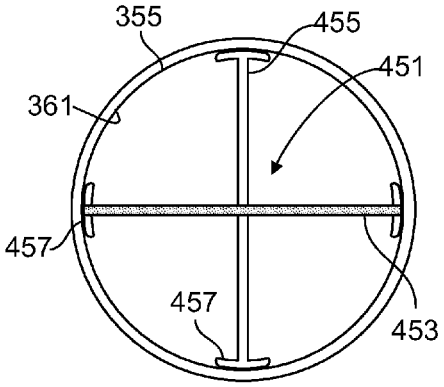

FIG. 20E illustrates yet another light-controlling member 451 comprising a pair of perpendicular cross pieces 453 and 455 which preferably are coextruded. Cross piece 453 is opaque in this embodiment, although it may, of course, have a different surface treatment, as discussed above. Additionally, feet 457 are formed at the opposite ends of the cross pieces are generally perpendicular to the cross pieces. Preferably, opaque cross piece 453 passes through clear feet to maximize light-blocking Feet 457, which will rest against the inner wall 374 of bearing member 355 to retain light-controlling member 151 in place, may be curved to follow the curvature of the inner surface of the bearing member and preferably will be clear as shown. As a result, opaque cross piece 453 is positioned and held in place across the diameter of the bearing member and presents minimal light-blocking when light-controlling member 451 is in the fully open position.

Figure 20F:
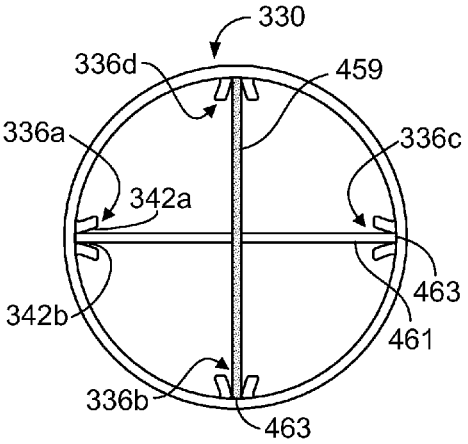
FIG. 20F is an end elevation view of another light-controlling member, mounted in another fashion in the bearing depicted in FIGS. 19A and 19B.

FIG. 20F illustrates yet another light-controlling member design. This design includes cross pieces 459 and 461 which generally correspond to cross pieces 453 and 455 of FIG. 20C. In this embodiment, however, there are no feet. Rather, the ends 463 of the cross pieces fit in opposed notch bottoms 336A-336D and in guide and retention tabs 342A and 342B of bearing member 330. It should be noted that in the embodiments of FIGS. 20C and 20D both bearing members 330 and 355 include retention flanges, but these have been removed for purposes of illustration. Other bearing designs (e.g. bearing members 330, 333, 350 or 355) may be used with this light-controlling member design.

Figure 21A:
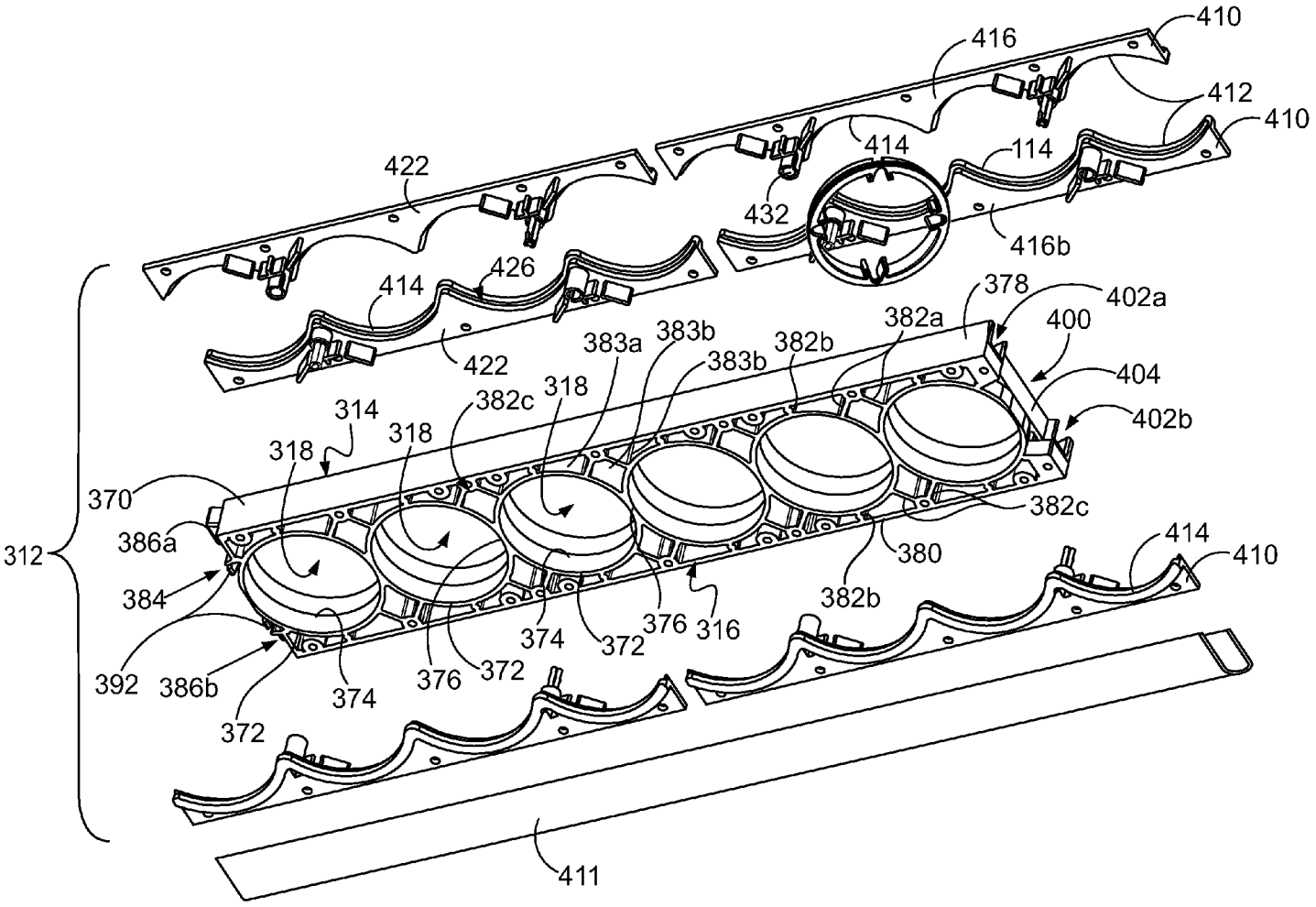
FIG. 21A is an exploded view of the light-control assembly of FIG. 18 including an optional reinforcing U-channel.

Turning now to FIG. 21A, an exploded view of light-control assembly 312 is shown, including a beam 370 at the center of the assembly having bores 318 in which the bearing members rotate. Since beam 370 in this embodiment is made by plastic injection molding for purposes of minimizing friction, weight and material usage, the beam is molded with rings 372 defining bores 318 along their inner surface 374. Adjacent rings 372 intersect on their periphery and are joined along lateral conjunction segments 376. Preferably, the beam will be made of a clear or translucent material like polycarbonate to help camouflage the light-control assembly. However, the beam may also be made by known techniques using aluminum, steel or other appropriate materials.

At least one and preferably three or more rollers or roller assemblies may be mounted on the beam about the periphery of the bores to contact the outer circular surface of the bearing members. This will help reduce friction and wear particularly in heavy usage applications, where the light-controlling members are heavy, or where it is necessary or desirable to minimize the number of light-control assemblies. Furthermore, where such rollers or roller assemblies are used they may be spaced from the front and back faces of the beam and/or undercut to create a gap for retaining the bearing members in lieu of or in addition to retainers 410 or 610 which are discussed below.

The injection molded beam illustrated in FIG. 21A also includes top and bottom strips 378 and 380, front and rear faces 314 and 316, and a series of repeating top and bottom support ribs 382*a*-382*c* defining cavities 383*a*-383*c*, as illustrated. The combination of the laterally conjoined rings, top and bottom strips, support ribs and cavities together make the beam lightweight yet give it sufficient rigidity to resist bending forces to ensure reliable operation of the light-control assembly.

The beam of FIG. 21A preferably is designed for modular applications where a series of beams having, for example, six bores that are approximately 45 mm in diameter can be easily and reliably interconnected to produce a longer composite light-controlling assembly of a desired width comprising a multiple of the width of a single light-control assembly. For example, such a modular assembly nominally 600 mm in width could be constructed and used in applications where the light-controlling members are any desired length from, e.g., up 15 meter or more.

Thus, the first end 384 of the illustrated beam 370 includes top and bottom trapezoidal projections 386*a* and 386*b* that fit into trapezoidal cavities 402*a* and 402*b*. Trapezoidal projection 386*a* and corresponding trapezoidal cavity 102*a* are shown in the partial enlarged views of FIGS. 21B and 21C. In FIG. 21C it is seen that trapezoidal projection 386*a* includes a base surface 388 protruding beyond a generally flat face 390 of beam end 384. Trapezoidal cavity 402*a* is dimensioned to receive trapezoidal projection 386*a*, so that face 388 of the trapezoidal projection is adjacent to flat bottom surface 104 of the trapezoidal cavity. Also, beam end 400 includes a flat face 404 dimensioned to abut flat face 390 of beam end 384 where the trapezoidal projection slides into the trapezoidal cavity as shown in FIG. 21C.

Additionally, flexible locking clips 392 (FIG. 21A) project from the flat surface 390 of first end 384. These clips are designed to flex inwardly as adjacent beams are moved into alignment and then to lock in place when the adjacent beams are fully laterally aligned.

Figure 21B:
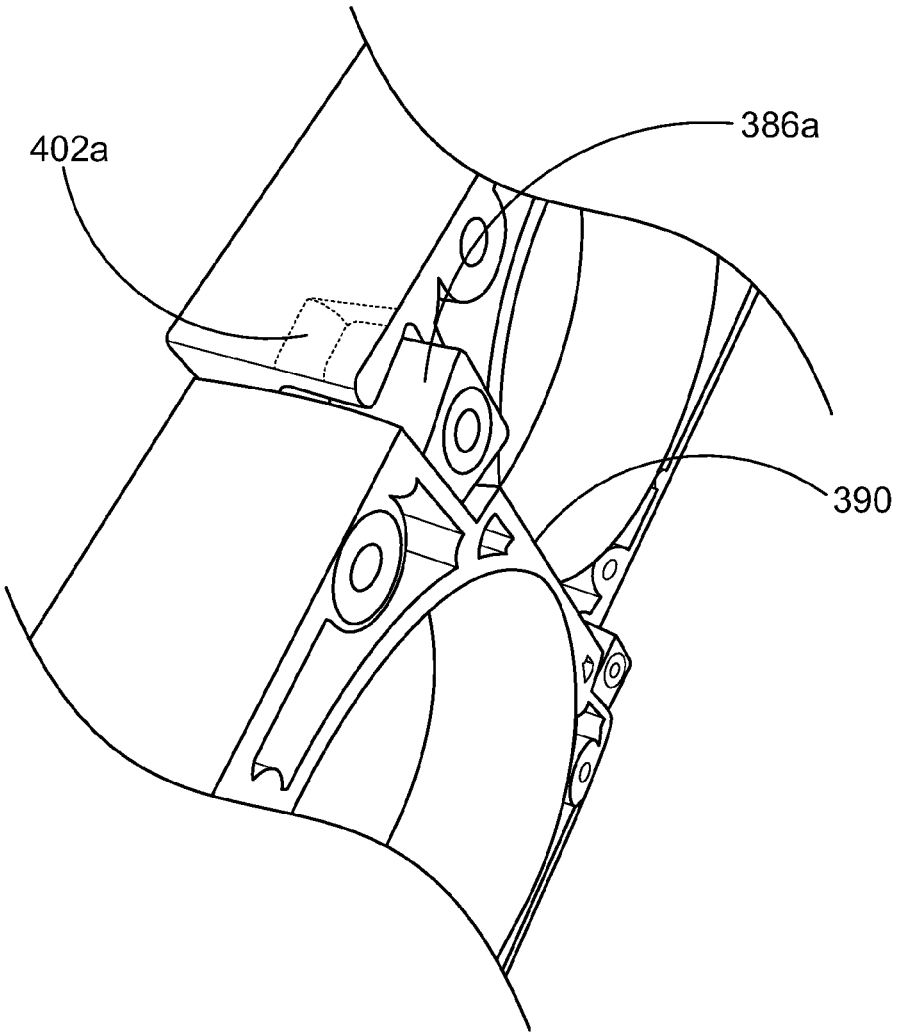
FIG. 21B is an enlarged partial perspective view showing corresponding ends of two light-control assembly beams as the beams are interlocked.
Figure 21C:
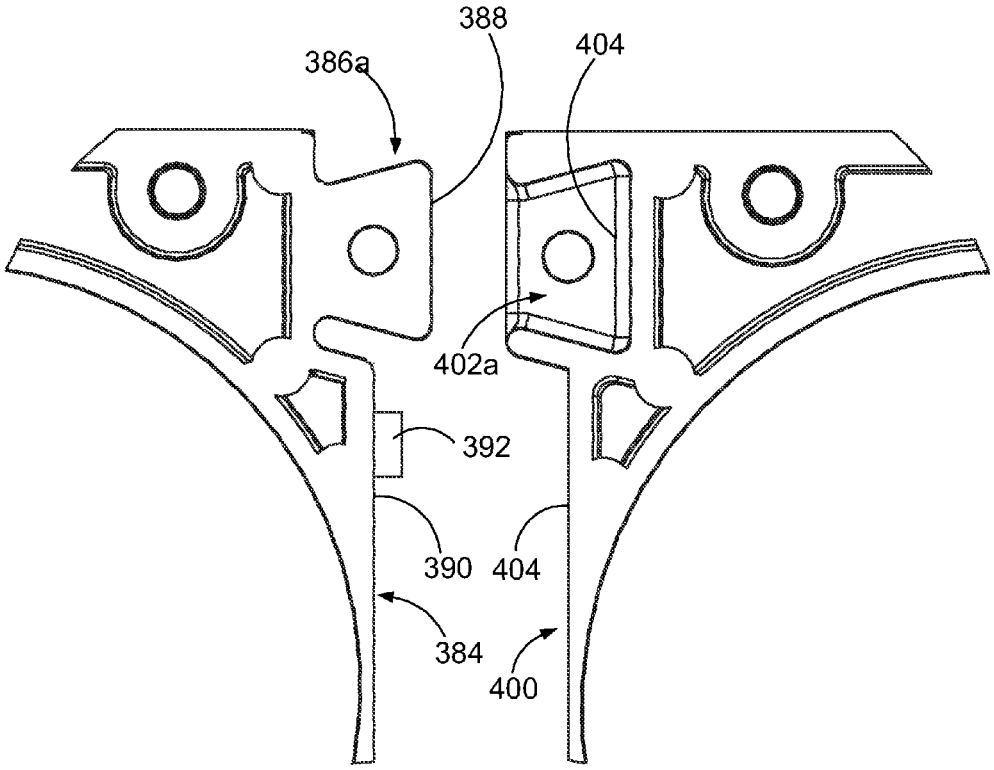
FIG. 21C is a partial elevation view of corresponding interlocking ends of two beams of the light-control assembly of FIGS. 18 and 21A.

The trapezoidal projections are aligned and moved into their corresponding trapezoidal cavities as illustrated in FIG. 21B. When corresponding front and back faces 314 and 316 of the beams are aligned, clips 392 will snap into place locking the adjacent beams together. Thus, any number of beams may be locked together in this way to modularly produce an overall light-control assembly of the desired width.

Once the desired number of beams is assembled along with the other components of the light-controlling assembly an optional reinforcement member may be applied across the top and/or the bottom edges of the assembly. For example, a metal U-channel 411 (FIG. 21A) may be used for this purpose. Such a reinforcement member may also be used to attach the light-control assembly to existing structure under or over glazing or opened unglazed areas using appropriate profiling members. Finally, appropriate holes may be located in the reinforcement member in alignment with bores 421 in the beam and corresponding holes 423 in retainers 410 (see below) and appropriate fasteners (not shown) may be used to insure reliable attachment.

Light-control assembly 310, in the illustrated embodiment, also includes at least a single retainer 410 and preferably pairs of front and back retainers 410 which are designed to be oriented as shown and attached to either one or both of the front and back faces 314 and 316 of the beams to retain the bearing members. The bearing members are thus coupled to the beam by trapping the retention flanges of the bearing members between the faces of the beam and the back surfaces 416 of the retainers. (The top front retainer was removed from FIG. 21A to facilitate viewing of the overall assembly.) Retainers 410, in the illustrated embodiment, have a scalloped edge with a series of semi-circular openings 412 each having an inner surface 414 of a diameter corresponding to that of bores 318. As in the case of the beams, the retainers preferably will be made of a transparent or translucent material like polycarbonate to help camouflage the light-control assembly, but can be made of any desired material.

Figure 22A:
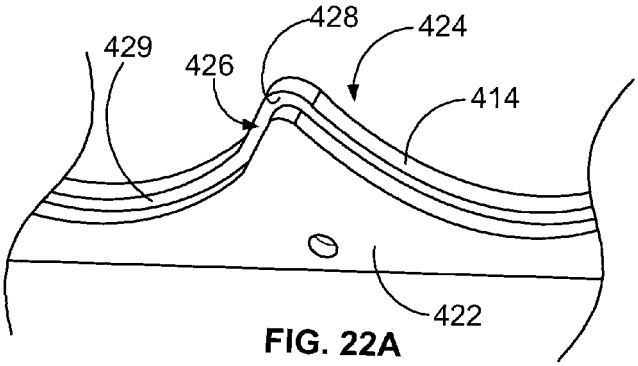
FIG. 22A is a partial perspective view of portions of two adjacent scallops of a retainer of the light-control assembly of FIGS. 18 and 21A.

As best seen in FIG. 22A, the back sides 422 of the retainers include a ridge 424 with inner surface 414 corresponding to the inner surface 319 (FIG. 18) of bores 318 and an undercut 426 behind the ridge creating a back face 428 and an annular cavity 431 dimensioned to receive and trap flange 434 of the bearing members without impeding rotation of the bearing members. Thus, the flanges of the bearing members are captured in the curved undercuts 426 of retainers 410. Alternatively, such undercuts may be formed in the face of the beam about the circumference of bores 318 to serve the same function as retainer undercuts 426 which may instead have a flat inner surface 414 in such an arrangement. In yet another alternative, both the surface of the beam and the inner surface of the retainer may be undercut so that these undercuts can cooperate in capturing the flanges of the bearing members in place in the light control assembly.

Figure 22B:
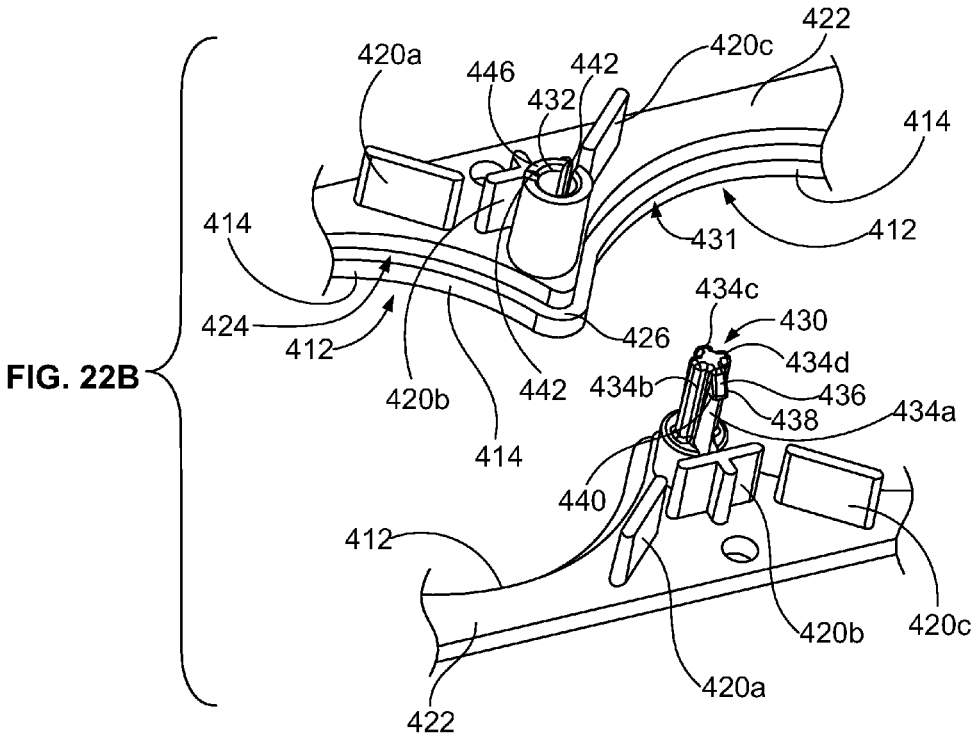
FIG. 22B includes partial perspective views of the back side of two portions of the retainers of FIGS. 18 and 21A showing corresponding locking pins and locking cavities.
Figure 22C:
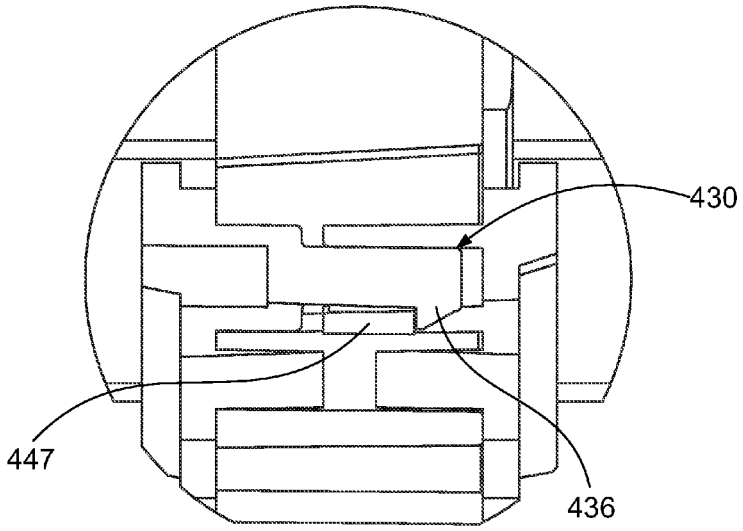
FIG. 22C is a partial elevation view of the mechanism by which the locking pins and locking cavities of FIG. 22B mate.

Additionally, as best seen in FIG. 22B tabs 420*a*, 420*b* and 420*c* project generally perpendicularly from the retainer back surfaces 416 and are positioned and dimensioned to fit in cavities 383*a*, 383*b* and 383*c* of the beam to ensure proper positioning of the retainers on the beams.

Finally, retainers 410 include alternating locking pins 430 and locking cavities 432 which are disposed on the backside of the retainers so that when retainers are positioned on opposite sides of the beam, the locking pins and locking cavities are aligned and paired up so that they can interconnect. These locking pins and locking cavities are illustrated in an enlarged form in FIG. 22B. A pair of fully interlocked pins and cavities is illustrated in the cross-sectional view of FIG. 22C.

Locking pins 430 include ribs 434*a*-434*d* which project in diametrically opposite directions and have outer edges that are dimensioned to rest securely within locking cavity 432. Additionally, bottom rib 434*d* includes a nose portion 436 having a ramp surface 438 and a locking face 440. Locking cavities 132 also include a tubular portion with longitudinal slits 442 defining a top flexible tubular portion 446.

Thus, when retainers 410 are properly positioned on faces 314 or 316 of the beam with ribs 120A-120C aligned with cavities 383*a*-383*c* and locking pins 430 aligned within locking cavities 432, the retainers are pressed together until they rest against the opposite faces of the beam. Nose portion 436 is positioned and dimensioned so that as it moves into cavity 432 the top flexible tubular portion 446 flexes upwardly as the nose portion flexes downwardly until the nose portion hooks onto a latch bar 447 whereupon the locking pins lock in the cavities affixing the retainers onto the front and back of the beam. Additionally, when multiple beams are joined together, the retainers will be offset as shown in FIG. 21A to cover the seams between adjacent interlocked beams and enhance the security of the attachment.

However, before the assembly of the retainers onto the beams is completed, a first bearing member 330 is mounted in a first bore such as bore 318*a* of FIG. 18 with its flange 334 adjacent the first beam face 314 and its ring extending into the bore. The next bearing member is mounted in the next adjacent bore such as bore 318*b* of FIG. 18 with its flange adjacent the second beam face 316 and its ring extending into the bore. The bearing members are mounted in each successive bore in this alternating fashion, so that looking at one of the faces of the beam, the flanges are at the front of every other bore. Looking at the opposite face of the beam, the flanges will be in the remaining alternate bores. This insures that the flanges in adjacent bores will not interfere with each other. In one alternative embodiment the retainers may be secured to the beams with screws or other fasteners that pass through holes 423 in the retainers and into bores 421 in the beam which are aligned with the holes.

In other embodiments in which laterally compliant light-blocking members as described below are used, web thickness A' may be large enough to accommodate adjacent bearing flanges (i.e., the flanges are not offset) so long as the total width of the flanges of adjacent bearings are less than or equal to the thickness A' of web portion 320 between the bores to preclude interference between the flanges of the adjacent bearings. Thus, a first bearing member 330 may be mounted in a bore such as bore 318*a* of FIG. 18 with its flange 334 adjacent one of the beam faces, i.e., adjacent first beam face 314 with its ring extending into the bore. The next bearing member may then be mounted in the next adjacent bore such as bore 318*b* of FIG. 18 with its flange also adjacent the same face, i.e., first beam face 314 with its ring extending into the bore (although it may be mounted with its flange adjacent the second beam face if a second retainer is used). The remaining bearing members will be mounted in the remaining bores in this fashion.

Figure 30:
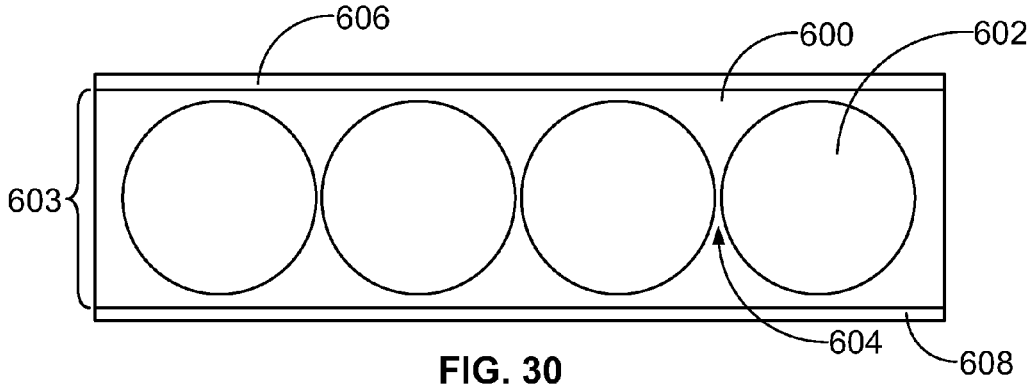
FIG. 30 is a front elevation view of an alternative beam embodiment and FIG. 30A is side elevation view thereof.
Figure 30B:
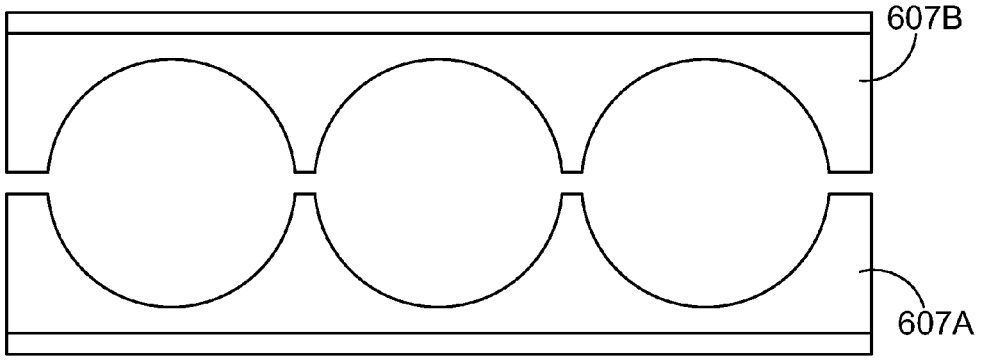
FIG. 30B illustrates a flat beam embodiment in the form of opposed scalloped carriage members.
Figure 30A:
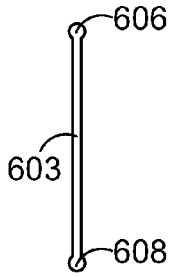

FIGS. 30-33 illustrate alternative light control assembly embodiments. These include generally flat alternate beam embodiments 600 of FIGS. 30 and 30A having a series of circular bores 602 which pass through the central section of the beam 603 and define web portions 604 between the bores. Top and bottom ribs 606 and 608 are located at the top and bottom of the central section of the beam. The flat beam embodiment may be in the form of opposed scalloped carriage members 607A and 607B which may be clamped together or otherwise held in place, as illustrated in FIG. 30B. The beam of course may also be a unitary member.

Figure 31:
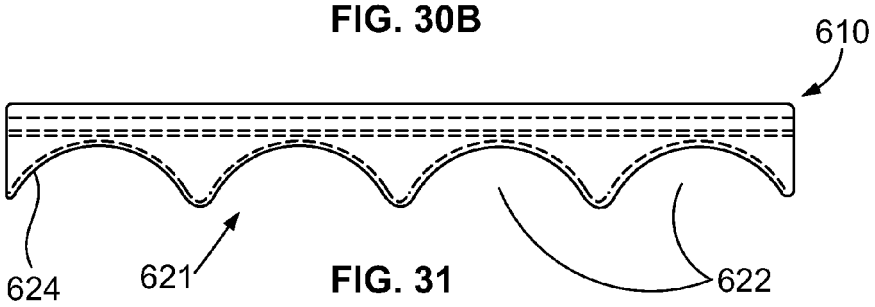
FIG. 31 is a front elevation view of an alternative retainer embodiment intended to be used with the beam of FIGS. 30 and 30A and FIG. 31A is a side elevation view thereof.
Figure 31A:
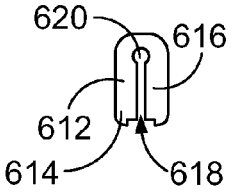

FIGS. 31 and 31A depict an alternative U-shaped retainer design 610. Retainer 610 as best viewed from its end 612 includes a front leg 614 and a back leg 616 defining an opening 618 between the two legs. A channel 620 is formed at the top of opening 618 to receive top rib 606 of beam 600. Retainer 610 also includes scalloped edge 621 with circular openings 622 corresponding in diameter to the diameter of bores 602. As in the case of retainer 410, retainer 610 is undercut at 624 to receive bearing member 626 as will be explained below.

Figure 32:
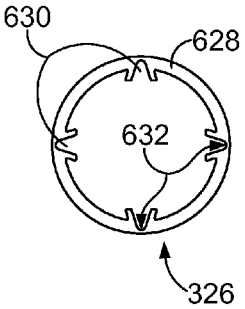
FIG. 32 is a front elevation view of an alternative bearing member design intended to be used with the beam of FIGS. 30 and 30A and FIG. 32A is a side elevation view thereof.
Figure 32A:
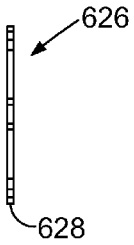

Bearing member 626 comprises a flat annular ring 628 with pairs of diametrically opposed notches 630 having opposed notch bottoms 632 generally corresponding to notches 336*a*-336*d* and notch bottoms 338*a*-338*d* of bearing members 330. Bearing member 626 also includes a circular outer edge 634 as depicted in FIG. 32A.

Figure 33A:
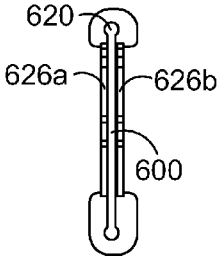
FIG. 33A is a cut-away view of the assembly of FIG. 33 taken along lines 33A-33A in FIG. 32.
Figure 33:
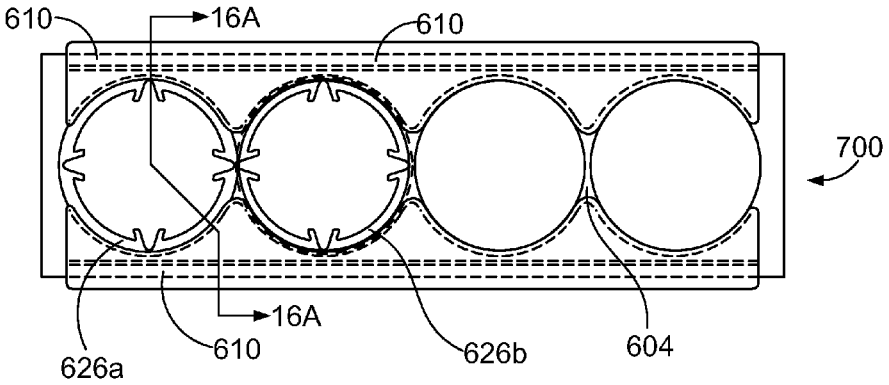
FIG. 33 is a front elevation view of an alternative light control assembly containing the beam, retainer and bearing members of FIGS. 30-32

A fully assembled alternate light control assembly 700 is shown in FIGS. 33 and 33A. This assembly is constructed by aligning bearing members 626*a* and 626*b* with adjacent bores 602 with each adjacent bearing member offset with respect to its adjacent bearing member(s), i.e., on opposite sides of the beam. The rings preferably overlap the web portions between adjacent bores. With the bearing members positioned in this way retainers 610 are pressed down upon the top and bottom ribs of beam 600 to generally spread the legs of the retainer until the ribs come to rest in channels 620 whereupon the legs of the retainer snap back in place, locking retainers to the top and bottom ribs of the beam and thereby capturing the offset-positioned bearing members in assembly 700. As can be seen in FIG. 33, the outer edges of the bearing members are captured within undercuts 324 (FIG. 31) in retainers 610. In a yet further alternative embodiment, such undercuts may be provided along the outer edge of bores 602 in lieu of or in addition to undercuts 624 of the retainers to perform the same retention function.

Figure 34:
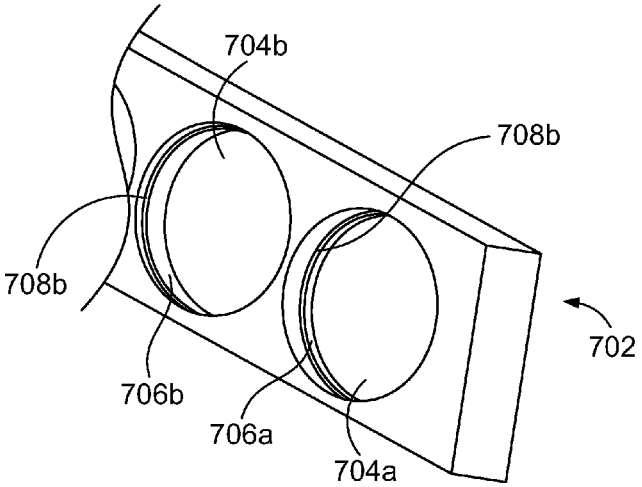
FIG. 34 is a partial perspective view of an alternative beam design designed to capture bearing members within off-set bore grooves.

Turning now to FIG. 34, an alternate beam design 702 is shown with bores 704*a* and 704*b*. These bores have respective inner surfaces 706*a* and 706*b* with circular grooves 708*a* and 708*b* that are shown offset with respect to each other but need not be offset. This beam will thus accept and retain, e.g., bearing members 330, 333, 350, 355, and 626. In the case of all but bearing member 333, the bearing members will be forced into the bore grooves. Slot 335 in bearing member 333 is therefore preferred in the sense that relief slot 35 makes it easier to squeeze this bearing member together before insertion released so that when it is released flanges 334 will rest in the appropriate grooves to complete the assembly. Similar relief slots or other relief means may be provided in any bearing member intended to be mounted in bores 704*a* and 704*b*. Additionally, it is noted that when using a beam design like that of beam 702, the bearing member flanges may be shifted from the outer ring edges to intermediate locations along the outer surfaces of the annular rings of the bearing members to engage grooves 706*a* and 706*b*.

Figure 42A:
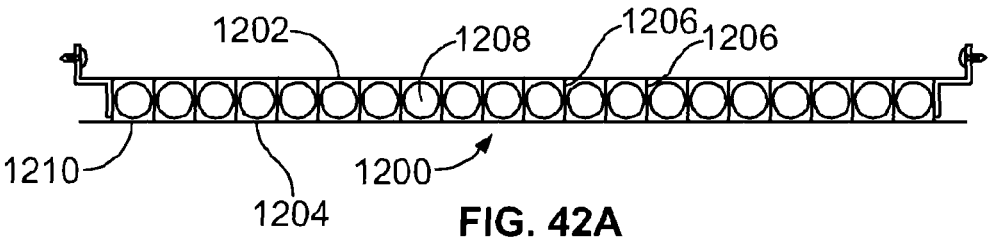
FIGS. 42A-42C are views of flexible support members having apertures containing rings for receiving light-control members.
Figure 42B:
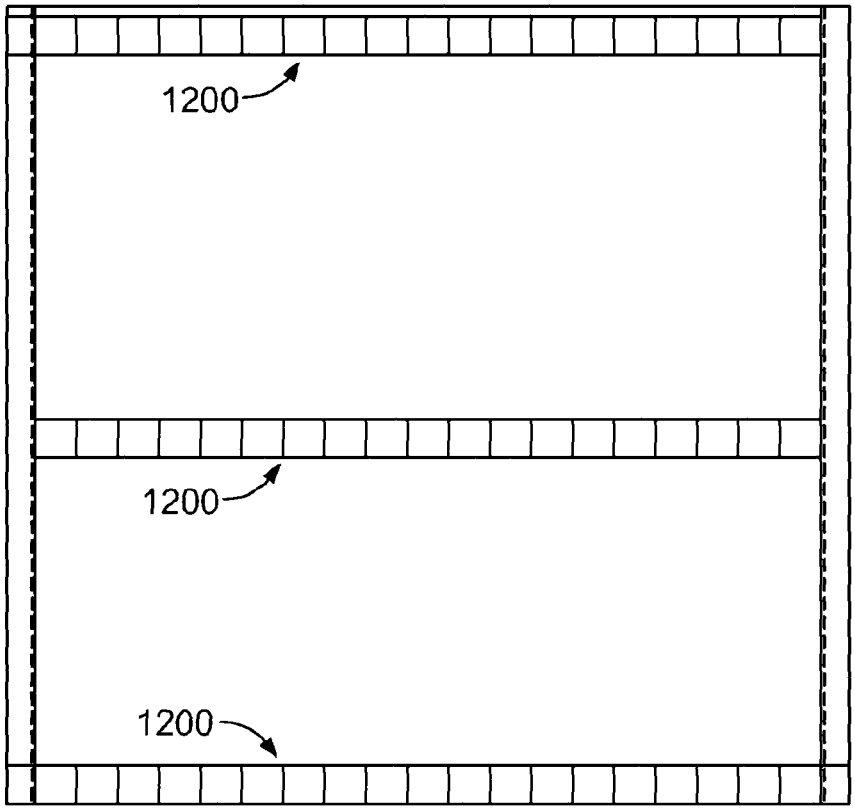
Figure 42C:
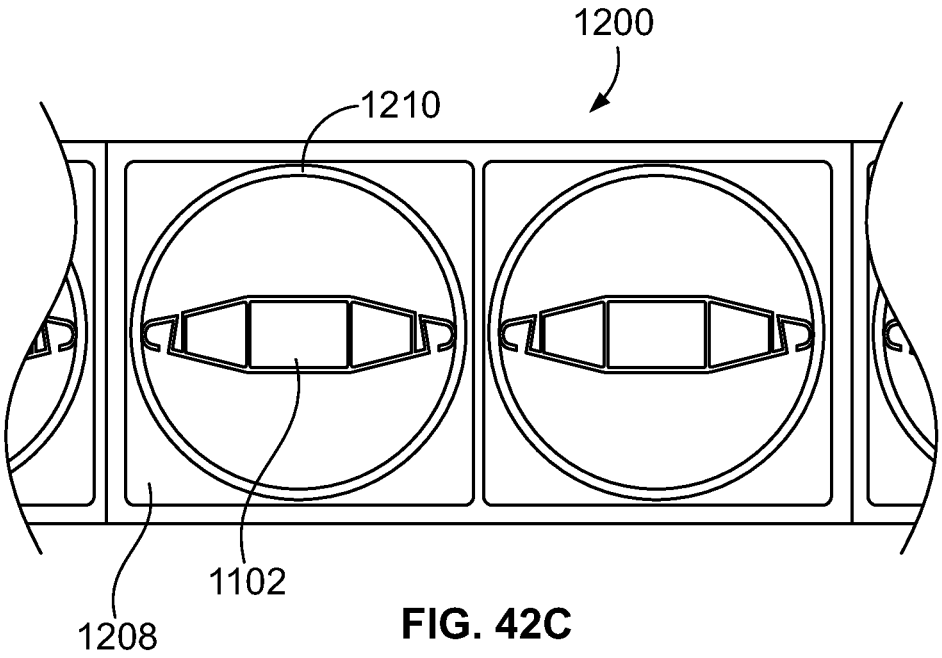

In another embodiment, as illustrated in FIGS. 42A-42C, the beam and paired carriage members may be replaced by at least one flexible support member 1200 (three are shown) comprising general parallel top and bottom members 1202 and 1204 joined by upstanding dividers 1206 which form a series of apertures 1208. A series of rings 1210 are positioned in the apertures. Finally, as shown in FIG. 42C, light-controlling members such as slats 1102 can be mounted within the rings as depicted in this figure. Also, while apertures are preferably rectangular as shown, they may be any shape that permits rings 1210 to be reliably fixed in place.

Figure 23A:
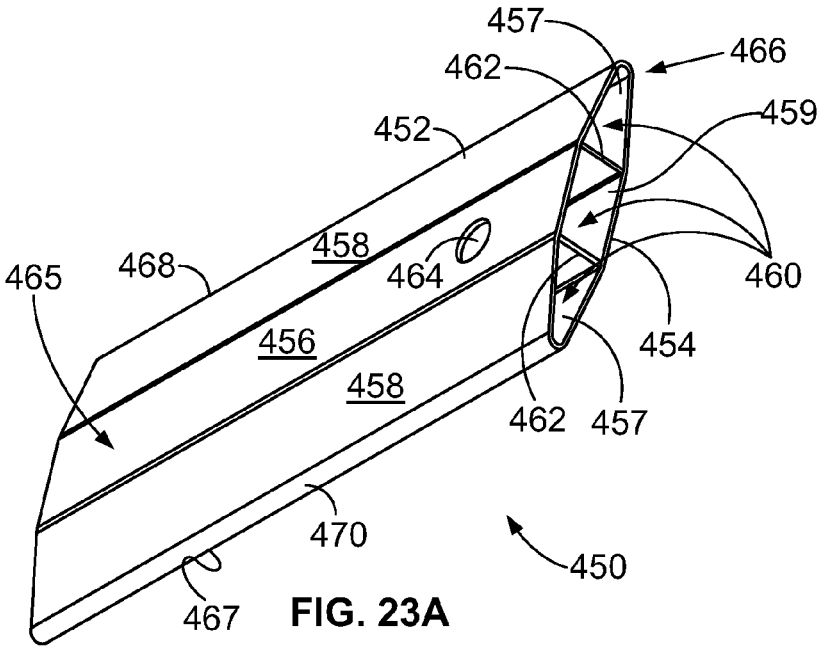
FIG. 23A is a perspective view of a light-controlling member which may be used.
Figure 23B:
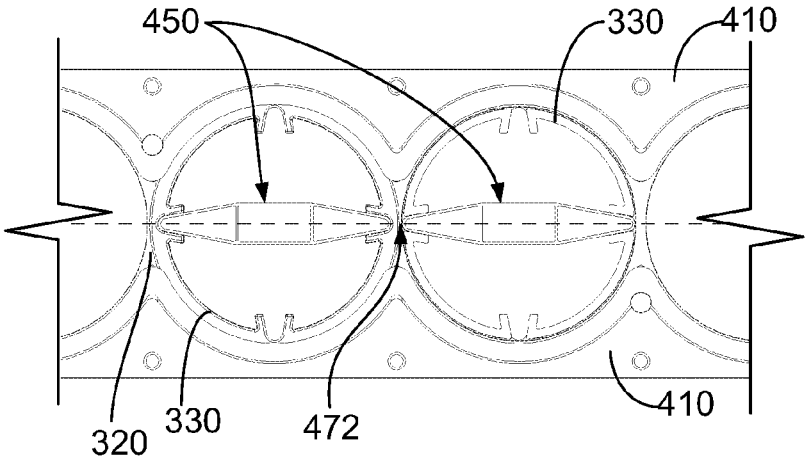
FIG. 23B is a partial front elevation view of a portion of the light-control assembly of FIG. 18 in which light-controlling members depicted in FIG. 23A are mounted in place in the assembly and rotated to a fully closed position.
Figure 25:
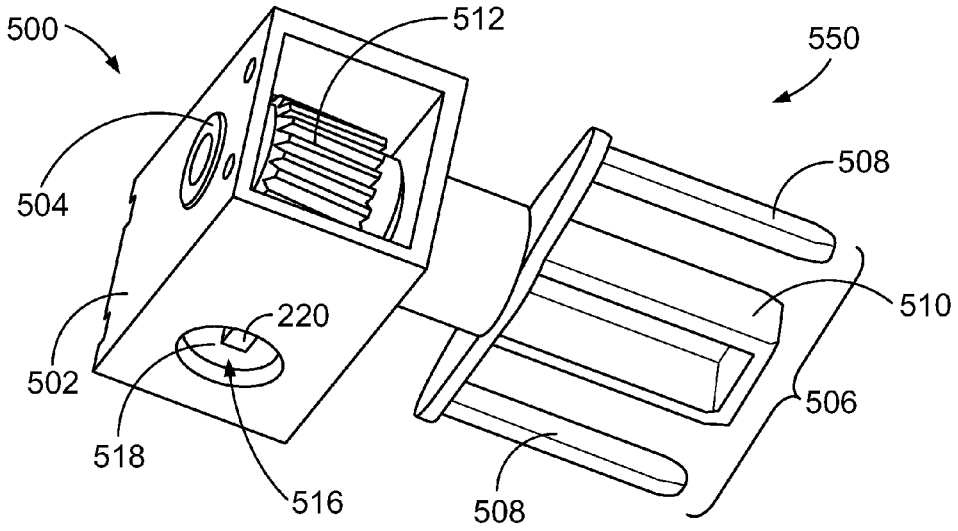
FIG. 25 is a perspective view of a drive mechanism that may be used to rotate adjacent light-controlling members.

Light-controlling members such as slats 450 of FIGS. 23A and 23B may be mounted in the bearing members and other supporting structures described above. Slats 450, in the illustrated embodiment, are plastic extruded to form top and bottom walls 452 and 454. Walls 452 and 454 are each made up of a central segment 456 and lateral segments 458 which define lateral cavities 457 and walled central cavity 459. The slats may be opaque or translucent. An air space 460 is maintained between the top and bottom walls by forming ribs 462 which, in the illustrated embodiment, are disposed perpendicularly at the lateral edges of central segment 456. Slat 450 also has a front face 465 and a back face 467. Also, in the illustrated embodiment, holes 464 are formed in the central segment adjacent the drive end 466 of the slats to facilitate locking the slats to a drive mechanism 550 as shown in FIG. 25, as discussed below. This segmented configuration gives the slats important rigidity characteristics while maintaining light weight and producing minimal interference with light transmission when the assembly is in a fully open position.

Figure 23C:
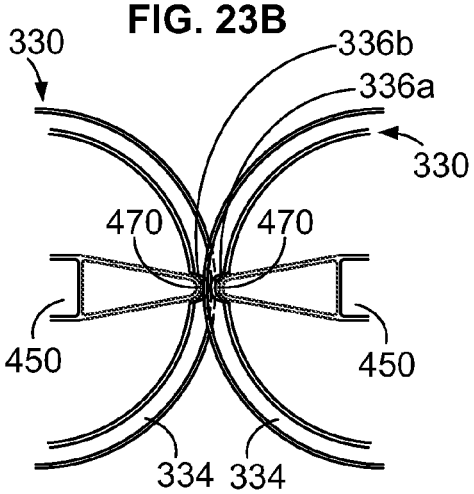
FIG. 23C is partial front elevation view of two light-controlling members as depicted in FIG. 23A highlighting the close-fitting relationship of the member edges when the light-controlling members are in the fully closed position.

FIG. 23C is a representation of two slats 450 resting within slots 36*a* and 36*b* of bearing member 30. In this representation retention flange 334 of the left bearing member will rest against back face 316 of beam 370 while retention flange of the right retention flange 334 of the right bearing member will rest against front face 314 of beam 370. Since the retention flanges of the bearing members are offset in this fashion they do not interfere with each other and thereby make it possible to bring corresponding edges 470 of the two slats far closer together than has been conceived of or implemented in any prior art light-control device.

Figure 23D:
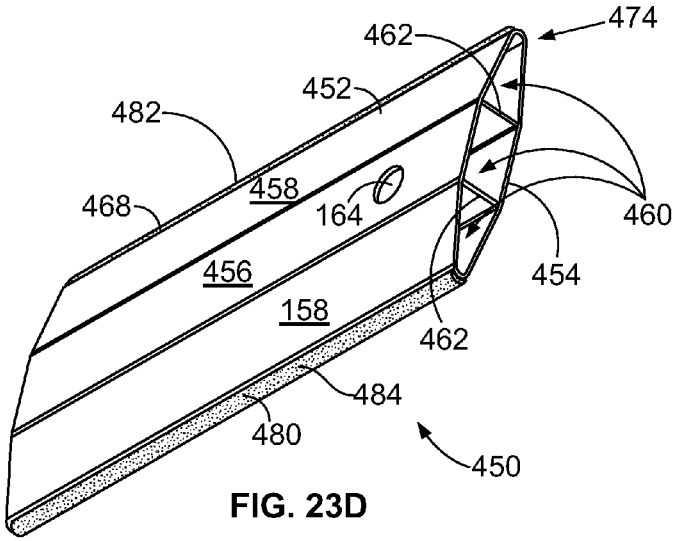
FIG. 23D is a perspective view of an alternative embodiment of the light-controlling member of FIG. 23A in which elastomeric materials is provided along the edges of the light-controlling member.

In an alternate embodiment, slats 474 of FIG. 23D are made laterally compliant by providing them with deformable top and bottom edges 480 and 482 as illustrated in this Figure. These deformable top and bottom edges may be formed by extruding deformable edge shapes, co-extruding flexible edges or otherwise attaching deformable strips 484 to top and bottom edges 480 and 482. Thus, when these slats are in a fully closed position corresponding generally to that depicted in the partial overhead view of FIG. 23E, the deformable/flexible edges will be compressed along web portion 320 of each of the beams leaving virtually all of the remaining space between adjacent slats closed off by the deformable edges beyond the web portions, as illustrated. FIG. 23F is a diagrammatic representation corresponding generally to FIG. 23D which highlights the contact between deformable edges 480 and 482 of slats 474 where the retention flanges of the bearing members are offset on opposite sides of the beam. If the edge shapes are sufficiently deformable, an enlarged web thickness A' may be used and the flanges of adjacent bearings need not be offset so long as the total width of the flanges of adjacent bearings is less than or equal to the thickness A' of web portion 320 between the bores to preclude interference between the flanges of the adjacent bearings.

Light-controlling members as illustrated in FIGS. 23A-23E (and FIGS. 35A-39B and 40A-41 as described below) may be mounted in the bearing members. The light-controlling members may be extruded plastic. For example, light-controlling members in the form of slats 450 may be plastic extruded to form top and bottom walls 452 and 454. Walls 452 and 454 are each made up of a central segment 456 and lateral segments 458 which define lateral cavities 457 and a walled central cavity 459. The slats may be opaque or translucent. The spacing between top and bottom walls 452 and 454 is maintained by ribs 462 which, in the illustrated embodiment, are disposed perpendicularly to top and bottom faces 465 and 469 of central segment 456. Also, holes 464 may be formed in the central segment adjacent the drive end 466 of the slats to facilitate locking the slats to a drive mechanism such as mechanism 550 shown in FIG. 25 and as discussed below. This segmented configuration gives the slats important rigidity characteristics deriving from the central and lateral segments while maintaining light weight and producing minimal interference with light transmission when the assembly is in a fully open position.

The illustrated configuration of slats 150 and 151, as well as the slats of FIGS. 35A-39B, gives them desirable longitudinal, torsional, and deflection rigidity. The term "torsional rigidity" is intended to refer to the ability of the slats to resist deformation when forces are applied to rotate them within the light-control assembly. "Longitudinal rigidity" is intended to refer to the ability of the slats to withstand deformation or deflection when a force is applied generally along the longitudinal axis of the slats such as when the slats are slid into the light-control assembly, as will be described in more detail below. "Deflection rigidity" is intended to refer to the ability of the slats to withstand bowing under the force of gravity or other forces which act generally perpendicularly to the longitudinal axis of the slats.

The top and bottom walls of slat 450 join together to form laterally spaced top and bottom edges 468 and 470. In the illustrated embodiment, these edges are dimensioned to fit into the opposed slots 336*a* and 336*b* of bearing members 330 although they may, of course, be used with other bearing member designs or even mounted without bearings. Thus, when the mounted slats are rotated into the closed configuration illustrated in FIG. 23B light will be able to pass only in the gap 472 between the adjacent slats.

The various slats described herein may include photovoltaic solar cells to general electricity, preferably in conjunction with means for maximizing the photovoltaic output by rotating the light-controlling members with movement of the sun across the sky to insure that the photovoltaic solar cells continuously receive the maximum possible sunlight exposure while providing daylighting into the space below.

Figure 24:
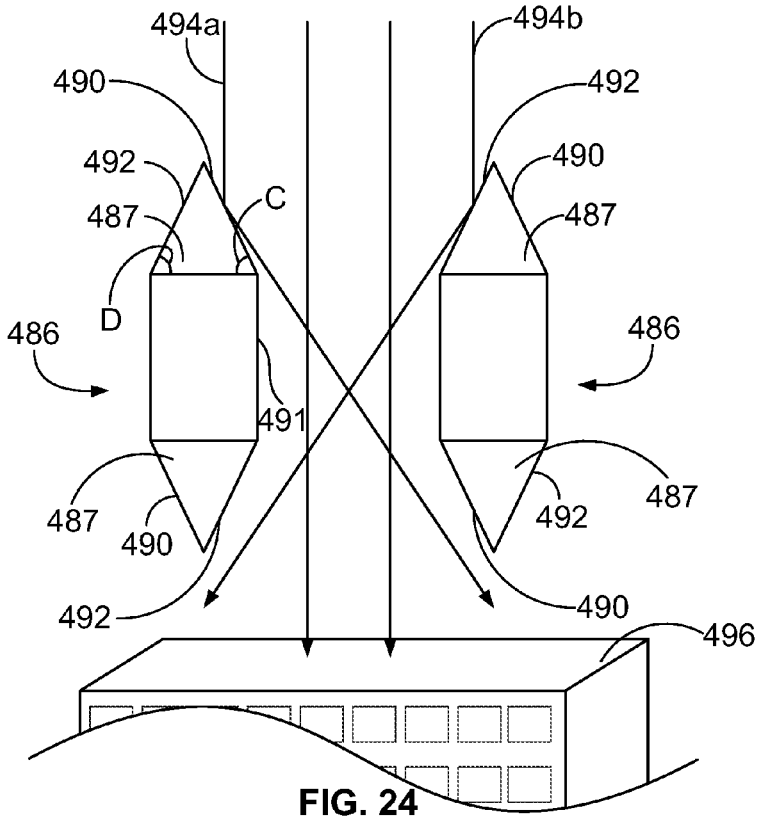
FIG. 24 is a diagrammatic representation of two light-controlling members fitted with reflective surfaces to maximize light transmission when the light-controlling members are in the open position.

FIG. 24 illustrates another important feature with respect to slat design 486 in which, for purposes of illustration, triangular top and bottom segments 487 with opposite beveled faces 490 and 492 are emphasized. Angles "C" and "D" of triangular top and bottom segments 487 preferably should be greater than 45 degrees. Slats 486 may be fit within bearing members in the same fashion as slats 450 and 474, described above. In accordance with the teaching above, segments 490, 491 and 492 (and preferably the corresponding segments on the opposite face of the slat) will be opaque, translucent, spectral controlling or reflective. Thus, when slat 486 is in the fully open position illustrated in this figure and segment 490 has a reflective surface most of the incoming light hitting that surface will be reflected into the area below shown diagrammatically as an enclosed area 496. When segment 490 is, e.g., white opaque, an estimated 60% of the incoming light hitting that surface will be reflected into the area below. Finally, when segment 490 is translucent an estimated 30% of the incoming light hitting that surface will be reflected into the area below. This is depicted diagrammatically in FIG. 24 which shows light rays 494*a* and 494*b* striking surfaces 490 and 492 of adjacent open slats and being directed downwardly to the area below the slats. Of course, when the slats are rotated 90 degrees to their closed position, they will block, reflect, etc. some or all of the incoming light, as described earlier.

Finally, it is noted with respect to slats 486 that the light-reflective surfaces of segments 490, 491 and/or 492 may be micro-prismatic reflective surfaces. Total light enhancement can be achieved by positioning such micro optical prisms to tunnel additional light into the interior space below the light-controlling members.

Figure 35A:
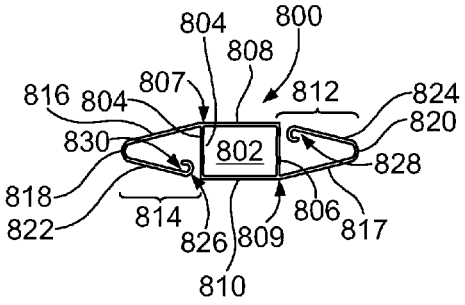
FIGS. 35A-35C are cross-sectional views of light blocking members in the form of slats with compliant lateral segments.

Turning now to FIG. 35A, a laterally compliant light-blocking member in the form of slat 800 is shown. This slat includes a walled central cavity 802 corresponding generally to walled central cavity 459 of slat 450 (FIG. 23A). Central cavity 802 comprises side ribs 804 and 806 which are joined to the top and bottom faces 808 and 810 of the central cavity.

Slat 800 also includes laterally compliant lateral segments 812 and 814 which are generally triangular in shape. These lateral segments include first legs 816 and 817 which extend from ribs 804 and 806 respectively forming resilient joints 807 and 809.

Each of first legs 816 and 817 of the lateral segments curves back upon itself to form respective preferably rounded apices 818 and 820 and second legs 822 and 824 which are directed toward side ribs 804 and 806. Unlike first legs 816 and 817, however, second legs 822 and 824 are not attached to the ribs, but rather stop short of the ribs as shown at free ends 826 and 828. Preferably, free ends 826 and 828 of second legs 822 and 824 curve inwardly to form radii 830.

Figure 23E:
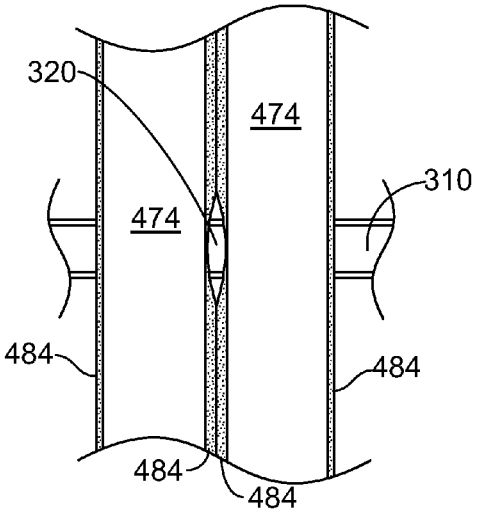
FIG. 23E is a top partial view of two adjacent light-controlling members as depicted in FIG. 23D in the fully closed position, with the top of the light-controlling assembly removed to facilitate the depiction.
Figure 23F:
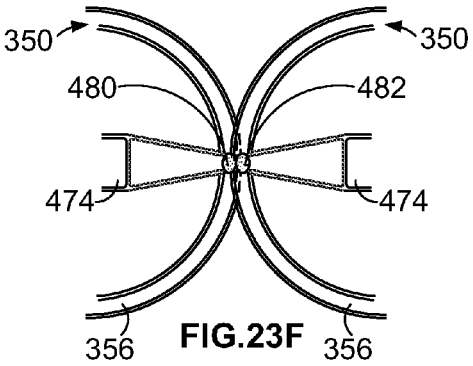
FIG. 23F is partial front elevation view of two light-controlling members as depicted in FIG. 23D highlighting the close-fitting relationship of the member edges in the fully closed position.

Thus, when slat 800 is mounted to beam 70 and the slats are rotated into their fully closed position, apices 818 and 820 of adjacent slats will intersect causing first legs 816 and 817 to comply or flex inwardly about resilient joints 807 and 809 producing a like compression at web portions 320 (whether of smaller thickness A or larger thickness A'), as illustrated for slats 174 in FIGS. 23D and 23E. As also shown in FIGS. 23D and 23E, virtually all of the remaining space between adjacent slats will be closed off at intersecting apices 518 and 520 of adjacent slats to produce a black-out or near black-out condition along nearly the entire length of the slats.

Figure 35B:
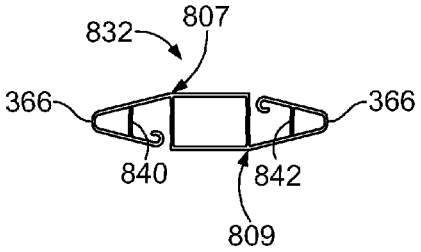

Turning now FIG. 35B, a similar slat design 832 is shown. Slat 832 thus corresponds to slat 800 of FIG. 35A except that strengthening ribs 840 and 842 extend between legs 816/822 and 817/824 to increase the rigidity of lateral segments 812 and 814, causing the lateral compliance of the slat to be focused on flexure about joints 807 and 809 where the slats encounter the web portions of the beams in which the slats are mounted. Thus, when slats 832 are in the fully closed position, the second legs will be bent about joints 807 and 809 at web portions 320 while beyond the web portions their apices 818 and 822 will be closely abutting.

Figure 35C:
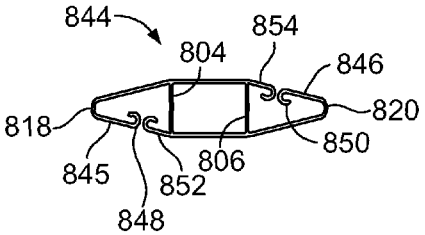

FIG. 35C illustrates yet another laterally compliant slat 844. The structure of this slat corresponds to slat 800 through apices 818 and 820. However, in this design second legs 845 and 846 which correspond generally to second legs 822 and 824 of slat 800 are shortened and so have free ends 848 and 850 spaced from third legs 852 and 854 which extend from top and bottom faces 808 and 810 toward second legs 845 and 846 and are generally coplanar with these second legs. Legs 845/852 and 846/854 have respective free ends which preferably curve inwardly to form corresponding radii as shown. Thus, when the slats comply laterally at web portions 320 of the beams in which they are mounted and along the intersecting apices of adjacent slats, the radii will meet and bypass each other where the side segments be compressed beyond the point of intersection of the radii.

Figure 36A:
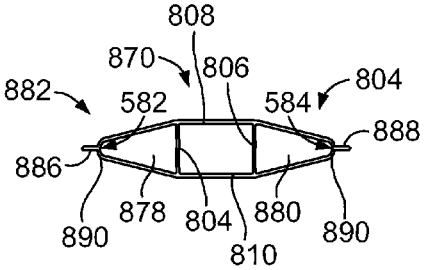
FIGS. 36A-36D are cross-sectional views of alternative slat embodiments with laterally compliant edges comprising flat-resilient gaskets, hook shaped gaskets, and beads of resilient material.

FIG. 36A shows another slat embodiment 870 in which the lateral segments are closed triangles. The structure of this slat thus corresponds generally to slat 800. Here, however, the second legs are attached to side ribs 804 and 806 adjacent to the point at which they are in turn attached to top and bottom faces 808 and 810 thus forming rigid triangular lateral segments 878 and 880. Additionally, outwardly directed generally flat resilient gaskets 886 and 888 project from the apices 882 and 884 of the lateral segments. Gaskets 886 and 888 may be made of any suitable resilient material such as rubber or an appropriate flexible plastic. These gaskets may be coextruded with the rest of the slats using conventional techniques either along the apices 882 and 884 or along an outside surface 890 of either of the first or second legs of each of the lateral segments. The gaskets may also be glued in place using conventional techniques.

Gaskets 886 and 888 preferably will be opaque or near-opaque. Since the gaskets are resilient they will bend out of the way when slats 870 are inserted into the beams facilitating assembly of the system. And, when the slats are rotated into a fully closed or near-fully closed position, the gaskets will closely abut except at web portions 320 to achieve a black-out or near black-out condition along nearly the entirety of the closed slats. Also, since the gaskets are resilient, the slats may be rotated past the point of intersection so that the gaskets flex past each other.

Figure 36B:
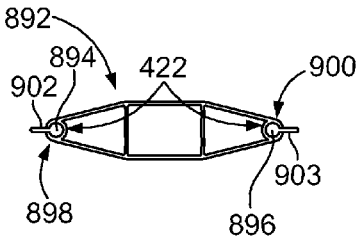

FIG. 36B illustrates a slat design 892 that corresponds to slat 870 of FIG. 36A except that cavities 894 and 896 are formed in apices 898 and 900. In the illustrated embodiment cavities 894 and 896 are circular but they may be of other shapes. Resilient gaskets 902 and 903 having an enlarged base position are press fit or otherwise attached to cavities 904 and 905. Gaskets 902 and 903 will operate like gaskets 886 and 838 of FIG. 36A.

Figure 36C:
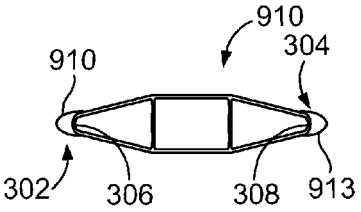

FIG. 36C illustrates yet another slat design 910 which corresponds generally to slat 870 of FIG. 36A except that beads 912 and 913 of resilient material providing lateral compliance are located along apices 914 and 916 of the slat. Beads 912 and 913 may be made of foam rubber, or other suitable opaque or near opaque resilient material. Resilient beads 912 and 913 may be attached by any appropriate means including co-extrusion, RF gluing or through the use of appropriate adhesives.

Figure 36D:
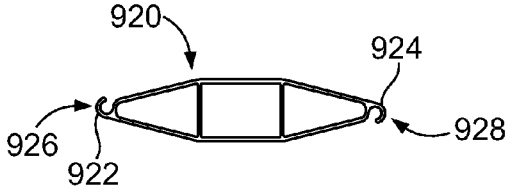

Turning now to FIG. 36D, another slat design 920 corresponding generally to the slat design of FIG. 36A is illustrated which differs in that gaskets 922 and 924 are radiused inwardly to produce a hook-like shape as shown presenting curved outer surfaces 926 and 928 and respective upwardly and downwardly directed cavities. These curved outer surfaces facilitate lateral compliance and will hook together where the slats are fully closed to achieve enhanced light-blocking Since they are resilient, they also may bypass as the slats are rotated beyond the fully closed position.

Figure 37A:
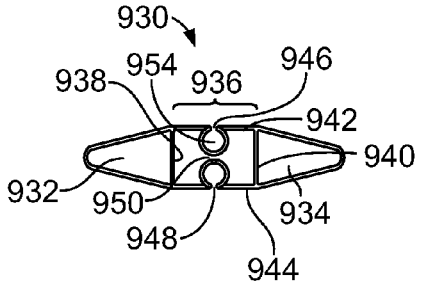
FIGS. 37A-37C are cross-sectional views of still further slat embodiments in which compliant lateral segments are provided with flexible links.

FIG. 37A illustrates yet another slat design 930. In this design, the lateral segments are closed triangles 932 and 934 as in the embodiments of FIGS. 36A-36D. However, here walled central cavity 936 is designed to supply the desired lateral compliance. Central cavity thus includes side ribs 938 and 940 and top and bottom faces 942 and 944. The top and bottom faces, however, are interrupted at their midpoints 946 and 948 a central flexible link 950. The flexible link enables the slats to flex inwardly at web portions 320 while achieving a black-out or near black-out condition along the rest of the abutting slats when they are in a closed position.

Figure 37B:
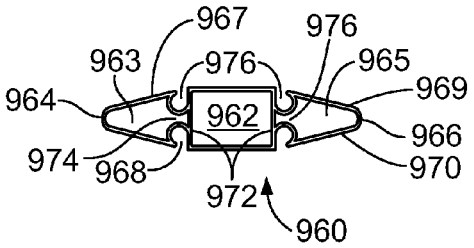

FIG. 37B shows a further slat embodiment 960. In this embodiment, walled central cavity 962 is a closed rectangle and lateral segments 963 and 965 are generally in a triangular arrowhead shape. The lateral segments have opposite apices 964 and 966 at their lateral edges and are designed to flex inwardly to give the slat the required lateral compliance. Thus, first and second pairs of legs 967/968 and 969/970 are attached to the opposed lateral segments 972 of the walled central cavity by flexible links 974/976.

Figure 37C:
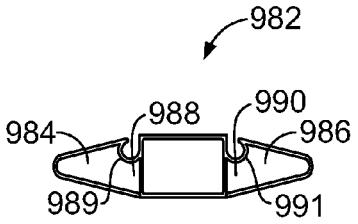

FIG. 37C illustrates a slat 982 that is similar to slat 960 of FIG. 37B except that the lateral segments 984 and 986 of slat 982 have flexible links 988 and 990 formed by cut-outs 989 and 991 at the top of each of lateral segments. In an alternate embodiment the flexible links may be offset by placing the cutouts on opposite sides of the lateral segments.

Figure 38:
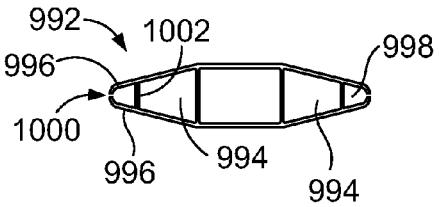
FIG. 38 is another slat design in which the lateral segments are triangular and are split at their apices.

Turning now to FIG. 38, a slat design 992 is shown in which the lateral segments 994 are provided with laterally extending pairs of legs 996 which establish elongated open cavities 998 split at their apices 1000. The lateral segments are also preferably provided with reinforcement legs 1002 as shown. The legs are able to laterally conform by flexing out of the way when the slats are inserted into the beams and to return to their initial configuration beyond web portions 320 between the bores to achieve black-out or near black-out along the slats beyond the web portions when the slats are closed.

Figure 39A:
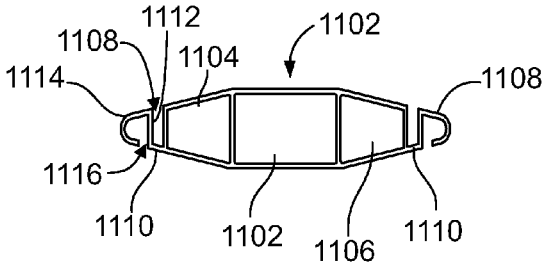
FIG. 39A is a cross-sectional view of a slat with flexible members attached to lateral segments by flexible arms.

FIG. 39A depicts yet another laterally compliance slat design 1100. This slat design includes a walled central cavity 1102, and lateral segments 1104 and 1106 which are trapezoidal in shape. The lateral compliance of the slats is achieved by flexible members 1108 which are attached to the lateral segments by flexible arms 1110. The flexible members may be any desirable shape. In this embodiment they each include a base 1112 and a curved portion 1114 extending from the base to leave a space 1116 at its distal end. This design therefore allows for flexure both at the flexible arms 1110 and at the point of attachment of the flexible members 1114 to base 1118.

Figure 39B:
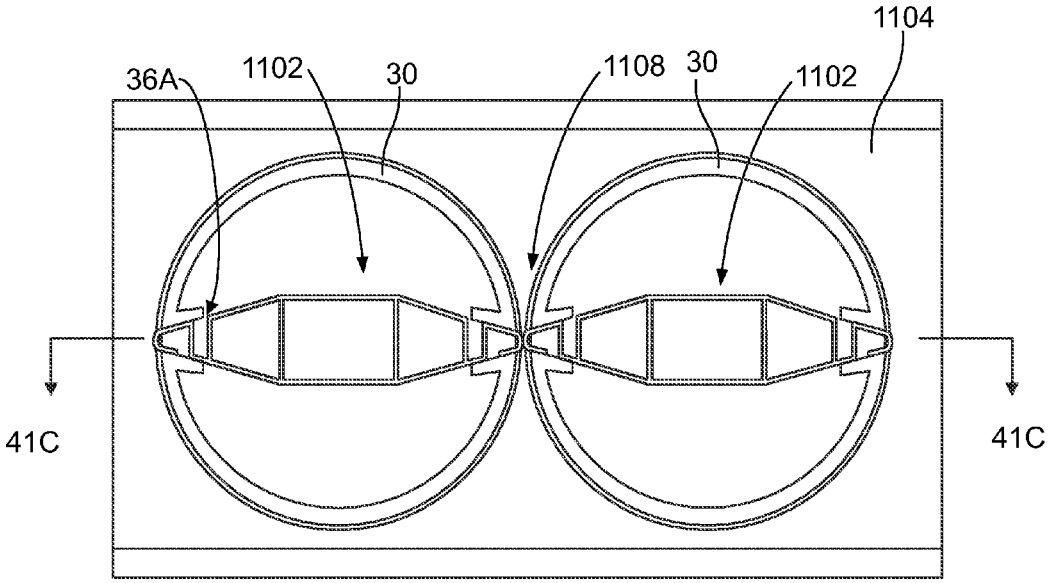
FIGS. 39B and 39C are, respectively, cross-sectional diagrammatic views of two adjacent slats in accordance with FIG. 39A mounted on a beam, as seen in cross-sectional elevation and plan views.

FIG. 39B shows a pair of adjacent slats 1102 mounted in bearings beam 1104. As can be seen in this figure, the flexible members are shaped and dimensioned to rest within the diametrically opposed notches 36A and 36B of the bearings.

Figure 39C:
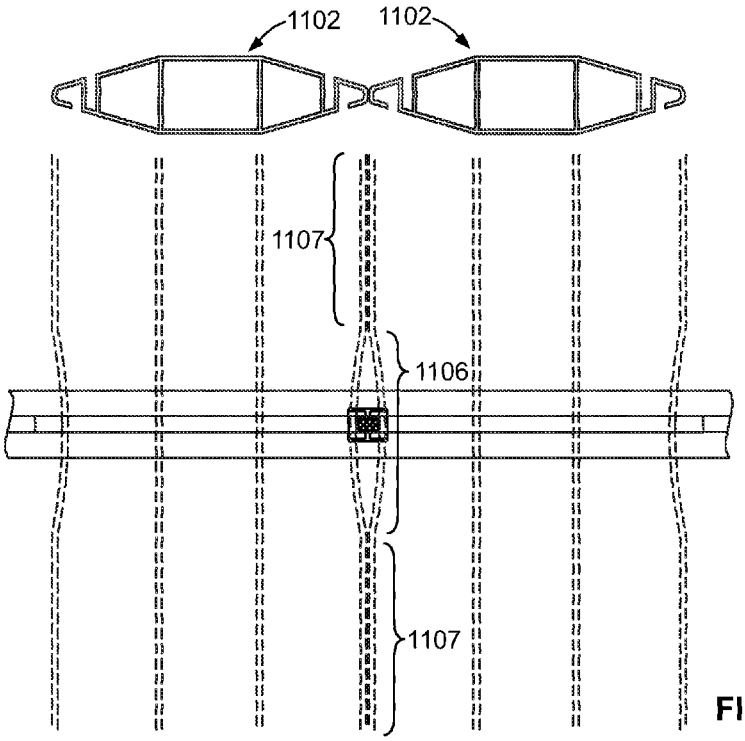

FIG. 39C is a top diagrammatic representation of slats 1102 in a fully closed position. As can be seen in this figure, the slats are closely abutting along 1107 and only slightly spaced at area 1106 where they pass around the web between the adjacent slats.

Figure 39D:
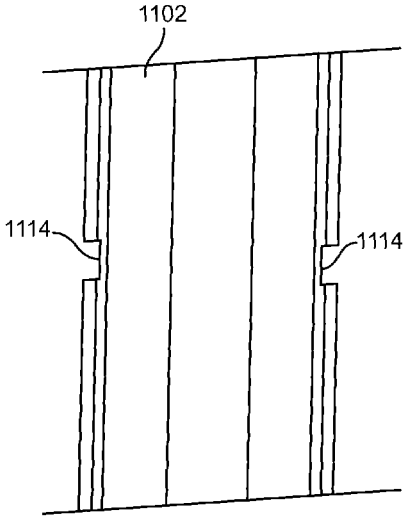
FIGS. 39D and 39E are top-plan partial views of slats with notches along their lateral edges.
Figure 39E:
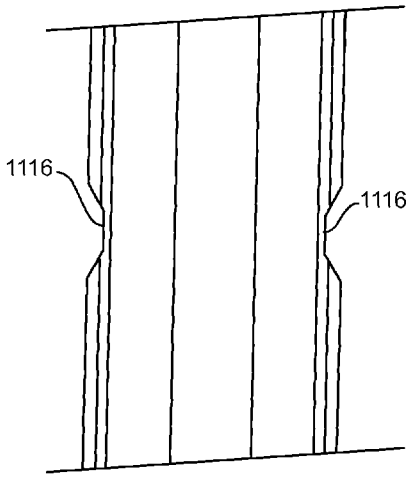

Additionally, it is noted that the slats may be notched where they pass across the webs in the bearing members. This is shown in FIGS. 39D and 39E. For example, in FIG. 41D slat 1102 has a pair of rectangular notches 1114 along its opposite lateral edges. These notches are formed to fit about the bearings to which the slats are mounted to improve light blocking. In FIG. 41E, corresponding notches cut-outs 1116 are trapezoidal in shape. In both cases, these notches permit the slats to product even closer to total black-out when they are in their closed position by reducing area 1106 of FIG. 1C 39C.

Figure 39F:
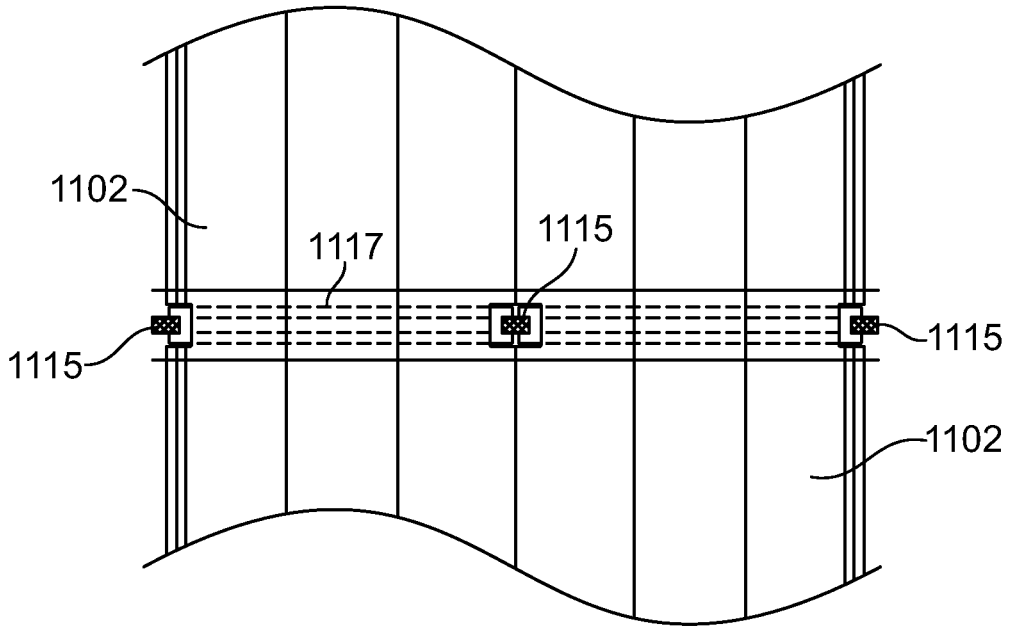
FIG. 39F is a partial top-plan partial view of a pair of slats in which rectangular notches are shown juxtaposed next to beam webs.

FIG. 39F is a top plan view of a pair of slats 1102 in which rectangular notches 1114 are shown juxtaposed next to webs 1115 in beam 1117. As can be seen in these figures, the notches are slightly larger than the width of the webs. As a result, friction between the edges of the slats and the webs is greatly reduced if not entirely eliminated. Second, this spacing will accommodate lateral expansion of the slats under normal operating conditions. Finally, the small rectangular gaps formed by the notches in the slats may be seen from a distance but due to their regular repeating geometrical shape, will be aesthetically desirable.

Figure 40A:
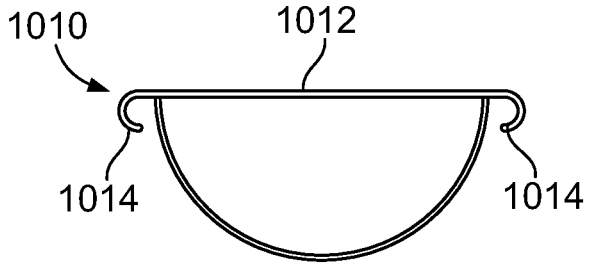
FIGS. 40A and 40B are cross-sectional views of hemispherical light-blocking members having flexible outer lips to provide lateral compliance.
Figure 40B:
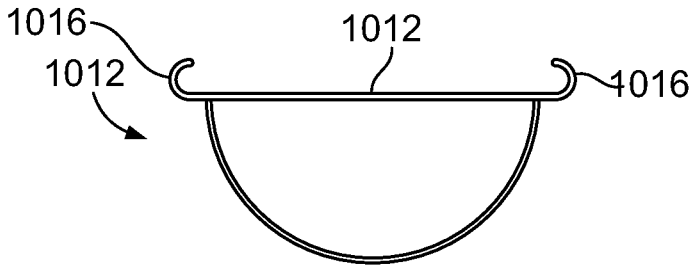

FIGS. 40A and 41B illustrate hemispherical light-blocking member 1010 and 1012 generally in accord with the cylindrical embodiments of FIGS. 20A-20E having a light-blocking component 1012. In FIG. 40A the hemispherical member is provided with flexible downwardly curving lips 1014 (which curve away from the outer hemispherical surface) and in FIG. 40B the hemispherical light-blocking member is provided with flexible upwardly curving lips 1016 (which curve toward the outer hemispherical surface).

In both cases, the lips will laterally conform when the light-blocking members are inserted into the beams and return to their uncompressed configuration beyond web portions 320 between the bores to achieve black-out or near black-out along the slats beyond the web portions when the slats are closed.

Figure 41:
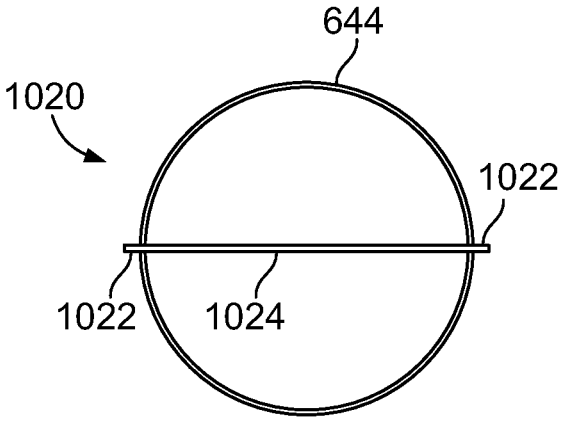
FIG. 41 is a cross-sectional view of a tubular light-blocking member with diametrically opposed flexible lips to provide lateral compliance.

Next, FIG. 41 illustrates a tubular light-blocking member 1020 which includes diametrically opposed generally flat flexible lips 1022 which extend outwardly from the outside surface of the tubular member, opposite the edges of their central light-blocking component 1024. These flexible lips will laterally conform when the light-blocking members are inserted into the beams and return to their uncompressed configuration beyond web portions 320 between the bores to achieve black-out or near black-out along the slats beyond the web portions when the slats are closed.

The various resilient features of FIGS. 35A-41 comprise resilient means that achieve compliance or flexibility along the edges of the light-blocking means.

A drive mechanism 500 that may be used is illustrated in FIG. 25. The drive mechanism includes a gear box 502 having a shaft 504 with a mounting comb 506 having tines 508 positioned and dimensioned to fit within lateral cavities 357 of slat 350 and a central member 310 dimensioned and positioned to fit within the central cavity 459 of slat 450. The mounting comb thus retains the slat on the drive mechanism. Central member 510 may also have a projection (not shown) that fits in hole 464 of the slat to lock the slat onto the comb.

Worm gear 512 (mounted onto shaft 504 of the mounting combs) meshes with an internal worm (not shown) having a circular axial cavity 516 with a key 518. Thus a rotation shaft 22 with a corresponding slat to receive key 218 is designed to be passed through cavities 216 of drive mechanisms 200 associated with each of a series of slats in a modular light-control assembly. As a result, rotation of the shaft will produce corresponding and coordinated rotation of all of the slats associated with drive mechanisms attached to the shaft.

Figure 26:
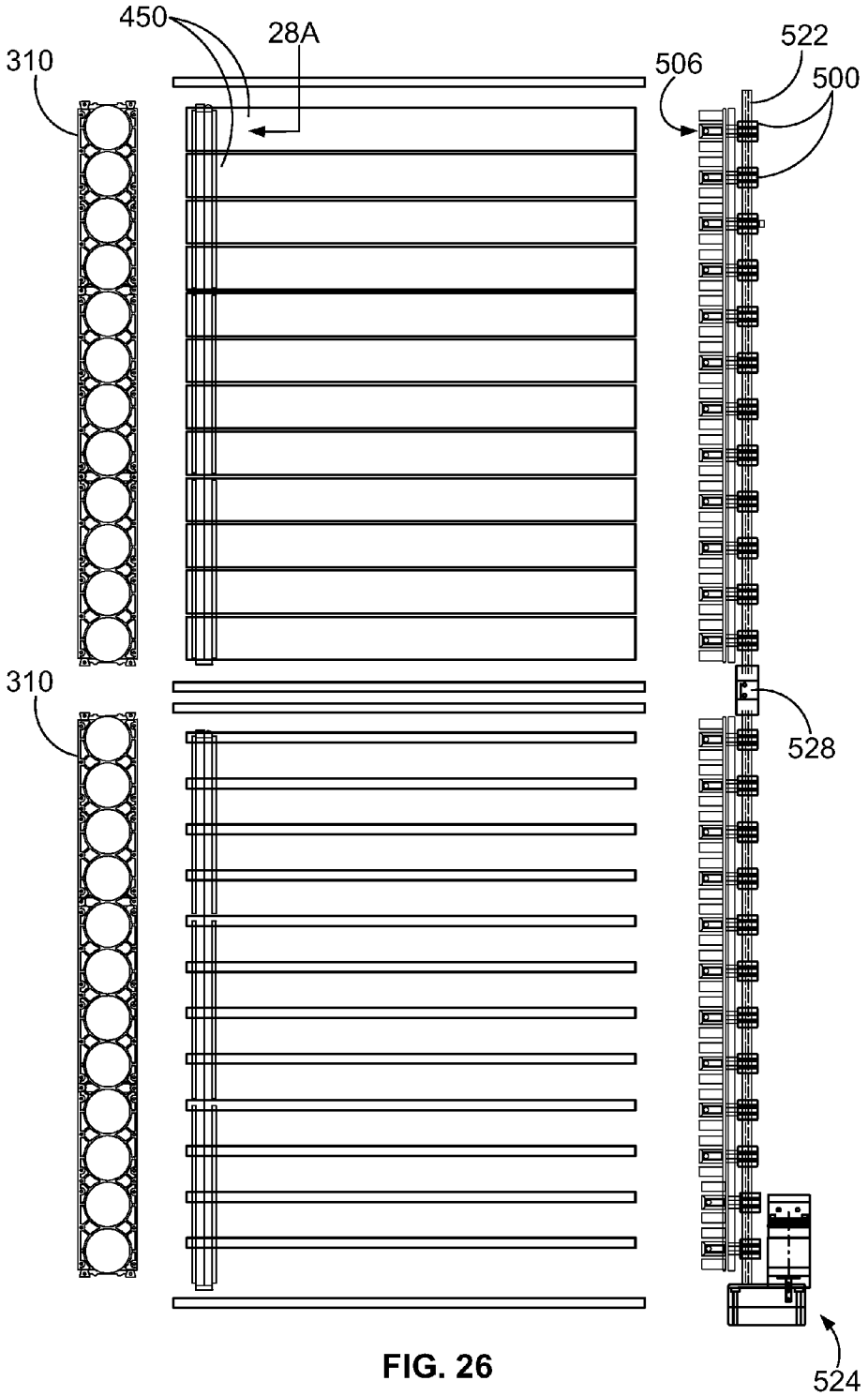
FIG. 26 is a diagrammatic representation of an installation including drive gears, light-controlling members in open and closed positions, light-controlling assemblies and associated side framing.
Figure 26A:
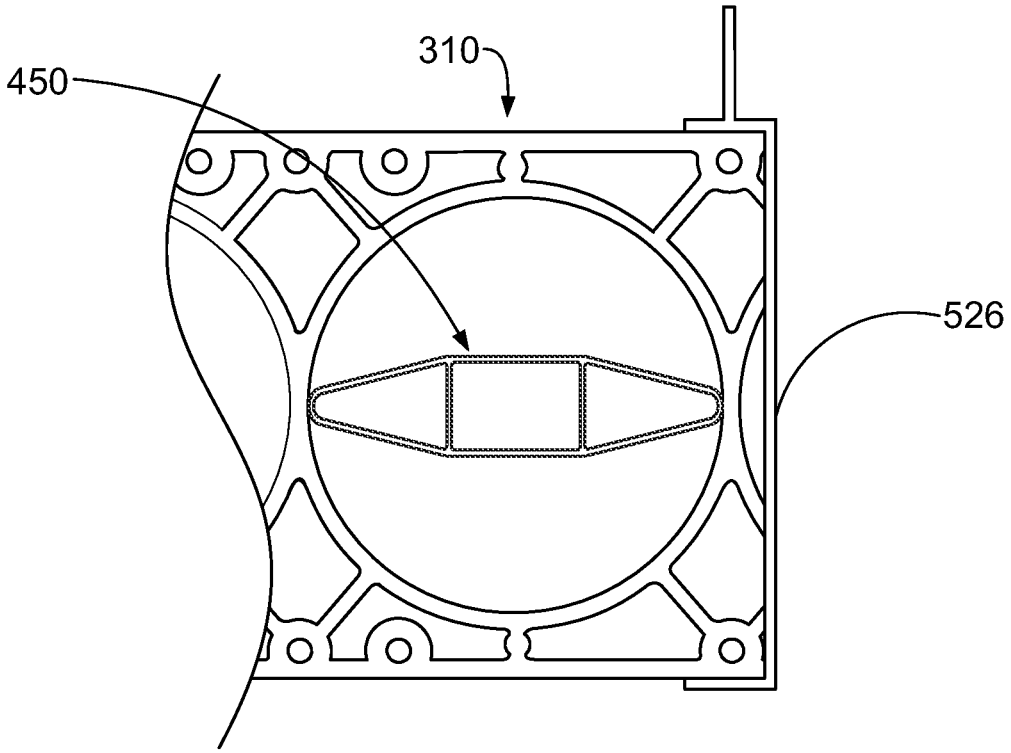
FIG. 26A is a partial end view taken along line 26A of FIG. 26 of a light-control assembly beam mounted in a side beam.

This is illustrated in FIG. 26 which shows, at the top of the figure, a series of 12 slats 450 in the closed position above a series of 12 slats in the open position at the bottom of the figure. The slats are supported in a light-control assembly 310 which is shown at the left of the figure, rotated 90 degrees to better view of the light-control assembly. In fact, a series of such light-control assemblies will be spaced along these slats at appropriate distances to ensure that the slats are maintained properly in position. The light control assemblies can be mounted in side beam 526 as shown in FIG. 26A. It should also be noted that each light-control assembly 310 in this figure comprises two beams, each having six circular bores 318 joined at their corresponding trapezoidal projections and trapezoidal cavities, as discussed earlier.

Looking to the right of FIG. 26, a series of 24 drive mechanisms 500 are shown each with mounting combs 506. While the mounting combs are shown removed from the slats for purposes of illustration, in operation the mounting combs, of course, will be positioned in the ends of the slats, as described earlier. Finally, shaft 522 passes through keyed circular openings 518 in each of the drive mechanisms. Thus, a motor 524 attached to the shaft can be used to simultaneously rotate all of the slats. Finally, connectors 528 may be used to create as wide assembly as needed by connecting a series of shafts 522. For example, in one modular single motor design, an assembly of 40' wide×40' long can be constructed with up to 240 slats operated by a single motor.

Figure 27A:
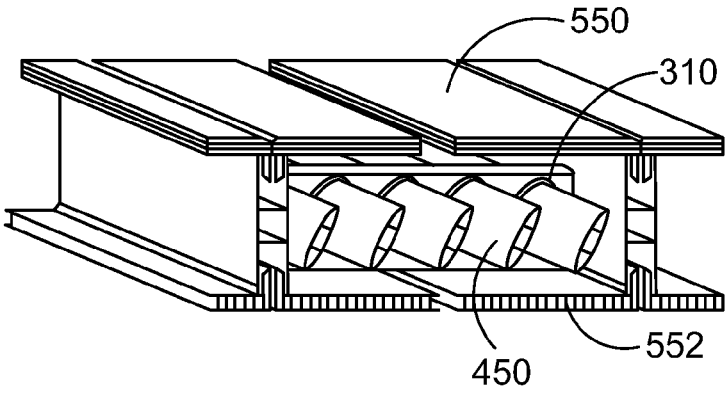
FIGS. 27A-27F are diagrammatic representations of applications of light-control assembly embodiments mounted respectively between top and bottom glazing, below a top glazing, below a skylight, vertically, in inclined applications; and in curved applications.
Figure 27B:
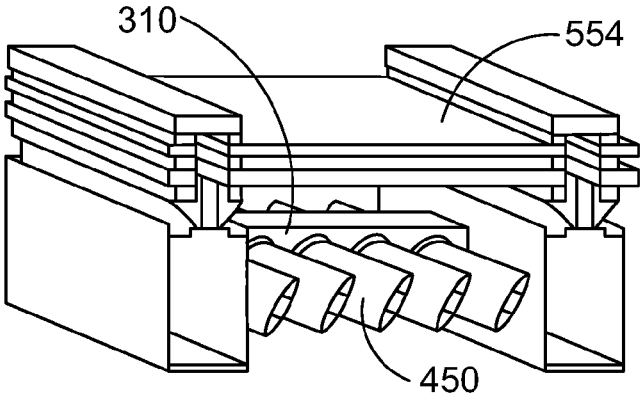
Figure 27C:
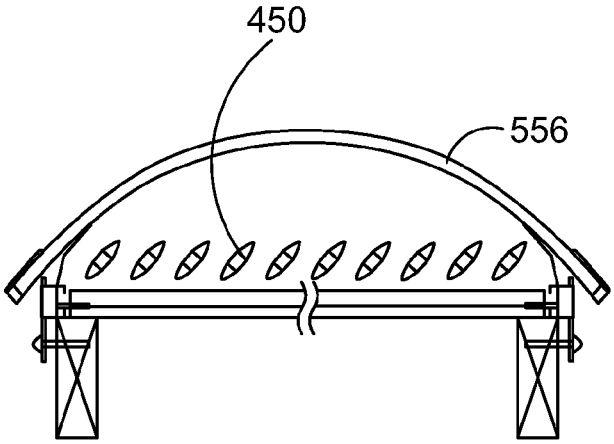
Figure 27D:
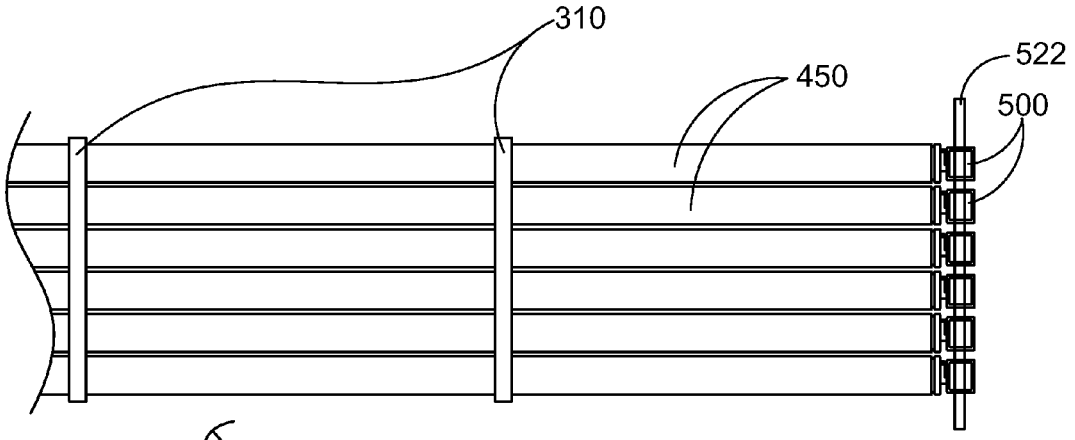
Figure 27E:
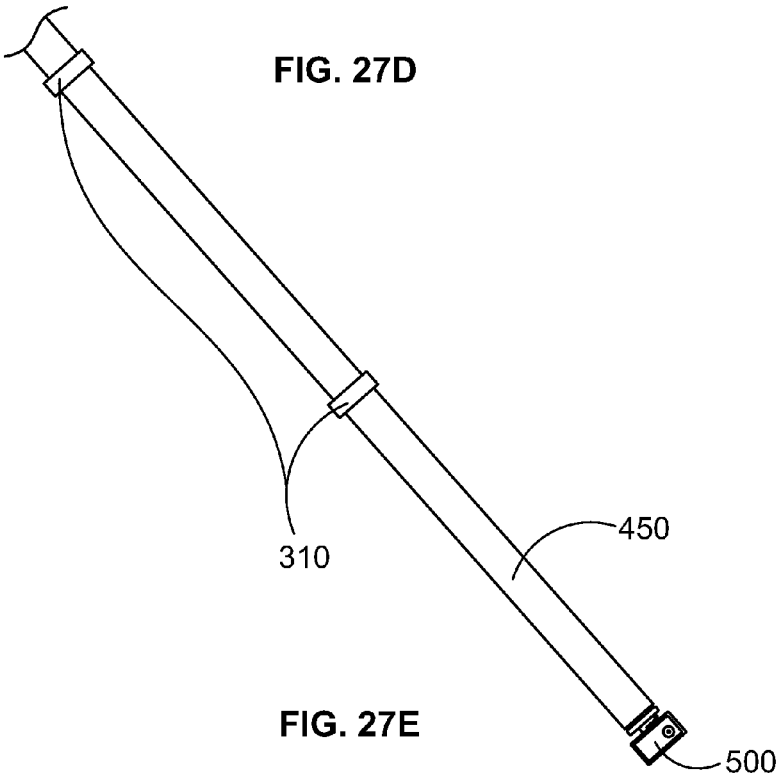
Figure 27F:
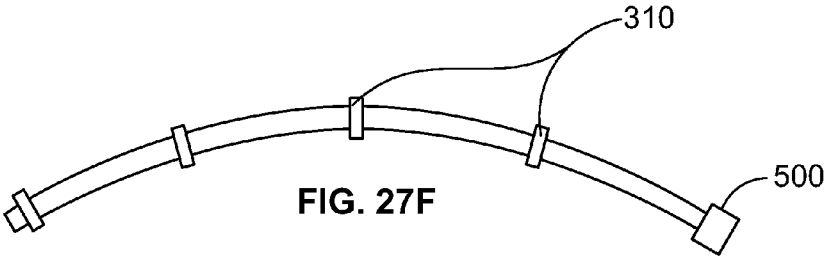

Light-control assembly 310 may be used in a variety of different applications. For example, it may be mounted between clear or translucent panels 550 and 552 as in the embodiment of FIG. 27A. Alternatively, the light-control assembly may be mounted under a clear or translucent sheet 554 as shown in FIG. 27B (or it may be mounted over a clear or translucent sheet). Additionally, the light-control assembly may be mounted under a skylight 556 as shown diagrammatically in FIG. 27C. Alternatively, a light-control assembly may be disposed vertically as shown in FIG. 27D or at inclined angle as shown in FIG. 27E. In yet other embodiments, the light-control assembly may be used in curved applications, as depicted in FIG. 27F. Although the depictions of FIGS. 27D-27F are comprised only light-controlling members 450 and supporting light-control assemblies 310, they may be used with any appropriate light-controlling members and they may be disposed under, over or adjacent to clear or transparent sheets or between pairs of clear or transparent sheets. Finally, the light-control assembly may be used without clear or translucent sheets or panels to shade open unglazed areas.

Panels and sheets 550, 552, 554 and skylight 556 may be made of various transparent and translucent materials, including, but not limited to, plastics (including, e.g., polycarbonates and acrylics), fiberglass, perforated metal fabric, or glass. In one preferred embodiment, a Pentaglas™ honeycomb polycarbonate translucent panel available from CPI Daylighting Inc. (Lake Forest, Ill.) will be used in these applications. These polycarbonate panels, which are described in U.S. Pat. No. 5,895,701 (incorporated herein by reference), have an integral extruded honeycomb structural core consisting of small honeycomb cells approximately 0.16 inch by 0.16 inch which provides internal flexibility to absorb expansion and minimize stress and resists impact buckling. The resulting design offers smaller spans between rib supports, resulting in stronger durability, as well as superior light quality, visual appeal, higher insulation and excellent UV resistance. The internal flexibility of the panels absorbs thermal expansion through the panel in all directions (on the x, y, and z axes). This minimizes stress in all directions and preserves dimensional stability. The panels also have a high impact absorbing and load bearing property, a good ratio of weight to strength, and UV protection on both sides of the panel. The superior light diffusion capabilities ensure excellent quality of natural light. The panels are environmentally friendly, non-toxic, and made of 100% recyclable material.

Also, the light-control assembly may be provided with automatic sun tracking, with appropriate embedded programming that senses the daylight outside and manages the level of light and solar heat gain inside based on the level of sunlight outside. This will enable users to control natural daylight and comfort levels in any space—whether covered by glazing or not—all day long, and all year long, simply by setting desired light levels.

The beam, retainers, and light-controlling members may be made of any desirable material. In one preferred embodiment, these components may be injection molded from polycarbonate resins or acetyl. Preferably at least the bearing members and more preferably all of the components of the light-control assembly will be molded from polytetrafluoroethylene-infused polycarbonate resins. Also, although in the illustrated preferred embodiment the beam, bearing members, retainers, and slats are injection molded, one or more of these components may be made in other ways and may be made of other materials, as appropriate. For example, beam 370 may be made of punched aluminum.

A light-control assembly generally as in FIG. 18 may be assembled as follows:

1. A beam 370 is provided and a series of bearing members, such as bearing members 330, mounted in the bores of the support member with the retention flanges of the bearing members adjacent a face of the beam.

2. Retainers 410 are positioned on opposite faces 314 and 316 of the beam so the tabs 420*a*, 420*b* and 420*c* of the retainers fit in cavities 383*a*, 383*b* and 383*c* of the beams and locking pins 430 are pressed home in locking cavities 432. The retainers are thus locked to the beam with the retention flanges of the bearing members trapped between the back face 429 of the retainer on the opposite faces of the beam.

3. Optionally, the desired number of light-control assemblies 310 are interconnected by aligning trapezoidal projections 386*a* and 386*b* at one end of the beam of each assembly with trapezoidal cavities 402*a* and 402*b* at the other end of the adjacent beam whereupon the projections are slid into the cavities until the adjacent beams lock together, as described earlier, to form an enlarged modular radiation control assembly of the desired length. Also, where two or more beams are laterally connected to form an enlarged assembly, multiple pairs of retainers preferably will be applied offset with regard to the seam between the adjacent interlocked beams to further reinforce the assembly.

4. A series of radiation control assemblies are then positioned longitudinally under, above, between or adjacent the glazing that is to be treated by the light-control assembly with the bores of the radiation-control assemblies aligned. The radiation control assemblies are mounted in place by appropriate means such as by using side beams 526 (FIG. 26A). For modular "cassette" design a mounting jam can be used.

5. Next, light-controlling members such as slats 450 or 474 of the appropriate length are slid into place in the laterally aligned bores of the bearing members so that they are supported within the successive light-controlling assemblies. In the case of slats 450 and bearing members 330, the slats will be slid into diametrically opposed notches 336*a* and 336*b* so that the opposite top and bottom edges 468 and 470 of the slats rest in opposed notch bottoms 338*a* and 338*b*. The longitudinal rigidity of the slats ensures that they can be slid into place in the successive bearing members without buckling. The torsional rigidity of the slats ensures that the slats can be rotated from one end with twisting out of shape. Finally, the deflection rigidity ensures that, one in position, the slats will not sag. Furthermore, it is noted that the overall assembly is thus readily assembled on-site and that can be used in both new construction and retrofit applications. It also ably accommodates thermal expansion and contraction of the components of the assembly, including the light-controlling members, when the assembly is subjected to wide-ranging temperature changes at the site of installation. The slats can move longitudinally within the bearing members free from the limitations imposed by rings and notches as they lengthen or shorten due to temperature swings.

6. Then, the slats are aligned and appropriate drive means attached to the control ends of the slats. "Aligned" in this context means that the slats will be parallel to each other when in the fully opened position and co-planer when in the fully closed position.

7. The resulting light-control assembly is now ready to provide light-blocking from almost full transparency to total black-out or near total black-out at a level of reliability which has heretobefore not been possible.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing embodiments (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments and does not pose a limitation on the scope of the embodiments unless otherwise claimed. No language in the specification should be construed as indicating any non-claimed element as essential to the practice of the embodiments.

Preferred embodiments are described herein, including the best mode known to the inventors for carrying them out. Variations of those preferred embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, embodiments include all modifications and equivalents of the subject matter recited in the claims appended hereto as permitted by applicable law. Moreover, any combination of the above-described elements in all possible variations thereof is encompassed embodiments unless otherwise indicated herein or otherwise clearly contradicted by context.

What is claimed is:

1. A closed light-control assembly comprising:

a beam having first and second opposed faces and at least two adjacent circular bores extending through the beam between the opposed faces and beam web portions separating the adjacent circular bores; and light-controlling members with resilient laterally compliant edges forming diametrically opposed hook-shaped gaskets presenting hooking outer curved surfaces rotatably mounted in the bores and passing therethrough, with corresponding portions of the resilient laterally compliant edges of the light-controlling members abutting adjacent to the beam web portions and the portions of the resilient laterally compliant edges of the light-controlling members opposite the beam web portions flexing away from the beam web portions to enable the resilient laterally compliant edges to pass around the beam web portions.

2. A closed light-control assembly comprising:

a beam having first and second opposed faces and at least two adjacent circular bores extending through the beam between the opposed faces and beam web portions separating the adjacent circular bores; and light-controlling members with resilient laterally compliant edges in the form of diametrically opposed hook-shaped gaskets presenting hooked together outer curved surfaces rotatably mounted in the bores and passing therethrough, corresponding portions of the resilient laterally compliant edges of the light-controlling members abutting adjacent to the beam web portions and flexing away from the beam web portions to enable the resilient laterally compliant edges to pass around the beam web portions.

3. The light-control assembly of claim 2 in which the light-controlling members include a walled central cavity and laterally disposed compliant lateral segments.

4. The light-control assembly of claim 2 in which the light-controlling members are opaque, translucent, reflective or spectral controlling.

5. The light-control assembly of claim 2 in which the resilient diametrically opposed hook-shaped gaskets provide the laterally compliant edges.

6. The light-control assembly of claim 2 in which the light-controlling members and the hook-shaped gaskets are opaque or near-opaque.

7. The light-control assembly of claim 2 in which the resilient laterally compliant edges comprise diametrically opposed beads of resilient material.

8. The light-control assembly of claim 2 in which the hook-shaped gaskets have respective upwardly and downwardly opening hooked together cavities.

9. The light-control assembly of claim 2 in which the light-controlling members include a walled central cavity and laterally disposed compliant lateral segments.

10. The light-control assembly of claim 2 in which the laterally compliant lateral segments are triangular in shape.

11. The light-control assembly of claim 2 in which the lateral segments are triangular and their apices opposite the walled central cavity are open to permit the lateral segments to flex.

12. The light-control assembly of claim 2 in which at least one wall of the central cavity is compliant.

* * * * *